US011067327B2

(12) United States Patent
Alexander et al.

(10) Patent No.: US 11,067,327 B2
(45) **Date of Patent: *Jul. 20, 2021**

(54) PORTABLE COOLER WITH ACTIVE TEMPERATURE CONTROL

(71) Applicant: Ember Technologies, Inc., Westlake Village, CA (US)

(72) Inventors: Clayton Alexander, Westlake Village, CA (US); Daren John Leith, Agoura Hills, CA (US); Mikko Juhani Timperi, San Marcos, CA (US); Christopher Thomas Wakeham, Solana Beach, CA (US); Jacob William Emmert, Westchester, CA (US); Joseph Lyle Koch, Anaheim, CA (US); Frank Victor Baumann, San Diego, CA (US); Clifton Texas Lin, San Diego, CA (US); Farzam Roknaldin, Coto De Caza, CA (US); Mark Channing Stabb, Solana Beach, CA (US)

(73) Assignee: Ember Technologies, Inc., Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/889,005

(22) Filed: Jun. 1, 2020

(65) Prior Publication Data

US 2020/0333057 A1 Oct. 22, 2020

Related U.S. Application Data

(63) Continuation of application No. 16/389,483, filed on Apr. 19, 2019, now Pat. No. 10,670,323.
(Continued)

(51) Int. Cl.
*F25D 11/00* (2006.01)
*F25B 21/04* (2006.01)

(52) U.S. Cl.
CPC ..... *F25D 11/003* (2013.01); *F25B 21/04* (2013.01); *F25B 2321/0212* (2013.01);
(Continued)

(58) Field of Classification Search
CPC .... F25D 11/003; F25D 2700/12; F25D 17/06; F25D 2400/40; F25D 2400/361; F25B 21/02; F25B 2321/0251; F25B 2321/0212
See application file for complete search history.

(56) References Cited

U.S. PATENT DOCUMENTS 1,649,067 A 11/1927 Karlson
1,721,311 A 7/1929 Muenchen
(Continued)

FOREIGN PATENT DOCUMENTS

CH 631614 8/1982
CN 1338240 A 3/2002
(Continued)

OTHER PUBLICATIONS

Australian Examination Report regarding Application No. 2016216669, dated Feb. 14, 2019, four pages.
(Continued)

*Primary Examiner* — Ana M Vazquez
(74) *Attorney, Agent, or Firm* — Knobbe, Martens, Olson & Bear LLP

(57) ABSTRACT

A portable cooler container with active temperature control system is provided. The active temperature control system is operated to heat or cool a chamber of a vessel to approach a temperature set point suitable for a medication stored in the cooler container.

23 Claims, 78 Drawing Sheets

Related U.S. Application Data

(60) Provisional application No. 62/694,584, filed on Jul. 6, 2018, provisional application No. 62/673,596, filed on May 18, 2018, provisional application No. 62/660,013, filed on Apr. 19, 2018.

(52) U.S. Cl.
CPC ..... *F25B 2321/0251* (2013.01); *F25D 2400/361* (2013.01); *F25D 2400/40* (2013.01); *F25D 2700/12* (2013.01)

(56) References Cited

U.S. PATENT DOCUMENTS 1,727,913 A 9/1929 Alfred Svenn
2,046,125 A 6/1936 Lacy
2,483,979 A 10/1949 Morrill
2,548,076 A 4/1951 Bogoia Strezoff
2,746,265 A 5/1956 Mills
3,064,113 A 11/1962 Pitrone
3,129,116 A 4/1964 Corry
3,155,260 A 11/1964 Widener
3,345,934 A 10/1967 Steiner
3,435,622 A 4/1969 Barton et al.
3,463,140 A 8/1969 Rollor, Jr.
3,536,893 A 10/1970 Cran Ley Vincent J
3,539,399 A 11/1970 Harvey
3,543,842 A 12/1970 Veit Merges
3,603,106 A 9/1971 Ryan et al.
3,607,444 A 9/1971 DeBucs
3,622,753 A 11/1971 Lax
3,678,248 A 7/1972 Tricault et al.
3,739,148 A 6/1973 Ryckman, Jr.
3,757,085 A 9/1973 Balaguer
3,766,975 A 10/1973 Todd
3,797,563 A 3/1974 Hoffmann et al.
3,823,567 A 7/1974 Corini
3,892,945 A 7/1975 Lerner
3,931,494 A 1/1976 Fisher et al.
4,038,831 A 8/1977 Gaudel et al.
4,068,115 A 1/1978 Mack
4,095,090 A 6/1978 Pianezza
4,134,004 A 1/1979 Anderson et al.
4,240,272 A 12/1980 Tiede et al.
4,442,343 A 4/1984 Genuit et al.
4,470,999 A 9/1984 Carpiac
4,531,046 A 7/1985 Stover
4,537,044 A 8/1985 Putnam
4,751,368 A 6/1988 Daifotes
D296,509 S 7/1988 Fuke
4,785,637 A 11/1988 Giebeler
4,801,782 A 1/1989 Ineson
4,827,107 A 5/1989 Peery
4,865,986 A 9/1989 Coy et al.
4,978,833 A 12/1990 Knepler
4,980,539 A 12/1990 Walton
4,982,722 A 1/1991 Wyatt
4,983,798 A 1/1991 Eckler
5,042,258 A 8/1991 Sundhar
5,090,209 A 2/1992 Martin
5,163,290 A 11/1992 Kinnear
5,199,275 A 4/1993 Martin
5,208,896 A 5/1993 Katayev
5,217,064 A 6/1993 Kellow
5,243,684 A 9/1993 Edwards
5,274,215 A 12/1993 Jackson
5,283,420 A 2/1994 Montalto
5,313,787 A 5/1994 Martin
5,343,368 A 8/1994 Miller
5,388,565 A 2/1995 Ou
5,448,809 A 9/1995 Kraus
5,497,883 A 3/1996 Monetti
5,508,494 A 4/1996 Sarris et al.
5,508,600 A 4/1996 Myslinski
5,535,815 A 7/1996 Hyman
5,549,035 A 8/1996 Wing-Chung
5,550,452 A 8/1996 Shirai et al.
5,603,220 A 2/1997 Seaman
5,603,858 A 2/1997 Wyatt et al.
5,605,047 A 2/1997 Park
5,638,896 A 6/1997 Nishino
5,643,485 A 7/1997 Potter et al.
5,678,925 A 10/1997 Garmaise et al.
5,731,568 A 3/1998 Malecek
5,737,923 A 4/1998 Gilley
5,771,788 A 6/1998 Lee
5,786,643 A 7/1998 Wyatt et al.
5,842,353 A 12/1998 Kuo-Liang
5,884,006 A 3/1999 Frohlich et al.
5,903,133 A 5/1999 Amero, Jr. et al.
5,948,301 A 9/1999 Liebermann
5,954,984 A 9/1999 Ablah et al.
5,959,433 A 9/1999 Rohde
6,000,224 A 12/1999 Foye
6,000,225 A 12/1999 Ghoshal
6,003,319 A 12/1999 Gilley et al.
6,005,233 A 12/1999 Wyatt
6,013,901 A 1/2000 Lavoie
6,020,575 A 2/2000 Nagle et al.
6,032,481 A 3/2000 Mosby
6,042,720 A 3/2000 Reber
6,072,161 A 6/2000 Stein
6,075,229 A 6/2000 Vanselow
6,089,409 A 7/2000 Hart
6,106,784 A 8/2000 Lund et al.
6,108,489 A 8/2000 Frohlich et al.
6,110,159 A 8/2000 Tsujita
6,119,460 A 9/2000 Huang
6,123,065 A 9/2000 Teglbjarg
6,140,614 A 10/2000 Padamsee
6,141,975 A 11/2000 Tatsumi
6,144,016 A 11/2000 Garvin
6,158,227 A 12/2000 Seeley
6,178,753 B1 1/2001 Scudder
6,180,003 B1 1/2001 Reber et al.
6,209,343 B1 4/2001 Owen
6,212,959 B1 4/2001 Perkins
6,232,585 B1 5/2001 Clothier
RE37,213 E 6/2001 Staggs
6,260,360 B1 7/2001 Wheeler
6,274,856 B1 8/2001 Clothier
6,279,470 B2 8/2001 Simeray et al.
6,281,611 B1 8/2001 Chen et al.
6,308,518 B1 10/2001 Hunter
6,310,329 B1 10/2001 Carter
6,314,867 B1 11/2001 Russell
6,316,753 B2 11/2001 Clothier
6,320,169 B1 11/2001 Clothier
6,350,972 B1 2/2002 Wright
6,351,952 B1 3/2002 Baker, III
6,353,208 B1 3/2002 Bostic
6,376,803 B1 4/2002 Klinger
6,384,387 B1 5/2002 Owens
6,403,928 B1 6/2002 Ford
6,414,278 B1 7/2002 Frohlich et al.
6,415,624 B1 7/2002 Connors et al.
6,427,863 B1 8/2002 Nichols
6,433,313 B1 8/2002 Owens
6,434,000 B1 8/2002 Pandolfi
6,444,961 B2 9/2002 Clothier
6,539,725 B2 4/2003 Bell
6,543,335 B1 4/2003 Lassota
6,555,789 B2 4/2003 Owens
6,558,947 B1 5/2003 Lund et al.
6,571,564 B2 6/2003 Upadhye et al.
6,584,374 B2 6/2003 Lee et al.
6,598,405 B2 7/2003 Bell
6,609,392 B1 8/2003 Brown
6,622,515 B2 9/2003 Baker, III
6,634,417 B1 10/2003 Kolowich
6,637,210 B2 10/2003 Bell
6,651,445 B1 11/2003 Clark
6,657,170 B2 12/2003 Clothier
6,662,978 B2 12/2003 Lin et al.

(56) References Cited

U.S. PATENT DOCUMENTS 6,664,520 B2 12/2003 Clothier
6,668,577 B2 12/2003 Quenedey
6,672,076 B2 1/2004 Bell
6,674,052 B1 1/2004 Luo
6,702,138 B1 3/2004 Bielecki et al.
6,703,590 B1 3/2004 Holley, Jr.
6,751,963 B2 6/2004 Navedo et al.
6,753,775 B2 6/2004 Auerbach et al.
6,771,183 B2 8/2004 Hunter
6,818,867 B2 11/2004 Kressmann
6,822,198 B2 11/2004 Rix
6,852,954 B1 2/2005 Liu et al.
6,864,462 B2 3/2005 Sanoner et al.
6,870,135 B2 3/2005 Hamm et al.
6,948,321 B2 9/2005 Bell
6,953,913 B1 10/2005 Hara et al.
6,968,888 B2 11/2005 Kolowich
7,002,111 B2 2/2006 Bauer
7,022,946 B2 4/2006 Sanoner et al.
7,034,256 B1 4/2006 Phillips
7,057,527 B2 6/2006 Hunter
7,059,387 B2 6/2006 Kolowich
7,069,739 B2 7/2006 Porter
7,073,678 B1 7/2006 Dibdin et al.
7,091,455 B2 8/2006 Fung
7,109,445 B2 9/2006 Patterson et al.
7,111,465 B2 9/2006 Bell
7,117,684 B2 10/2006 Scudder
7,140,508 B2 11/2006 Kuhn et al.
7,140,768 B2 11/2006 Prabhakar
7,174,720 B2 2/2007 Kennedy
7,193,190 B2 3/2007 Kissel, Jr.
7,208,707 B2 4/2007 Clothier
7,212,955 B2 5/2007 Kirshenbaum et al.
7,225,632 B2 6/2007 Derifield
7,227,108 B2 6/2007 Clothier
7,260,438 B2 8/2007 Caldwell
7,263,283 B2 8/2007 Knepler
7,263,855 B2 9/2007 Meyer et al.
7,276,676 B1 10/2007 Thompson
7,278,270 B2 10/2007 Culp
7,287,386 B2 10/2007 Upadhye et al.
7,294,374 B2 11/2007 Romero
7,411,792 B2 8/2008 Richards et al.
7,414,380 B2 8/2008 Tang et al.
7,419,073 B2 9/2008 Crisp, III
7,421,845 B2 9/2008 Bell
7,431,174 B2 10/2008 Thissen
7,511,617 B2 3/2009 Burman et al.
7,571,830 B2 8/2009 Lin
7,592,084 B2 9/2009 Hoffjann
7,659,493 B2 2/2010 Reusche et al.
7,681,754 B1 3/2010 Ross
7,683,572 B2 3/2010 Toya
7,721,566 B1 5/2010 Wilken
7,728,711 B2 6/2010 Shoenfeld
7,748,223 B2 7/2010 Minoura
7,764,497 B2 7/2010 Becklin
7,784,301 B2 8/2010 Sasaki et al.
7,802,446 B2 9/2010 Overgaard
7,815,067 B2 10/2010 Matsumoto et al.
7,825,353 B2 11/2010 Shingler
7,836,722 B2 11/2010 Magill et al.
7,861,538 B2 1/2011 Welle et al.
7,872,214 B2 1/2011 Schandel
7,886,655 B1 2/2011 Lassota
7,908,870 B2 3/2011 Williams et al.
7,913,511 B2 3/2011 Meyer et al.
7,926,293 B2 4/2011 Bell
7,934,537 B2 5/2011 Kolowich
7,939,312 B2 5/2011 Roberts et al.
7,942,145 B2 5/2011 Palena et al.
7,948,209 B2 5/2011 Jung
7,966,927 B2 6/2011 Yoakim
7,997,786 B2 8/2011 Liu
8,055,310 B2 11/2011 Beart et al.
8,056,357 B2 11/2011 Bruce
8,061,149 B1 11/2011 Gowans
8,076,620 B2 12/2011 Maupin et al.
8,113,365 B2 2/2012 Brown
8,146,485 B2 4/2012 Ozanne
8,156,755 B2 4/2012 Murray
8,205,468 B2 6/2012 Hemminger et al.
8,215,835 B2 7/2012 Hyde et al.
8,272,530 B2 9/2012 Rebernik
8,272,532 B2 9/2012 Michaelian et al.
8,274,016 B2 9/2012 Montana
8,280,453 B2 10/2012 Beart et al.
8,319,154 B2 11/2012 Shaikh et al.
8,336,729 B2 12/2012 Kelly
8,362,351 B2 1/2013 Hagg et al.
8,375,728 B2 2/2013 Bell
8,398,602 B2 3/2013 Iio
8,400,104 B2 3/2013 Adamczyk et al.
8,424,316 B2 4/2013 Tuszkiewicz
8,448,457 B2 5/2013 Cutting et al.
8,448,809 B2 5/2013 Kelly
8,453,477 B2 6/2013 Crespo et al.
8,467,669 B2 6/2013 Widanagamage et al.
8,479,941 B2 7/2013 Matsumoto et al.
8,607,581 B2 12/2013 Williams et al.
8,618,448 B2 12/2013 Alexander
8,621,980 B2 1/2014 Bunn
8,646,282 B2 2/2014 Llercil
8,659,903 B2 2/2014 Schwartz
8,677,767 B2 3/2014 Ilercil et al.
8,759,721 B1 6/2014 Alexander
D715,143 S 10/2014 Hewitt
8,887,512 B2 11/2014 Olsen
8,887,944 B2 11/2014 Deane et al.
8,893,513 B2 11/2014 June
8,904,809 B2 12/2014 Yuan et al.
8,907,796 B2 12/2014 Sweeney et al.
8,919,138 B2 12/2014 Kobayashi
8,938,986 B2 1/2015 Matta et al.
8,991,194 B2 3/2015 Edwards et al.
9,021,825 B2 5/2015 Hewitt
9,022,249 B2 5/2015 Ranade
9,035,222 B2 5/2015 Alexander
9,057,568 B2 6/2015 Malik et al.
9,060,508 B2 6/2015 Anti et al.
9,103,572 B2 8/2015 Edwards et al.
9,115,919 B2 8/2015 Llercil
9,134,055 B2 9/2015 Ilercil
9,138,295 B2 9/2015 Hyde et al.
9,139,319 B2 9/2015 Crespo et al.
9,139,351 B2 9/2015 Chou et al.
9,140,476 B2 9/2015 Eckhoff et al.
9,144,180 B2 9/2015 Olsson et al.
9,151,523 B2 10/2015 Ilercil
9,151,545 B2 10/2015 Soukhojak
9,182,155 B2 11/2015 Crumlin
9,184,427 B2 11/2015 Chuang
9,272,475 B2 3/2016 Ranade et al.
9,310,111 B2 4/2016 Edwards et al.
9,341,394 B2 5/2016 Edwards et al.
9,351,600 B2 5/2016 Rime
9,366,469 B2 6/2016 Chapman, Jr.
9,372,016 B2 6/2016 Bloedow et al.
9,424,548 B1 * 8/2016 Siegel ..... G06Q 10/08355
9,429,350 B2 8/2016 Chapman, Jr.
9,435,578 B2 9/2016 Calderon et al.
9,447,995 B2 9/2016 Bloedow et al.
9,470,440 B2 10/2016 Ilercil
9,480,363 B2 11/2016 Delattre
9,513,067 B2 12/2016 Ahmed
9,573,754 B2 2/2017 Ahmed et al.
9,581,362 B2 2/2017 Stanley et al.
9,593,871 B2 3/2017 Stanley et al.
9,599,376 B2 3/2017 Ilercil
9,618,253 B2 4/2017 Tansley
9,685,598 B2 6/2017 Marc
9,688,454 B2 6/2017 Ranade
9,713,798 B2 7/2017 Hewitt

(56) References Cited

U.S. PATENT DOCUMENTS 9,752,808 B2 9/2017 Nakamura
9,758,299 B2 9/2017 Ahmed et al.
9,791,184 B2 10/2017 Novisoff et al.
9,791,185 B2 10/2017 Ilercil
9,795,979 B2 10/2017 Adler
9,802,806 B2 10/2017 Hewitt
9,814,331 B2 * 11/2017 Alexander ..... A47J 27/21083
9,828,165 B2 11/2017 Ranade et al.
9,829,221 B2 11/2017 Ilercil
9,874,377 B1 1/2018 Ilercil
9,885,502 B2 2/2018 Yuan et al.
9,950,851 B2 4/2018 Ranade
9,958,187 B2 5/2018 Monroy
10,012,417 B2 7/2018 Edwards et al.
10,101,420 B2 10/2018 Wikus et al.
10,119,733 B1 11/2018 Ilercil
10,131,478 B2 * 11/2018 Maser ..... E05B 65/5223
10,156,388 B2 12/2018 Ilercil
10,161,657 B2 12/2018 Ilercil
10,181,109 B2 1/2019 Joao
10,274,241 B2 4/2019 Ghiraldi
10,279,979 B2 5/2019 Ranade
10,287,085 B2 5/2019 Kuhn
10,328,074 B2 6/2019 Engelhardt et al.
10,372,922 B2 8/2019 Paterra
10,405,650 B2 9/2019 Turner et al.
10,458,684 B1 10/2019 Ilercil
10,472,158 B2 11/2019 Ranade
10,495,357 B2 12/2019 Ilercil
10,549,900 B2 2/2020 McCormick
10,562,695 B2 2/2020 Knight et al.
10,625,922 B2 4/2020 Epenetos et al.
2001/0009609 A1 7/2001 Bradenbaugh
2001/0022304 A1 9/2001 Roche
2001/0023866 A1 9/2001 Wang
2002/0023912 A1 2/2002 Mcgee
2002/0083840 A1 7/2002 Lassota
2002/0104318 A1 8/2002 Jaafar
2002/0001297 A1 9/2002 Westbrook
2002/0129712 A1 9/2002 Westbrook
2002/0162339 A1 11/2002 Harrison
2002/0175158 A1 11/2002 Sanoner et al.
2003/0010768 A1 1/2003 Li
2003/0024250 A1 2/2003 Haas
2003/0029862 A1 2/2003 Clothier
2003/0029876 A1 2/2003 Giraud
2003/0066638 A1 4/2003 Qu
2003/0074903 A1 4/2003 Upadhye
2003/0122455 A1 7/2003 Caldwell
2003/0145621 A1 8/2003 Kidwell
2004/0004072 A1 1/2004 Clothier
2004/0006996 A1 1/2004 Butcher
2004/0007553 A1 1/2004 Smolko
2004/0159240 A1 8/2004 Lyall, III
2004/0167592 A1 8/2004 Grove
2004/0194470 A1 10/2004 Upadhye et al.
2004/0212120 A1 10/2004 Giraud
2005/0045615 A1 3/2005 Sanoner et al.
2005/0045618 A1 3/2005 Ito
2005/0121431 A1 6/2005 Yuen
2005/0242804 A1 11/2005 Hintz
2006/0005873 A1 1/2006 Kambe et al.
2006/0021513 A1 2/2006 Ide
2006/0023480 A1 2/2006 Plummer
2006/0081599 A1 4/2006 Anderson
2006/0173259 A1 8/2006 Flaherty
2006/0207442 A1 9/2006 Pettersson
2006/0209628 A1 9/2006 Jones
2006/0261233 A1 11/2006 Williams et al.
2007/0024237 A1 2/2007 Cole et al.
2007/0051727 A1 3/2007 Holley
2007/0092773 A1 4/2007 Guo
2007/0144205 A1 6/2007 Moore
2007/0151457 A1 7/2007 Rabin et al.
2007/0182367 A1 8/2007 Partovi
2007/0186577 A1 8/2007 Goncharko
2007/0193297 A1 8/2007 Wilson
2007/0223895 A1 9/2007 Flemm
2007/0257766 A1 11/2007 Richards et al.
2007/0278207 A1 12/2007 Van Hoy
2007/0279002 A1 12/2007 Partovi
2008/0011077 A1 1/2008 Ramus et al.
2008/0019122 A1 1/2008 Kramer
2008/0022695 A1 1/2008 Welle
2008/0022696 A1 1/2008 Welle
2008/0041233 A1 2/2008 Bunn
2008/0041859 A1 2/2008 Teglbjarg
2008/0087270 A1 4/2008 Shaikh
2008/0121630 A1 5/2008 Simard
2008/0135564 A1 6/2008 Romero
2008/0141681 A1 6/2008 Arnold
2008/0149624 A1 6/2008 Tamura
2008/0179311 A1 7/2008 Koro et al.
2008/0190914 A1 8/2008 Gibson
2008/0213449 A1 9/2008 Wisner et al.
2008/0251063 A1 10/2008 Palena et al.
2008/0272134 A1 11/2008 Rohe
2009/0049845 A1 * 2/2009 McStravick ..... A61M 5/003 62/3.62
2009/0058352 A1 3/2009 Lin
2009/0064687 A1 3/2009 Tuszkiewicz
2009/0071952 A1 3/2009 Kuwabara
2009/0078708 A1 3/2009 Williams
2009/0102296 A1 4/2009 Greene et al.
2009/0152276 A1 6/2009 Groll
2009/0158770 A1 6/2009 Cohrs et al.
2009/0166350 A1 7/2009 Ho
2009/0184102 A1 7/2009 Parker, Jr. et al.
2009/0200320 A1 8/2009 Saito
2009/0230117 A1 9/2009 Fernando
2009/0277187 A1 11/2009 McGann
2010/0000980 A1 1/2010 Popescu
2010/0028758 A1 2/2010 Eaves
2010/0089247 A1 4/2010 Yang
2010/0108694 A1 5/2010 Sedlbauer et al.
2010/0125417 A1 5/2010 Hyde et al.
2010/0145688 A1 6/2010 Sung et al.
2010/0147014 A1 6/2010 Kim
2010/0158489 A1 6/2010 Siu et al.
2010/0158660 A1 6/2010 Radhakrishnan
2010/0186499 A1 7/2010 Ramus et al.
2010/0251755 A1 10/2010 Lauchnor
2011/0041546 A1 2/2011 Linder
2011/0056215 A1 3/2011 Ham et al.
2011/0062149 A1 3/2011 Oriel
2011/0070474 A1 3/2011 Lee et al.
2011/0072978 A1 3/2011 Popescu
2011/0108506 A1 5/2011 Lindhorst-Ko
2011/0121660 A1 5/2011 Azancot et al.
2011/0143000 A1 6/2011 Fiset
2011/0152979 A1 6/2011 Driscoll et al.
2011/0155621 A1 6/2011 Lindquist et al.
2011/0174993 A1 7/2011 Blain
2011/0179807 A1 7/2011 Holloway
2011/0180527 A1 7/2011 Abbott
2011/0198255 A1 8/2011 Baumfalk et al.
2011/0247356 A1 10/2011 Krosse et al.
2011/0259871 A1 10/2011 Li
2011/0265562 A1 11/2011 Li
2012/0061050 A1 3/2012 Petrillo et al.
2012/0064470 A1 3/2012 Delattre et al.
2012/0082766 A1 4/2012 Maupin et al.
2012/0090333 A1 4/2012 DellaMorte et al.
2012/0103562 A1 5/2012 Alexander
2012/0118874 A1 5/2012 Williams et al.
2012/0132646 A1 5/2012 England et al.
2012/0138597 A1 6/2012 Quella et al.
2012/0152511 A1 6/2012 Chang et al.
2012/0193999 A1 8/2012 Zeine
2012/0235505 A1 9/2012 Schatz et al.
2012/0235636 A1 9/2012 Partovi
2012/0248095 A1 10/2012 Lee et al.
2012/0248096 A1 10/2012 Lee et al.
2012/0255946 A1 10/2012 Kim et al.

(56) References Cited

U.S. PATENT DOCUMENTS

| | | | | |
|---|---|---|---|---|
| 2012/0256585 | A1 | 10/2012 | Partovi et al. | |
| 2012/0258229 | A1 | 10/2012 | Mindrup | |
| 2012/0312031 | A1 | 12/2012 | Olsen | |
| 2012/0319500 | A1 | 12/2012 | Beart et al. | |
| 2013/0059259 | A1 | 3/2013 | Oldani | |
| 2013/0103463 | A1 | 4/2013 | Briar et al. | |
| 2013/0128915 | A1 | 5/2013 | Aschauer et al. | |
| 2013/0167730 | A1 | 7/2013 | Behm | |
| 2013/0180563 | A1 | 7/2013 | Makansi | |
| 2013/0200064 | A1 | 8/2013 | Alexander | |
| 2013/0206015 | A1 | 8/2013 | Jacoby et al. | |
| 2013/0221013 | A1 | 8/2013 | Kolowich et al. | |
| 2013/0239607 | A1 | 9/2013 | Kelly | |
| 2013/0255306 | A1 | 10/2013 | Mayer | |
| 2013/0255824 | A1 | 10/2013 | Williams et al. | |
| 2013/0275075 | A1 | 10/2013 | Johnson | |
| 2013/0287967 | A1 | 11/2013 | Alexander | |
| 2013/0306656 | A1* | 11/2013 | Eckhoff | B65D 81/3823 220/592.26 |
| 2014/0137570 | A1 | 5/2014 | Hauck et al. | |
| 2014/0150464 | A1 | 6/2014 | Bloedow | |
| 2014/0165607 | A1 | 6/2014 | Alexander | |
| 2014/0230484 | A1 | 8/2014 | Yavitz | |
| 2014/0238985 | A1 | 8/2014 | Sweeney et al. | |
| 2014/0305927 | A1 | 10/2014 | Alexander | |
| 2014/0338713 | A1 | 11/2014 | Nakanuma | |
| 2014/0352329 | A1 | 12/2014 | Bloedow et al. | |
| 2015/0024349 | A1 | 1/2015 | Bischoff | |
| 2015/0122688 | A1 | 5/2015 | Dias | |
| 2015/0205625 | A1 | 7/2015 | Pearson et al. | |
| 2015/0245723 | A1 | 9/2015 | Alexander | |
| 2015/0321195 | A1 | 11/2015 | Malik et al. | |
| 2015/0335184 | A1 | 11/2015 | Balachandran | |
| 2015/0349233 | A1 | 12/2015 | Span et al. | |
| 2016/0035957 | A1 | 2/2016 | Casey | |
| 2016/0111622 | A1 | 4/2016 | Lee et al. | |
| 2016/0183730 | A1 | 6/2016 | Bedi | |
| 2016/0271015 | A1 | 9/2016 | Wengreen et al. | |
| 2017/0042373 | A1 | 2/2017 | Alexander et al. | |
| 2017/0108261 | A1 | 4/2017 | Broussard | |
| 2017/0150840 | A1 | 6/2017 | Park | |
| 2017/0177883 | A1 | 6/2017 | Paterra et al. | |
| 2017/0180368 | A1 | 6/2017 | Paterra | |
| 2017/0259956 | A1 | 9/2017 | Hori | |
| 2017/0271570 | A1 | 9/2017 | Marc | |
| 2017/0290741 | A1 | 10/2017 | Chou et al. | |
| 2017/0314851 | A1 | 11/2017 | Alexander et al. | |
| 2017/0372260 | A1 | 12/2017 | Desmarais et al. | |
| 2018/0023865 | A1 | 1/2018 | Llercil | |
| 2018/0039940 | A1 | 2/2018 | Varga | |
| 2018/0061162 | A1 | 3/2018 | High et al. | |
| 2018/0175272 | A1 | 6/2018 | Imai et al. | |
| 2018/0320947 | A1 | 11/2018 | Jain et al. | |
| 2018/0352796 | A1* | 12/2018 | Chattman | A01M 1/02 |
| 2018/0353379 | A1 | 12/2018 | Chou et al. | |
| 2019/0003757 | A1 | 1/2019 | Miros et al. | |
| 2019/0003781 | A1 | 1/2019 | Caniere et al. | |
| 2019/0039811 | A1 | 2/2019 | Kuhn et al. | |
| 2019/0303862 | A1 | 10/2019 | Bollinger et al. | |
| 2019/0359411 | A1 | 11/2019 | Fallgren | |

FOREIGN PATENT DOCUMENTS

| | | | |
|---|---|---|---|
| CN | 1502513 | A | 6/2004 |
| CN | 2708795 | Y | 7/2005 |
| CN | 1748112 | A | 3/2006 |
| CN | 1776992 | A | 5/2006 |
| CN | 2922666 | Y | 7/2007 |
| CN | 101069606 | A | 11/2007 |
| CN | 101109795 | A | 1/2008 |
| CN | 201042350 | Y | 4/2008 |
| CN | 201076180 | | 6/2008 |
| CN | 201308643 | | 10/2008 |
| CN | 201237271 | | 5/2009 |
| CN | 101507261 | A | 8/2009 |
| CN | 201303850 | Y | 9/2009 |
| CN | 201445353 | U | 5/2010 |
| CN | 101820128 | A | 9/2010 |
| CN | 201612420 | U | 10/2010 |
| CN | 102 164 526 | A | 8/2011 |
| CN | 102802294 | | 5/2012 |
| CN | 202681700 | | 1/2013 |
| CN | 202919767 | U | 5/2013 |
| CN | 102266184 | B | 10/2013 |
| CN | 203468187 | U | 3/2014 |
| CN | 108 974 637 | A | 12/2018 |
| DE | 19744526 | | 4/1999 |
| DE | 20108363 | | 8/2001 |
| DE | 20314416 | | 1/2004 |
| EP | 0332355 | | 9/1989 |
| EP | 0722708 | | 7/1996 |
| EP | 0895772 | | 2/1999 |
| EP | 2022727 | A1 | 2/2009 |
| EP | 2165243 | | 3/2010 |
| EP | 2001761 | | 1/2012 |
| EP | 2308771 | | 6/2012 |
| EP | 2852540 | B1 | 7/2016 |
| EP | 3 109 574 | A1 | 12/2016 |
| EP | 3491301 | B1 | 4/2020 |
| FR | 2737380 | | 1/1997 |
| FR | 2752377 | | 2/1998 |
| FR | 2763463 | | 11/1998 |
| FR | 2828082 | | 2/2003 |
| GB | 1311955 | A | 3/1973 |
| GB | 2 304 179 | A | 3/1997 |
| GB | 2390798 | A | 1/2004 |
| GB | 2414922 | A | 12/2005 |
| GB | 2441825 | | 3/2008 |
| IN | 02555CN2012 | A | 5/2013 |
| JP | S54-147575 | U | 4/1953 |
| JP | S63-249519 | A | 10/1988 |
| JP | H01 164322 | A | 6/1989 |
| JP | H05-306472 | A | 11/1993 |
| JP | H06-021549 | U | 3/1994 |
| JP | H10-146276 | U | 6/1998 |
| JP | 11-268777 | | 10/1999 |
| JP | 2000-279302 | A | 10/2000 |
| JP | 2003106728 | A | 4/2003 |
| JP | 2003-299255 | A | 10/2003 |
| JP | 2004-261493 | A | 9/2004 |
| JP | 2006-345957 | | 6/2005 |
| JP | 2005-308353 | A | 11/2005 |
| JP | 2006-068152 | | 3/2006 |
| JP | 2006-102234 | A | 4/2006 |
| JP | 2006-166522 | A | 6/2006 |
| JP | 2007-064557 | A | 3/2007 |
| JP | 2007 139328 | A | 6/2007 |
| JP | 2007 260838 | A | 10/2007 |
| JP | 2007-312932 | | 12/2007 |
| JP | 2008-173464 | A | 7/2008 |
| JP | 3153007 | U | 7/2009 |
| JP | 2010-527226 | A | 8/2010 |
| JP | 2011-171205 | | 9/2011 |
| JP | 2012-523085 | A | 9/2012 |
| JP | 5127819 | | 1/2013 |
| JP | 5481388 | | 4/2014 |
| KR | 2010 0124932 | A | 11/2010 |
| KR | 10-2015-0051074 | A | 5/2015 |
| WO | WO 02/067737 | A2 | 9/2002 |
| WO | WO 2003/073030 | A1 | 9/2003 |
| WO | WO 2004/055654 | A2 | 7/2004 |
| WO | WO 2008/028329 | | 3/2008 |
| WO | WO 2008/065175 | | 6/2008 |
| WO | WO 2008/137996 | | 11/2008 |
| WO | WO 2008/155538 | A2 | 12/2008 |
| WO | WO 2009/138930 | | 11/2009 |
| WO | WO 2010/087560 | A2 | 8/2010 |
| WO | WO 2010/087560 | A3 | 8/2010 |
| WO | WO 2011/131595 | A2 | 10/2011 |
| WO | WO 2012/104665 | | 8/2012 |
| WO | WO 2013/187763 | A1 | 12/2013 |
| WO | WO 2014/158655 | A2 | 10/2014 |

(56) References Cited

FOREIGN PATENT DOCUMENTS

| | | | |
|---|---|---|---|
| WO | WO 2016/193480 | A1 | 12/2016 |
| WO | WO 2018/016238 | A1 | 1/2018 |
| WO | WO 2019/204660 | A1 | 10/2019 |

OTHER PUBLICATIONS

Chinese Office Action, regarding Application No. 201510869257.5, dated Aug. 30, 2018, 9 pages.
Decision of Rejection dated Apr. 4, 2017 in JP Application No. 2013-537797.
European Office Action dated Sep. 28, 2017, received in European Patent Application No. 14 774 350.4, pp. 5.
European Patent Office Search Report dated Mar. 17, 2016 regarding Application No. 11838764.6-1804, PCT/US2011059014, 7 pages.
European Search Report received in European Patent Application No. 15811173.2, dated Dec. 13, 2017.
First Office Action dated Nov. 23, 2016 in CN Application No. 201480014620.9.
International Preliminary Report on Patentability dated May 7, 2013 in PCT Application No. PCT/US2011/059014.
International Search Report and Written Opinion dated Jan. 12, 2016 in PCT Application No. PCT/US15/36304.
International Search Report and Written Opinion dated Dec. 9, 2014 in PCT/US2014/019130.
International Search Report and Written Opinion dated Jul. 12, 2017, in PCT Application No. PCT/US2017/031534.
International Search Report and Written Opinion dated Mar. 16, 2012 in PCT/US2011/059014.
International Search and Written Opinion dated Jul. 9, 2019, received in International Patent Application No. PCT/US2019/028198.
Non-final Office Action dated Nov. 14, 2016 in U.S. Appl. No. 15/050,714.
Non-final office action dated Aug. 2, 2016 in Japanese Patent Application No. 2013-537797.
Notice of Reason(s) for Rejection dated Aug. 11, 2015 in JP Application No. 2013-537797.
Office Action dated Aug. 7, 2018, received for Japanese Patent Application No. JP 2017-151497, 4 pages.
Office Action dated Jan. 12, 2018, received in Chinese Application No. 201510869257.5.
Office Action in related Chinese Application No. 201180063844.5, dated Dec. 29, 2014.
Office Action dated Sep. 4, 2018, regarding Japan Patent Application No. 2017-554610, 10 pages.
Office Action received in Japanese Patent Application No. 2017-151497, dated Nov. 21, 2017, 5 pages.
Patent Examination Report No. 1 in related Australian Application No. 2011323416, dated May 15, 2015.
Patent Examination Report No. 2 in related Australian Application No. 2011323416, dated Oct. 20, 2015.
PCT International Search Report and Written Opinion dated Sep. 14, 2017 regarding International Application No. PCT/US2017/034081, 15 pages.
PCT International Search Report and Written Opinion dated Aug. 17, 2017 in PCT Application No. PCT/US2017/032020.
Second Office Action dated Apr. 10, 2017 in CN Application No. 201510869257.5.
Supplementary European Search Report dated Oct. 18, 2016 in European Patent Application No. 14 77 4350.
International Search Report and Written Opinion dated Aug. 12, 2020, received in International Patent Application No. PCT/US2020/012591, 9 pages.

* cited by examiner

PORTABLE COOLER WITH ACTIVE TEMPERATURE CONTROL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND OF THE INVENTION

Field of the Invention

The invention is directed to a portable cooler (e.g., for medicine such as insulin, vaccines, epinephrine, medicine injectors, cartridges, biological fluids, etc.), and more particularly to a portable cooler with active temperature control.

Description of the Related Art

Certain medicine needs to be maintained at a certain temperature or temperature range to be effective (e.g., to maintain potency). Once potency of medicine (e.g., a vaccine) is lost, it cannot be restored, rendering the medicine ineffective and/or unusable. However, maintaining the cold chain (e.g., a record of the medicine's temperature history as it travels through various distribution channels) can be difficult. Additionally, where medicine is transported to remote locations for delivery (e.g., rural, mountainous, sparsely populated areas without road access), maintaining the medicine in the required temperature range may be difficult, especially when travelling through harsh (e.g., desert) climates. Existing medicine transport coolers are passive and inadequate for proper cold chain control (e.g., when used in extreme weather, such as in desert climates, tropical or subtropical climates, etc.).

SUMMARY

Accordingly, there is a need for improved portable cooler designs (e.g., for transporting medicine, such as vaccines, insulin, epinephrine, vials, cartridges, injector pens, etc.) that can maintain the contents of the cooler at a desired temperature or temperature range. Additionally, there is a need for an improved portable cooler design with improved cold chain control and record keeping of the temperature history of the contents (e.g., medicine, such as vaccines) of the cooler (e.g., during transport to remote locations).

In accordance with one aspect, a portable cooler container with active temperature control system is provided. The active temperature control system is operated to heat or cool a chamber of a vessel to approach a temperature set point suitable for a medication stored in the cooler container.

In accordance with another aspect, a portable cooler is provided that includes a temperature control system operable (e.g., automatically) to maintain the chamber of the cooler at a desired temperature or temperature range for a prolonged period of time. Optionally, the portable cooler is sized to house one or more liquid containers (e.g., medicine vials, cartridges or containers, such as a vaccine vials or insulin vials/cartridges, medicine injectors). Optionally, the portable cooler automatically logs (e.g., stores on a memory of the cooler) and/or communicates data on one or more sensed parameters (e.g., of the temperature of the chamber) to a remote electronic device (e.g., remote computer, mobile electronic device such as a smartphone or tablet computer, remote server, etc.). Optionally, the portable cooler can automatically log and/or transmit the data to the remote electronic device (e.g., automatically in real time, periodically at set intervals, etc.).

In accordance with another aspect, a portable cooler container with active temperature control is provided. The container comprises a container body having a chamber configured to receive and hold one or more volumes of perishable liquid, the chamber defined by a base and an inner peripheral wall of the container body. The container also comprises a temperature control system comprising one or more thermoelectric elements configured to actively heat or cool at least a portion of the chamber, and circuitry configured to control an operation of the one or more thermoelectric elements to heat or cool at least a portion of the chamber to a predetermined temperature or temperature range.

Optionally, the container can include one or more batteries configured to provide power to one or both of the circuitry and the one or more thermoelectric elements.

Optionally, the circuitry is further configured to wirelessly communicate with a cloud-based data storage system and/or a remote electronic device.

Optionally, the container includes a first heat sink in communication with the chamber, the first sink being selectively thermally coupled to the one or more thermoelectric elements.

Optionally, the container includes a second heat sink in communication with the one or more thermoelectric elements (TECs), such that the one or more TECs are disposed between the first heat sink and the second heat sink.

Optionally, the second heat sink is in thermal communication with a fan operable to draw heat from the second heat sink.

In one implementation, such as where the ambient temperature is above the predetermined temperature or temperature range, the temperature control system is operable to draw heat from the chamber via the first heat sink, which transfers said heat to the one or more TECs, which transfer said heat to the second heat sink, where the optional fan dissipates heat from the second heat sink.

In another implementation, such as where the ambient temperature is below the predetermined temperature or temperature range, the temperature control system is operable to add heat to the chamber via the first heat sink, which transfers said heat from the one or more TECs.

In accordance with one aspect of the disclosure, a portable cooler container with active temperature control is provided. The portable cooler container comprises a container body having a chamber configured to receive and hold one or more containers (e.g., of medicine). The portable cooler container also comprises a lid removably coupleable to the container body to access the chamber, and a temperature control system. The temperature control system comprises one or more thermoelectric elements configured to actively heat or cool at least a portion of the chamber, one or more batteries and circuitry configured to control an operation of the one or more thermoelectric elements to heat or cool at least a portion of the chamber to a predetermined temperature or temperature range. A display screen is disposed on one or both of the container body and the lid, the display screen configured to selectively display shipping information for the portable cooler container using electronic ink.

In accordance with another aspect of the disclosure, a portable cooler container with active temperature control is provided. The portable cooler container comprises a container body having a chamber configured to receive and hold one or more containers (e.g., of medicine), the chamber defined by a base and an inner peripheral wall of the container body. A lid is removably coupleable to the container body to access the chamber. The portable cooler container also comprises a temperature control system. The temperature control system comprises one or more thermoelectric elements and one or more fans, one or both of the thermoelectric elements and fans configured to actively heat or cool at least a portion of the chamber, one or more batteries and circuitry configured to control an operation of the one or more thermoelectric elements to heat or cool at least a portion of the chamber to a predetermined temperature or temperature range.

In accordance with another aspect of the disclosure, a portable cooler container with active temperature control is provided. The portable cooler container comprises a container body having a chamber configured to receive and hold one or more volumes of perishable liquid, the chamber defined by a base and an inner peripheral wall of the container body, and a lid movably coupled to the container body by one or more hinges. The portable cooler container also comprises a temperature control system that comprises one or more thermoelectric elements configured to actively heat or cool at least a portion of the chamber, and one or more power storage elements. The temperature control system also comprises circuitry configured to control an operation of the one or more thermoelectric elements to heat or cool at least a portion of the chamber to a predetermined temperature or temperature range, the circuitry further configured to wirelessly communicate with a cloud-based data storage system or a remote electronic device. An electronic display screen is disposed on one or both of the container body and the lid, the display screen configured to selectively display shipping information for the portable cooler container.

DETAILED DESCRIPTION

Figure 1A:
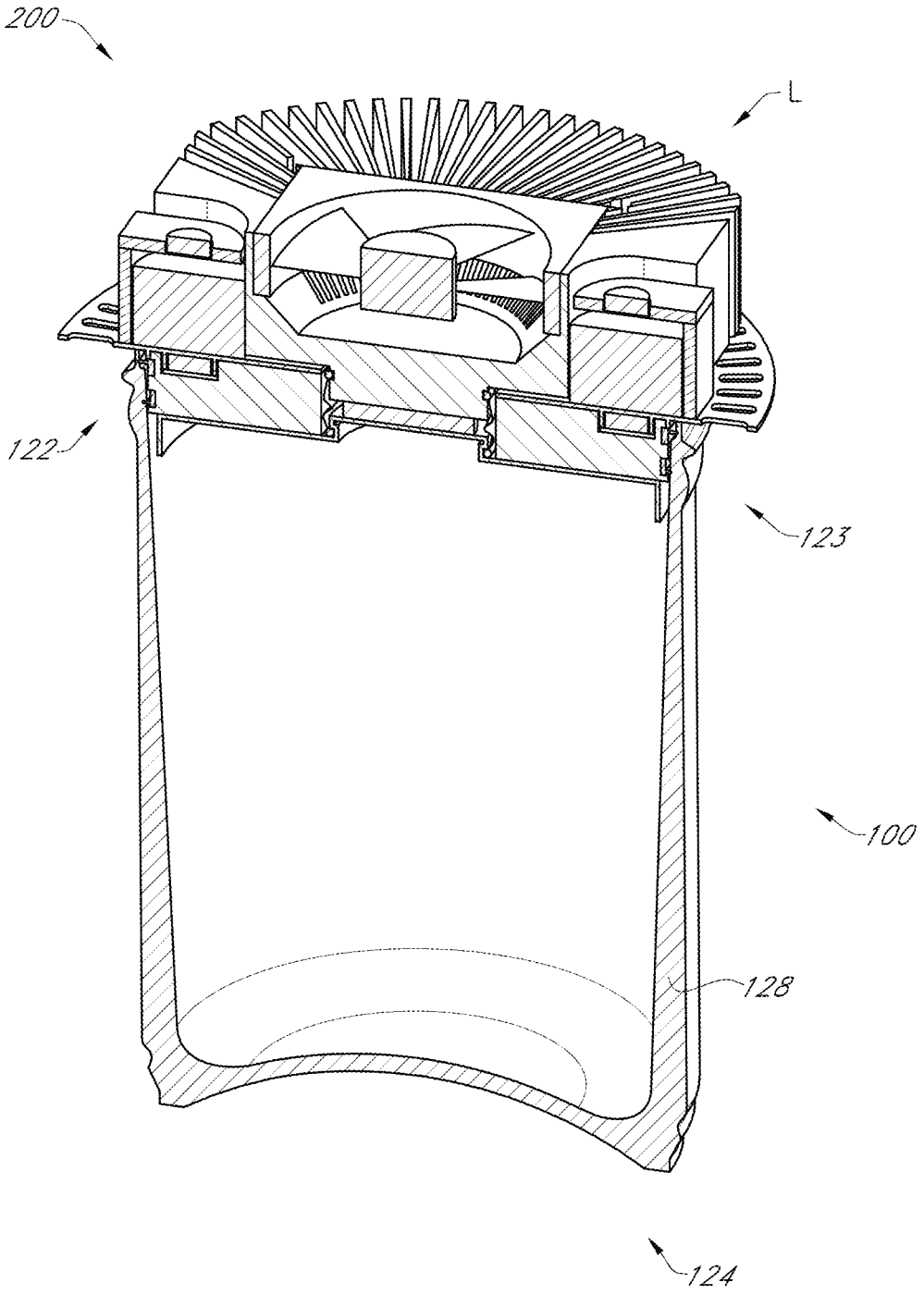
FIGS. 1A-1D are schematic views of one embodiment of a cooler container.
Figure 1B:
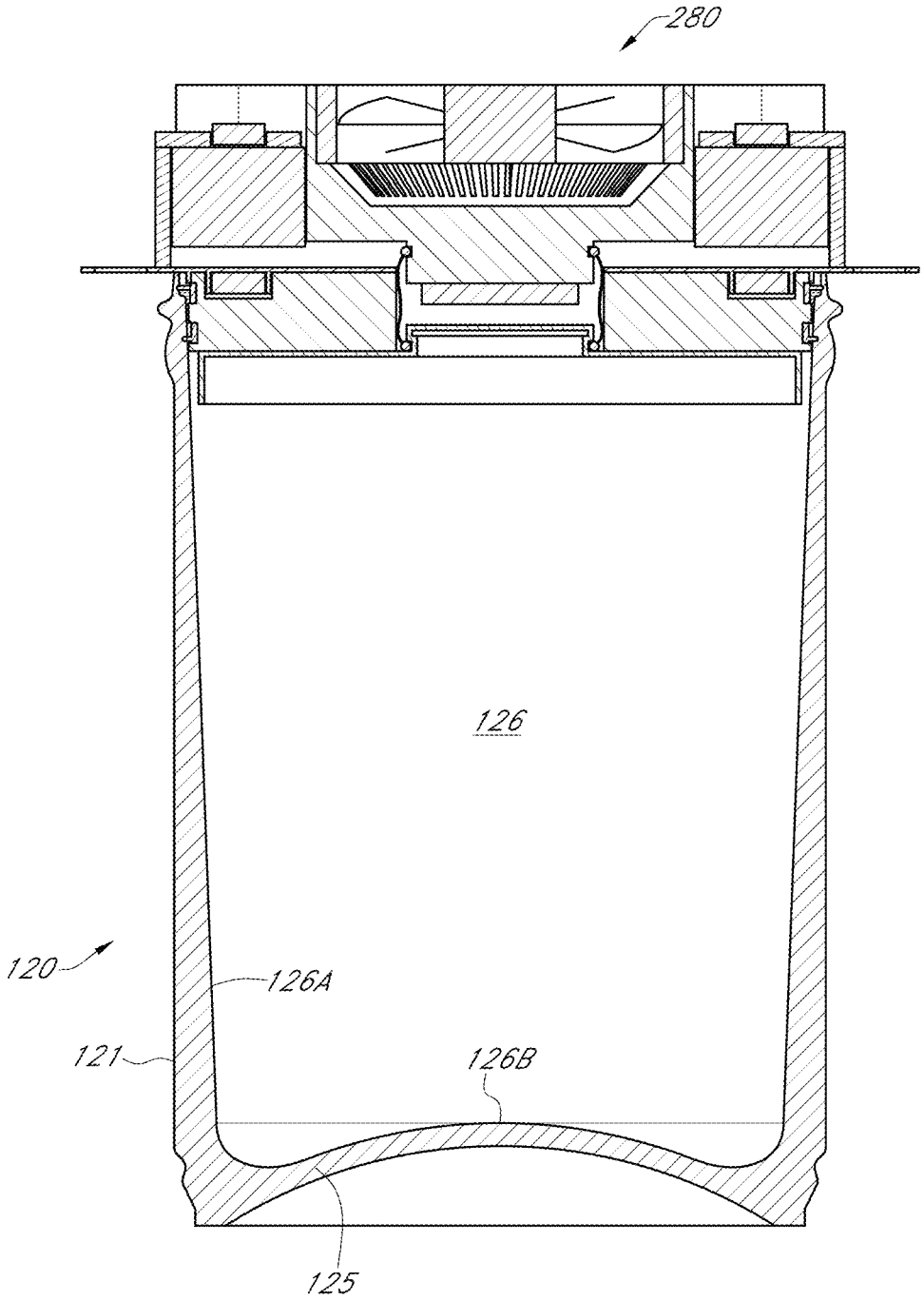

FIGS. 1A-1D show a schematic cross-sectional view of a container system 100 that includes a cooling system 200. Optionally, the container system 100 has a container vessel 120 that is optionally cylindrical and symmetrical about a longitudinal axis Z, and one of ordinary skill in the art will recognize that the features shown in cross-section in FIGS. 1A-1D are defined by rotating them about the axis Z to define the features of the container 100 and cooling system 200.

The container vessel 120 is optionally a cooler with active temperature control provided by the cooling system 200 to cool the contents of the container vessel 120 and/or maintain the contents of the vessel 120 in a cooled or chilled state. Optionally, the vessel 120 can hold therein one or more (e.g., a plurality of) separate containers (e.g., vials, cartridges, packages, injectors, etc.). Optionally, the one or more (e.g., plurality of) separate containers that can be inserted into the container vessel 120 are medicine containers (e.g., vaccine vials, insulin cartridges, injectors, etc.).

The container vessel 120 has an outer wall 121 that extends between a proximal end 122 that has an opening 123 and a distal end 124 having a base 125. The opening 123 is selectively closed by a lid L removably attached to the proximal end 122. The vessel 120 has an inner wall 126A and a base wall 126B that defines an open chamber 126 that can receive and hold contents to be cooled therein (e.g., one or more volumes of liquid, such as one or more vials, cartridges, packages, injectors, etc.). Optionally, the vessel 120 can be made of metal (e.g., stainless steel). In another implementation, the vessel 120 can be made of plastic. In one implementation, the vessel 120 has a cavity 128 (e.g., annular cavity or chamber) between the inner wall 126A and the outer wall 121. Optionally, the cavity 128 can be under vacuum. In another implementation, the cavity 128 can be filled with air but not be under vacuum. In still another implementation, the cavity 128 can be filled with a thermally insulative material (e.g., foam). In another implementation, the vessel 120 can exclude a cavity so that the vessel 120 is solid between the inner wall 126A and the outer wall 121.

With continued reference to FIGS. 1A-1D, the cooling system 200 is optionally implemented in the lid L that releasably closes the opening 123 of the vessel 120 (e.g., lid L can be attached to vessel 120 to closer the opening 123, and detached or decoupled from the vessel 120 to access the chamber 126 through the opening 123).

The cooling system 200 optionally includes a cold side heat sink 210 that faces the chamber 126, one or more thermoelectric elements (TECs) 220 (such as one or more Peltier elements) that selectively contacts the cold side heat sink 210, a hot side heat sink 230 in contact with the thermoelectric element 220 and disposed on an opposite side of the TEC 220 from the cold side heat sink 210, an insulator member 240 disposed between the cold side heat sink 210 and the hot side heat sink 230, one or more distal magnets 250 proximate a surface of the insulator 240, one or more proximal magnets 260 and one or more electromagnets 270 disposed axially between the distal magnets 250 and the proximal magnets 260. The proximal magnets 260 have an opposite polarity than the distal magnets 250. The electromagnets 270 are disposed about and connected to the hot side heat sink 230, which as noted above is attached to the TEC 220. The cooling system 200 also optionally includes a fan 280 in communication with the hot side heat sink 230 and one or more sealing gaskets 290 disposed between the cold side heat sink 210 and the hot side heat sink 230 and circumferentially about the TEC 220.

As discussed further below, circuitry and one or more batteries are optionally disposed in or on the vessel 120. For example, in one implementation, circuitry, sensors and/or batteries are disposed in a cavity in the distal end 124 of the vessel body 120, such as below the base wall 126B of the vessel 120, and can communicate with electrical contacts on the proximal end 122 of the vessel 120 that can contact corresponding electrical contacts (e.g., pogo pins, contact rings) on the lid L. In another implementation, the lid L can be connected to the proximal end 122 of the vessel 120 via a hinge, and electrical wires can extend through the hinge between the circuitry disposed in the distal end 124 of the vessel 120 and the fan 280 and TEC 220 in the lid L. Further discussion of the electronics in the cooling system 200 is provided further below. In another implementation, the circuitry and one or more batteries can be in a removable pack (e.g., DeWalt battery pack) that attaches to the distal end 124 of the vessel 120, where one or more contacts in the removable pack contact one or more contacts on the distal end 124 of the vessel 120. The one or more contacts on the distal end 124 of the vessel 120 are electrically connected (via one or more wires or one or more intermediate components) with the electrical connections on the proximal 122 of the vessel 120, or via the hinge, as discussed above, to provide power to the components of the cooling system 200.

Figure 1C:
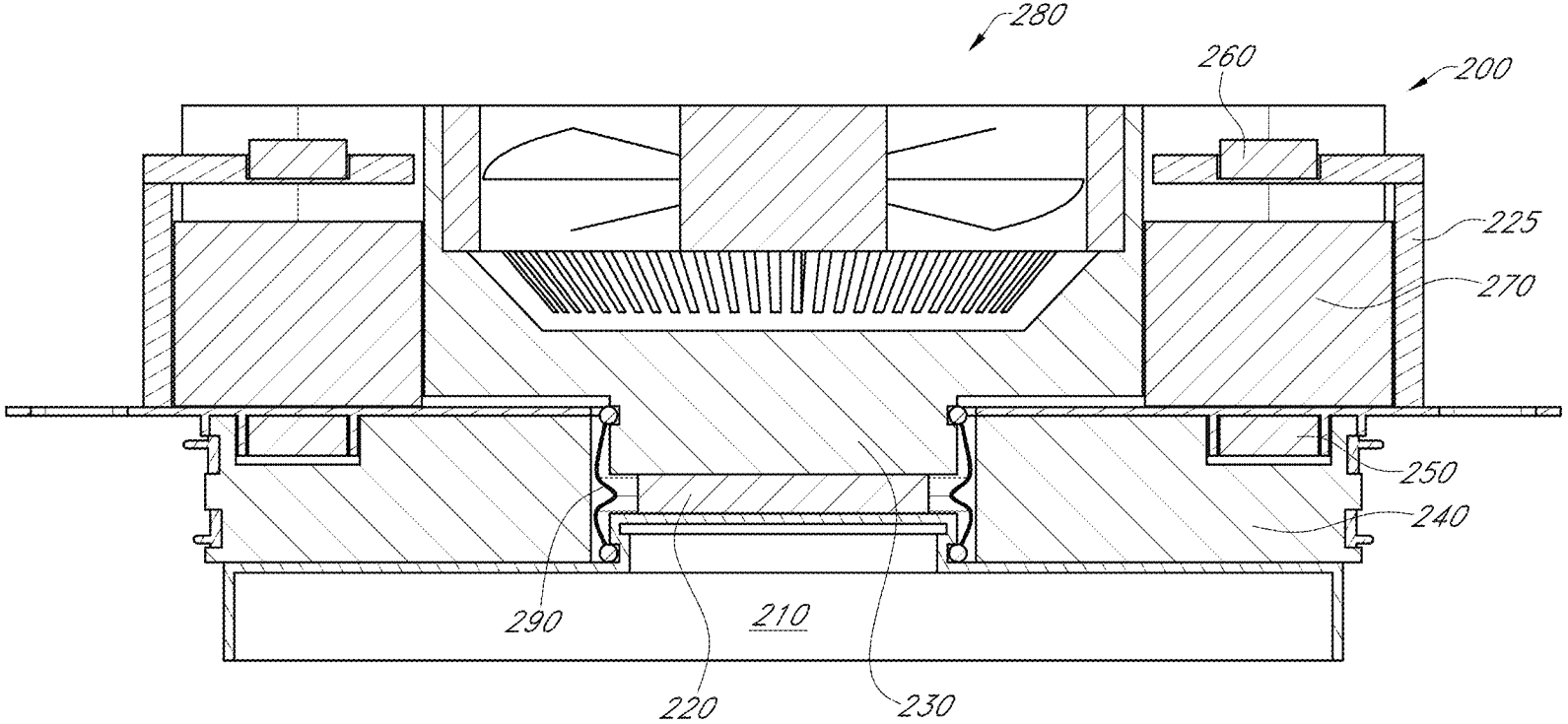
Figure 1D:
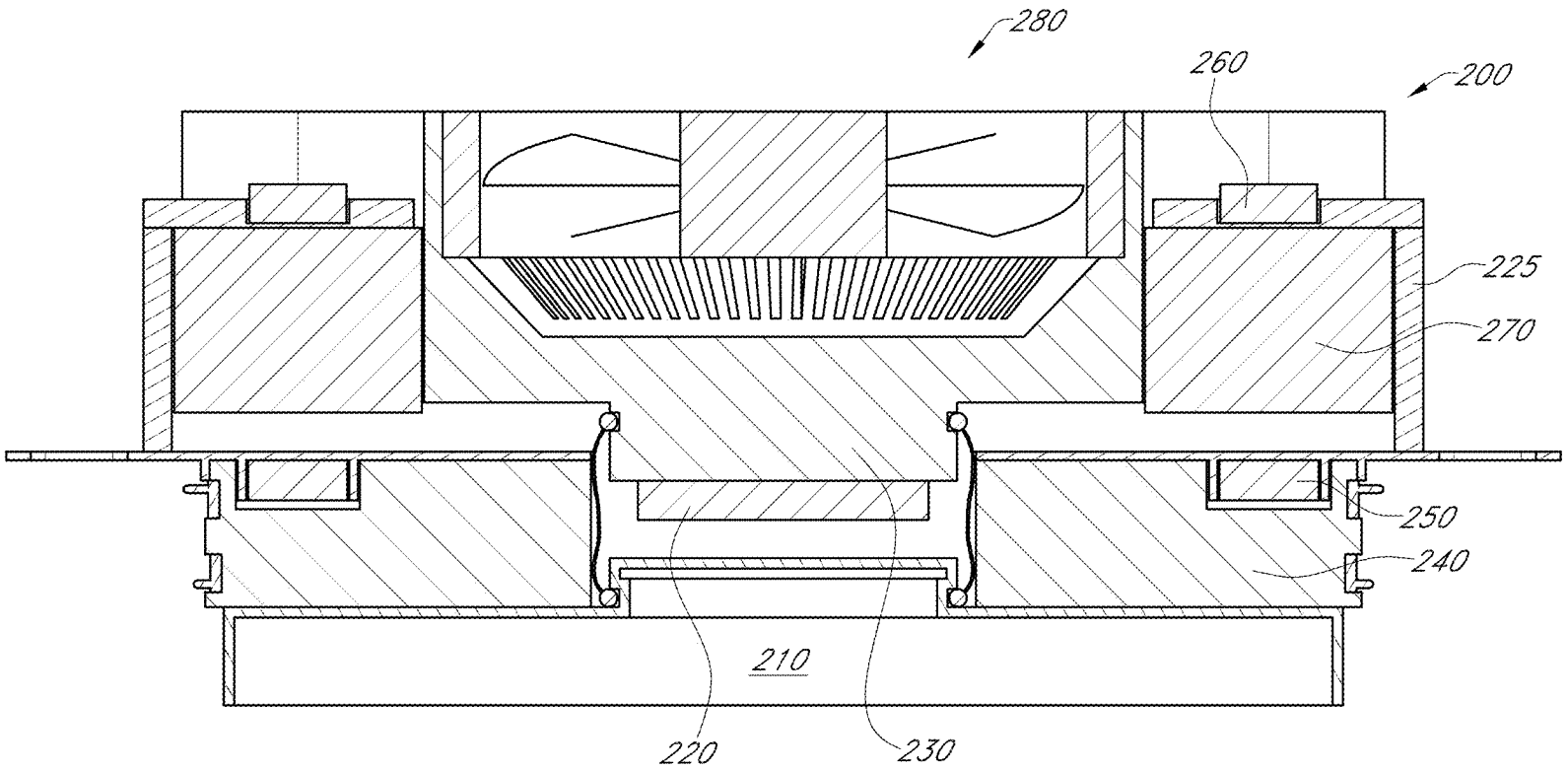

In operation, the one or more electromagnets 270 are operated to have a polarity that is opposite that of the one or more distal magnets 250 and/or the same as the polarity of the one or more proximal magnets 260, causing the electromagnets 270 to move toward and contact the distal magnets 250, thereby causing the TEC 220 to contact the cold side heat sink 210 (see FIG. 1C). The TEC 220 can be operated to draw heat from the chamber 126 via the cold side heat sink 210, which the TEC 220 transfers to the hot side heat sink 230. The fan 280 can optionally be operated to dissipate heat from the hot side heat sink 230, allowing the TEC 220 to draw more heat out of the chamber 126 to thereby cool the chamber 126. Once the desired temperature is achieved in the chamber 126 (e.g., as sensed by one or more sensors in thermal communication with the chamber 126), the fan 280 is turned off and the polarity of the one or more electromagnets 270 can be switched (e.g., switched off) so that the electromagnets 270 are repelled from the distal magnets 250 and/or attracted to the proximal magnets 260, thereby causing the TEC 220 to be spaced apart from (i.e., no longer contact) the cold side heat sink 210 (see FIG.

1D) within the housing 225. The separation between the TEC 220 and the cold side heat sink 210 advantageously prevents heat in the hot side heat sink or due to ambient temperature from flowing back to the cold side heat sink, which prolongs the cooled state in the chamber 126.

Figure 2A:
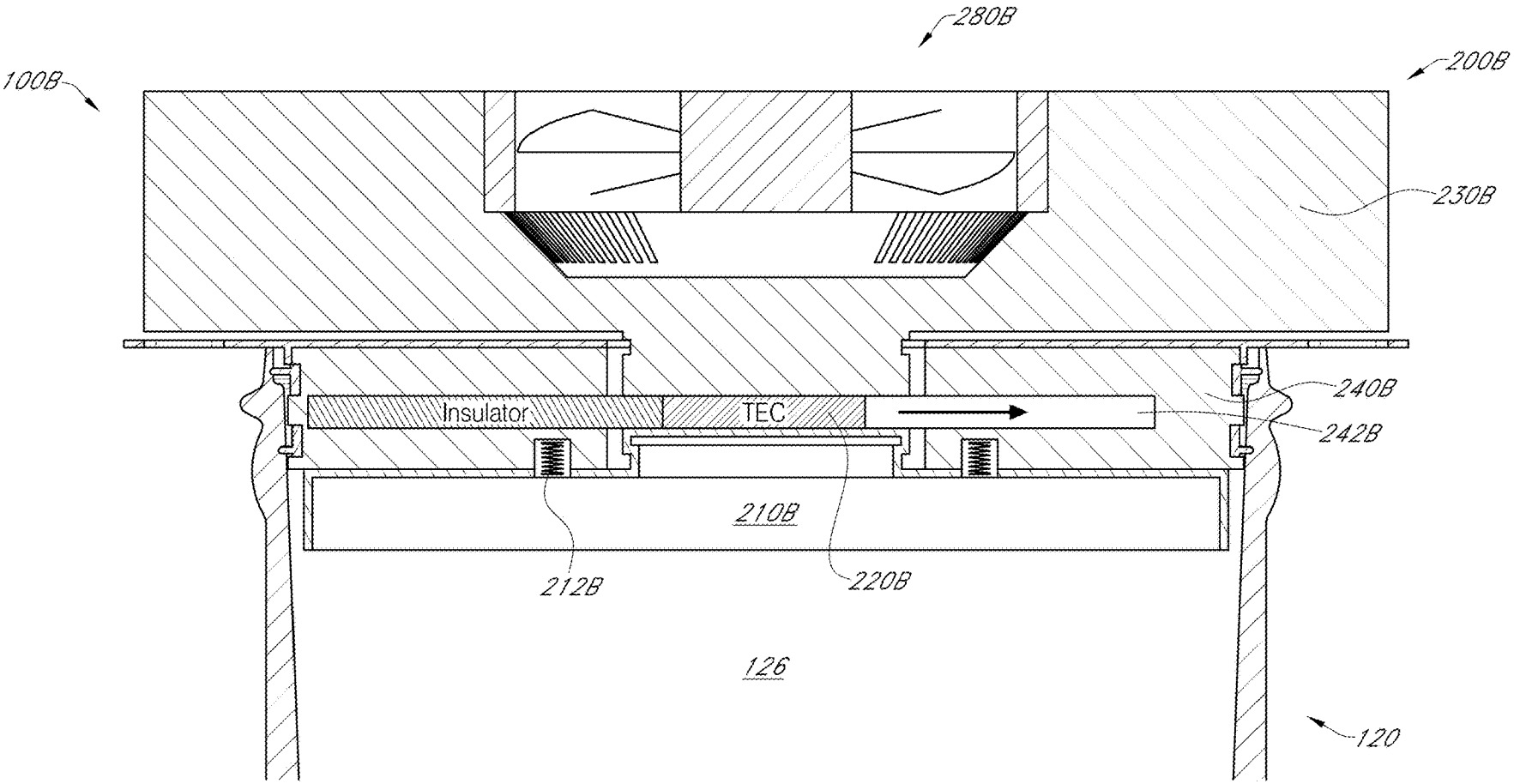
FIGS. 2A-2B are schematic partial views of another embodiment of a cooler container.
Figure 2B:
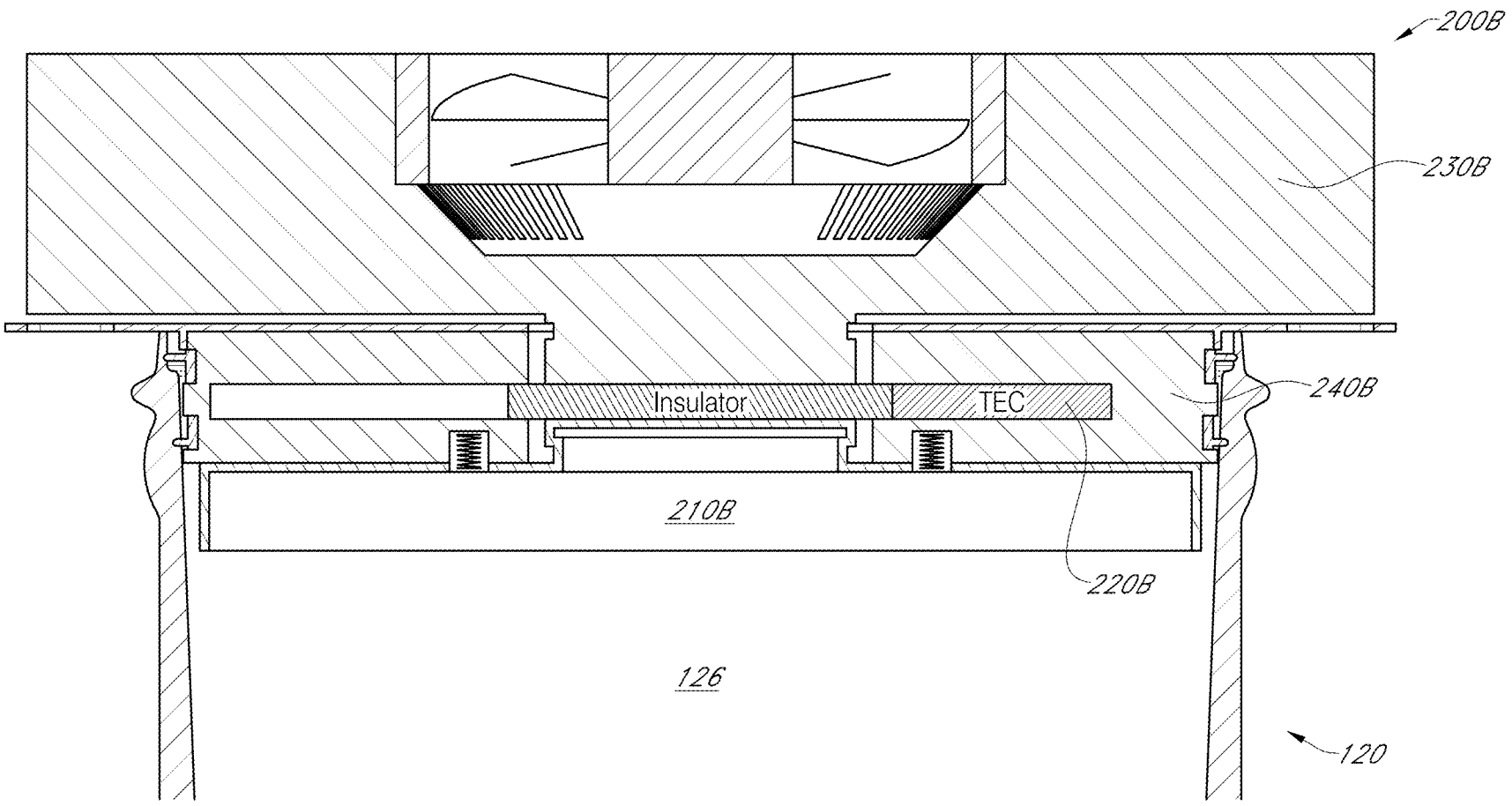

FIGS. 2A-2B schematically illustrate a container system 100B that includes the cooling system 200B. The container system 100B can include the vessel 120 (as described above). Some of the features of the cooling system 200B are similar to features in the cooling system 200 in FIGS. 1A-1D. Thus, references numerals used to designate the various components of the cooling system 200B are identical to those used for identifying the corresponding components of the cooling system 200 in FIGS. 1A-1D, except that a "B" is added to the numerical identifier. Therefore, the structure and description for the various components of the cooling system 200 in FIGS. 1A-1D are understood to also apply to the corresponding components of the cooling system 200B in FIGS. 2A-2B, except as described below.

The TEC 220B can optionally be selectively slid into alignment between the cold side heat sink 210B and the hot side heat sink 230B, such that operation of the TEC 220B draws heat from the chamber 126 via the cold side heat sink 210B and transfers it to the hot side heat sink 230B. The fan 280B is optionally operated to further dissipate heat from the hot side heat sink 230B, allowing it to draw more heat from the chamber 126 via the TEC 220B. Optionally, one or more springs 212B (e.g., coil springs) resiliently couple the cold side heat sink 210B with the insulator 240B to maintain an efficient thermal connection between the cold side heat sink 210B and the TEC 220 when aligned together.

The TEC 220B can optionally be selectively slid out of alignment between the cold side heat sink 210B and the hot side heat sink 230B to thereby disallow heat transfer through the TEC 220B (e.g., once the desired temperature in the chamber 126 has been achieved). Optionally, the TEC 220B is slid into a cavity 242B in the insulator 240B.

The TEC 220B can be slid into and out or alignment between the cold side heat sink 210B and the hot side heat sink 230B with a number of suitable mechanisms. In one implementation, an electric motor can drive a gear in contact with a gear rack (e.g., rack and pinion), where the TEC 220B can be attached to the rack that linearly moved via rotation of the gear by the electric motor. In another implementation, a solenoid motor can be attached to TEC 220B to effect the linear movement of the TEC 220B. In still another implementation a pneumatic or electromechanical system can actuate movement of a piston attached to the TEC 220B to effect the linear movement of the TEC 220B.

Figure 2C:
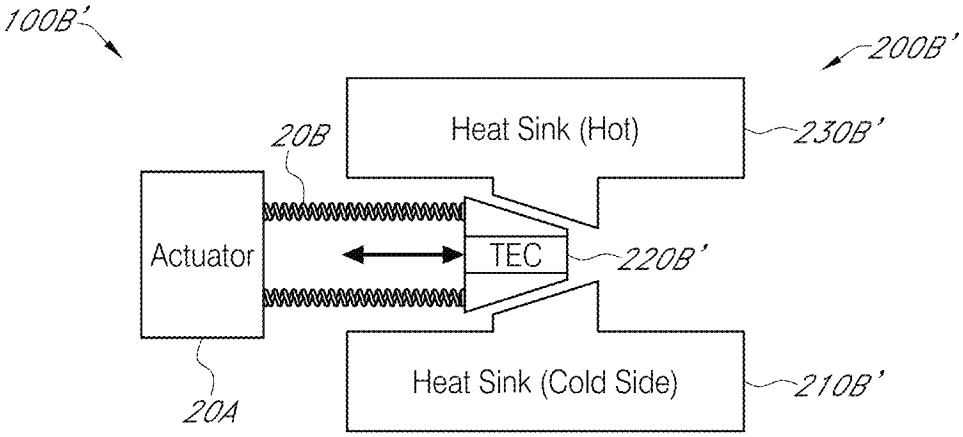
FIG. 2C is a schematic view of another embodiment of a cooler container.

FIG. 2C schematically illustrates a portion of a container system 100B' that includes the cooling system 200B'. The container system 100B' can include the vessel 120 (as described above). Some of the features of the cooling system 200B' are similar to features in the cooling system 200B in FIGS. 2A-2B. Thus, references numerals used to designate the various components of the cooling system 200B' are identical to those used for identifying the corresponding components of the cooling system 200B in FIGS. 2A-2B, except that a "" is added to the numerical identifier. Therefore, the structure and description for the various components of the cooling system 200B in FIGS. 2A-2B are understood to also apply to the corresponding components of the cooling system 200B' in FIG. 2C, except as described below.

The cooling system 200B' differs from the cooling system 200B in that the TEC 220B' is tapered or wedge shaped. An actuator 20A (e.g., electric motor) is coupled to the TEC 220B' via a driver 20B. The actuator 20A is selectively actuatable to move the TEC 220B' into and out of engagement (e.g., into and out of contact) with the hot side heat sink 230B' and the cold side heat sink 210B' to allow for heat transfer therebetween. Optionally, the hot side heat sink 230B' and/or the cold side heat sink 210B' can have a tapered surface that thermally communicates with (e.g., operatively contacts) one or more tapered surfaces (e.g., wedge shaped surfaces) of the TEC 220B' when the TEC 220B' is moved into thermal communication (e.g., into contact) with the hot side heat sink 230B' and the cold side heat sink 210B'.

Figure 3A:
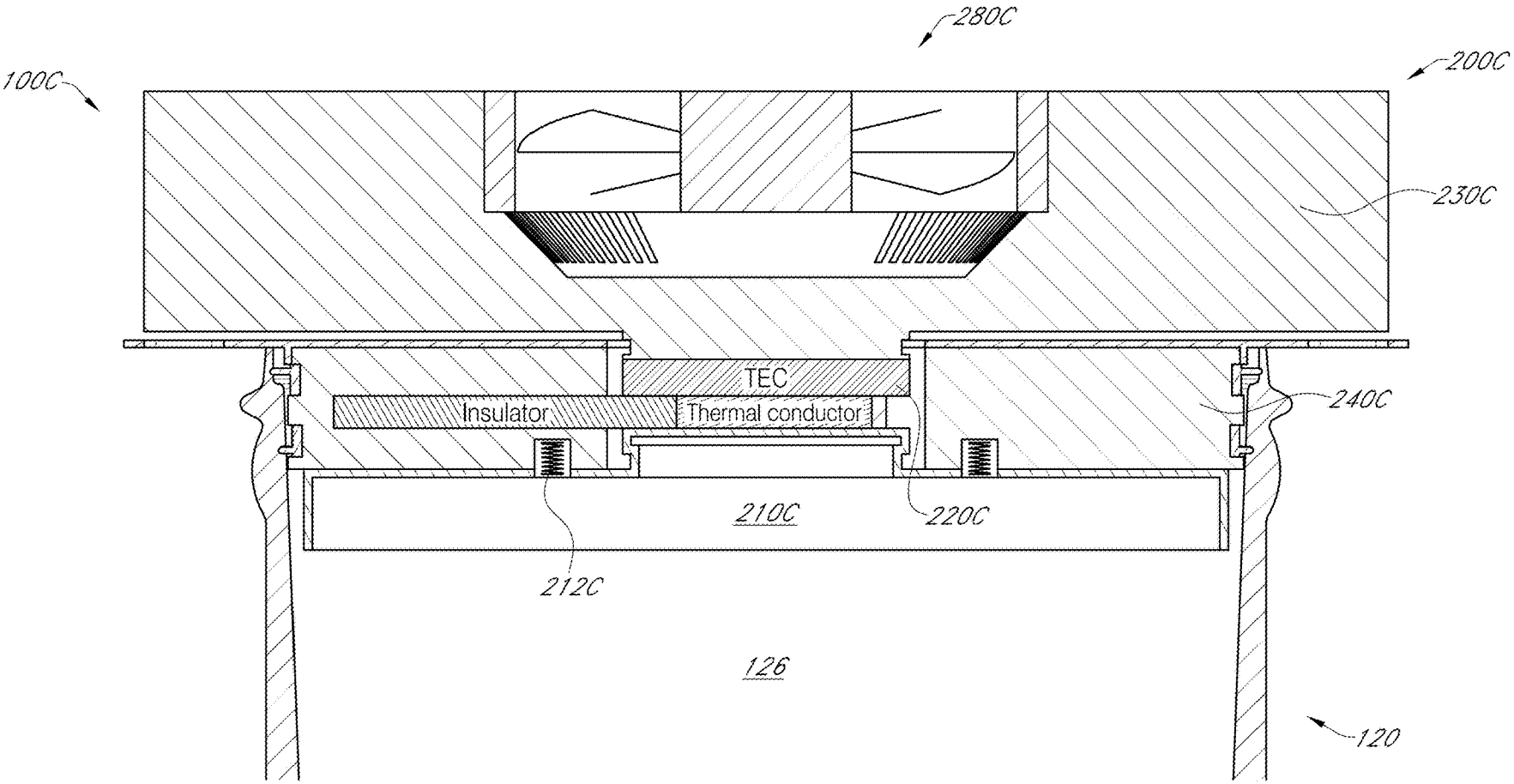
FIGS. 3A-3C are schematic partial views of another embodiment of a cooler container.
Figure 3B:
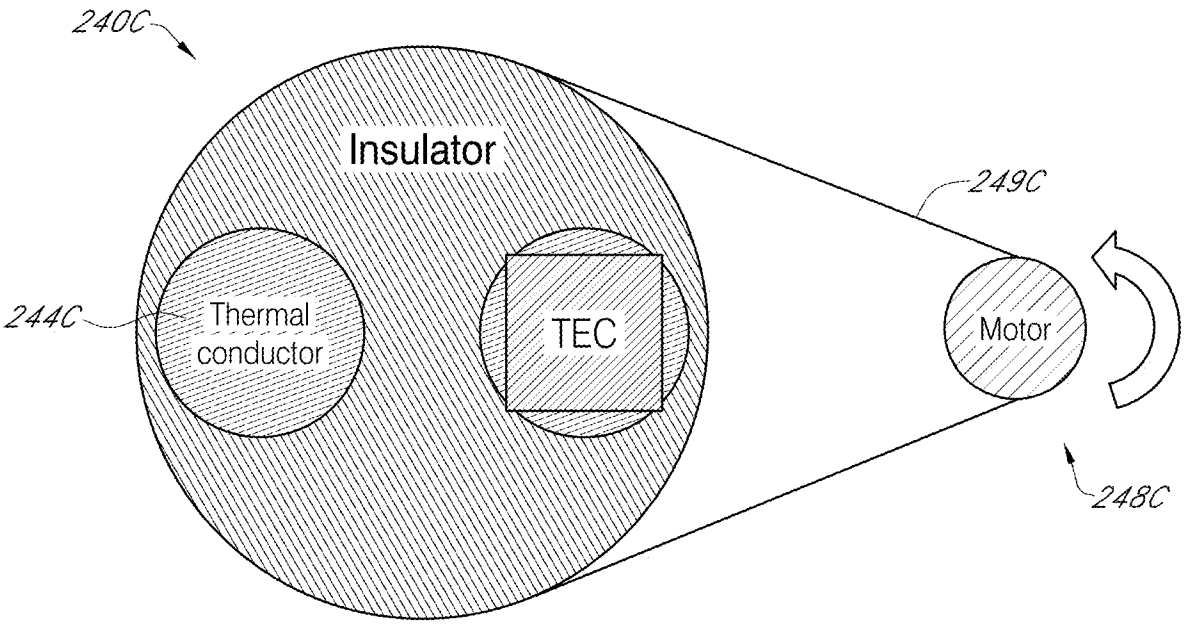
Figure 3C:
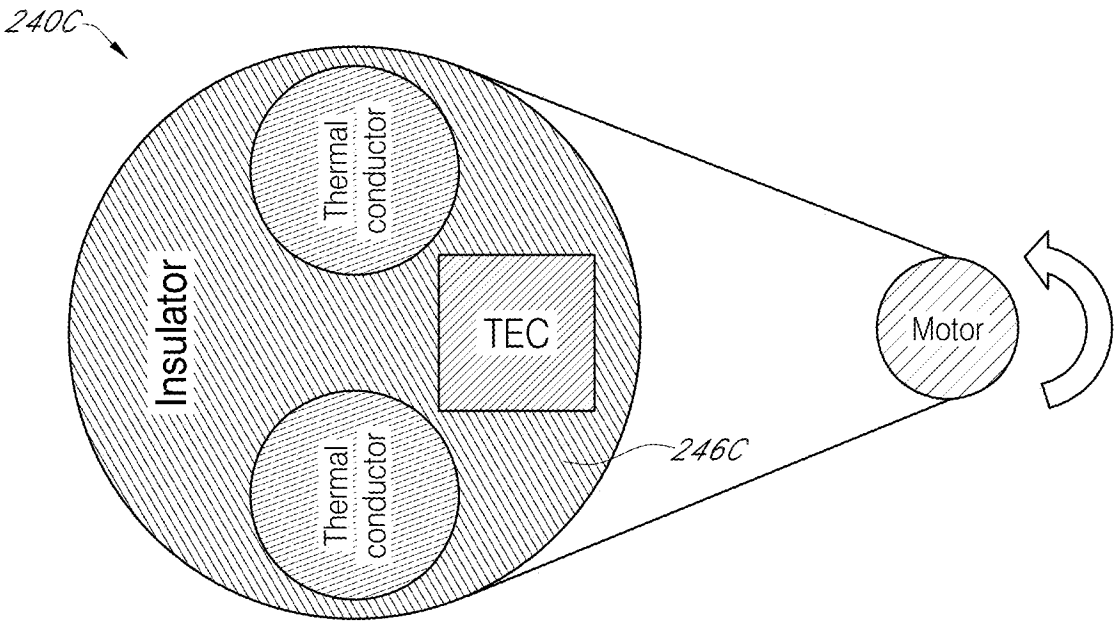

FIGS. 3A-3C schematically illustrate a container system 100C that includes the cooling system 200C. The container system 100C can include the vessel 120 (as described above). Some of the features of the cooling system 200C are similar to features in the cooling system 200B in FIGS. 2A-2B. Thus, references numerals used to designate the various components of the cooling system 200C are identical to those used for identifying the corresponding components of the cooling system 200B in FIGS. 2A-2B, except that a "C" is used instead of a "B". Therefore, the structure and description for the various components of the cooling system 200B in FIGS. 2A-2B are understood to also apply to the corresponding components of the cooling system 200C in FIGS. 3A-3C, except as described below.

The cooling system 200C differs from the cooling system 200B in that the TEC 220C is in a fixed position adjacent the hot side heat sink 230C. The insulator member 240C has one or more thermal conductors 244C embedded therein, and the insulator member 240C can be selectively rotated about an axis (e.g., an axis offset from the axis Z of the vessel 120) to align at least one of the thermal conductors 244C with the TEC 220C and the cold side heat sink 210C to allow heat transfer between the chamber 126 and the hot side heat sink 230C. The insulator member 240C can also be selectively rotated to move the one or more thermal conductors 244C out of alignment with the TEC 220C so that instead an insulating portion 246C is interposed between the TEC 220C and the cold side heat sink 210C, thereby inhibiting (e.g., preventing) heat transfer between the TEC 220C and the cold side heat sink 210C to prolong the cooled state in the chamber 126. With reference to FIGS. 3B-3C, in one implementation, the insulator member 240C can be rotated by a motor 248C (e.g., electric motor) via a pulley cable or band 249C.

Figure 4A:
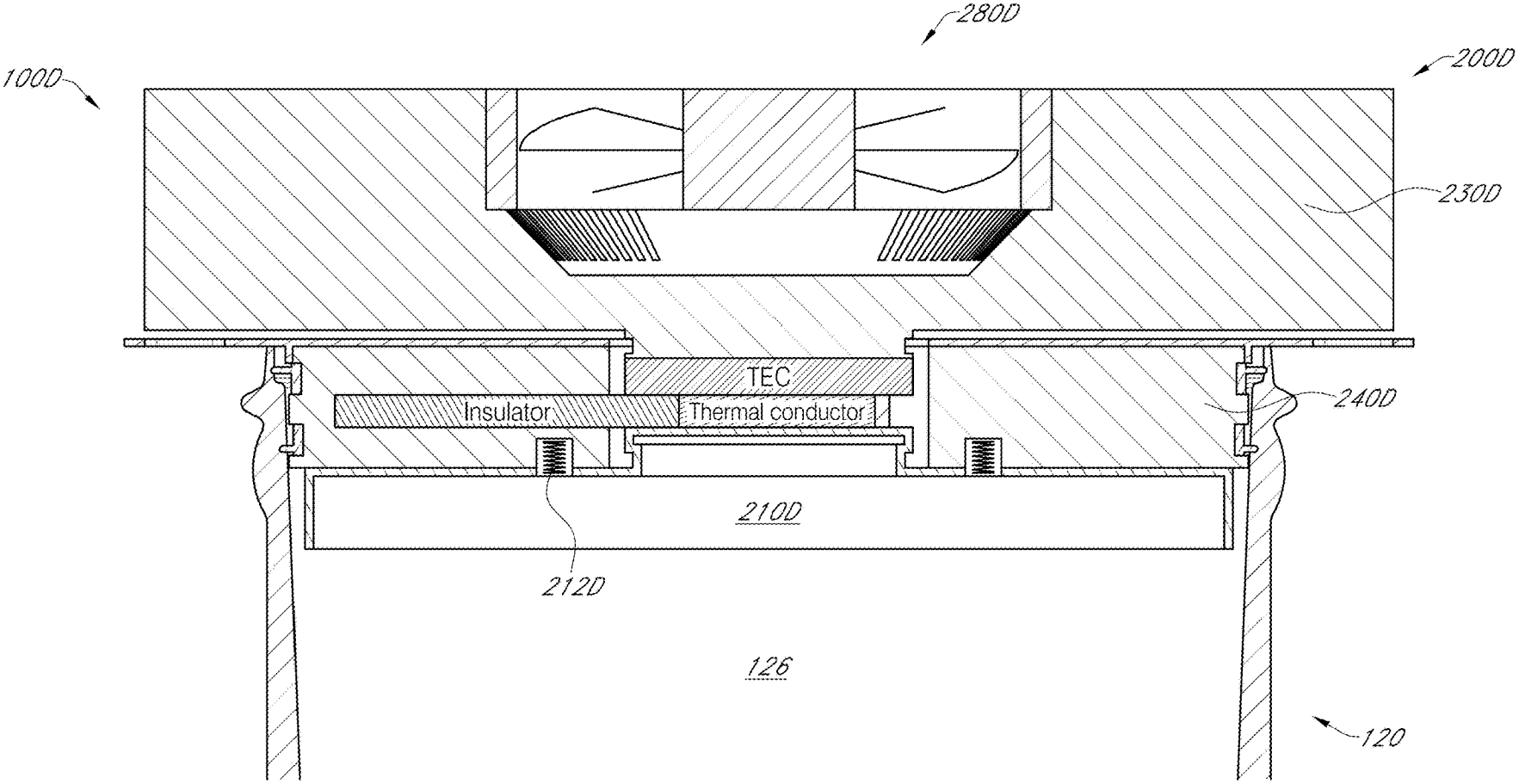
FIGS. 4A-4C are schematic partial views of another embodiment of a cooler container.
Figure 4B:
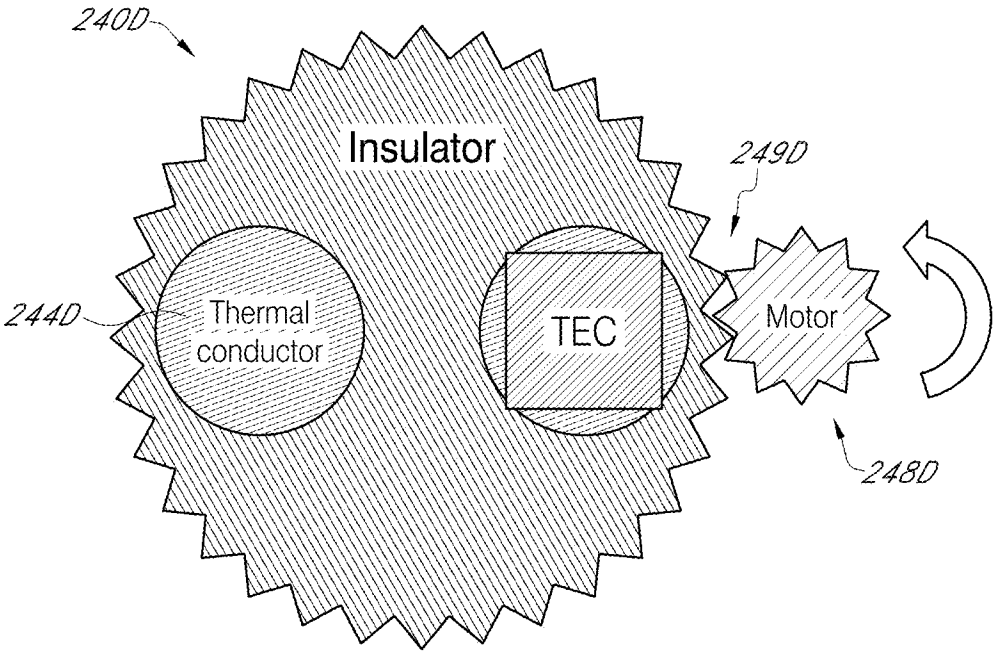
Figure 4C:
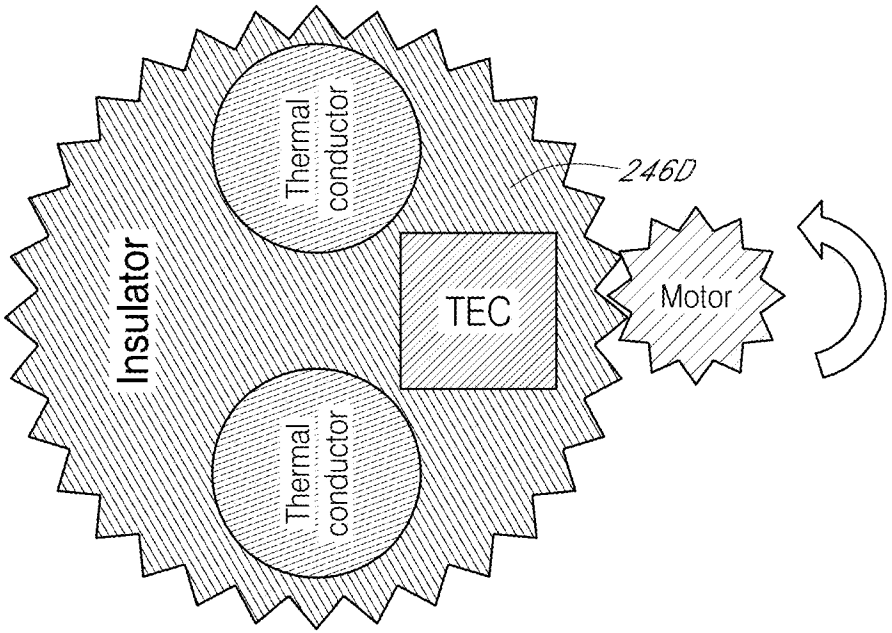

FIGS. 4A-4C schematically illustrate a container system 100D that includes the cooling system 200D. The container system 100D can include the vessel 120 (as described above). Some of the features of the cooling system 200D are similar to features in the cooling system 200C in FIGS. 3A-3C. Thus, references numerals used to designate the various components of the cooling system 200D are identical to those used for identifying the corresponding components of the cooling system 200C in FIGS. 3A-3C, except that a "D" is used instead of a "C". Therefore, the structure and description for the various components of the cooling system 200C in FIGS. 3A-3C are understood to also apply to the corresponding components of the cooling system 200D in FIGS. 4A-4C, except as described below.

The cooling system 200D differs from the cooling system 200C in the mechanism for rotating the insulator member 240D. In particular, the insulator member 240D has one or more thermal conductors 244D embedded therein, and the insulator member 240D can be selectively rotated about an axis (e.g., an axis offset from the axis Z of the vessel 120) to align at least one of the thermal conductors 244D with the TEC 220D and the cold side heat sink 210D to allow heat transfer between the chamber 126 and the hot side heat sink 230D. The insulator member 240D can also be selectively rotated to move the one or more thermal conductors 244D out of alignment with the TEC 220D so that instead an insulating portion 246D is interposed between the TEC 220D and the cold side heat sink 210D, thereby inhibiting (e.g., preventing) heat transfer between the TEC 220D and the cold side heat sink 210D to prolong the cooled state in the chamber 126. With reference to FIGS. 4B-4C, in one implementation, the insulator member 240D can be rotated by a motor 248D (e.g., electric motor) via a gear train or geared connection 249D.

Figure 5A:
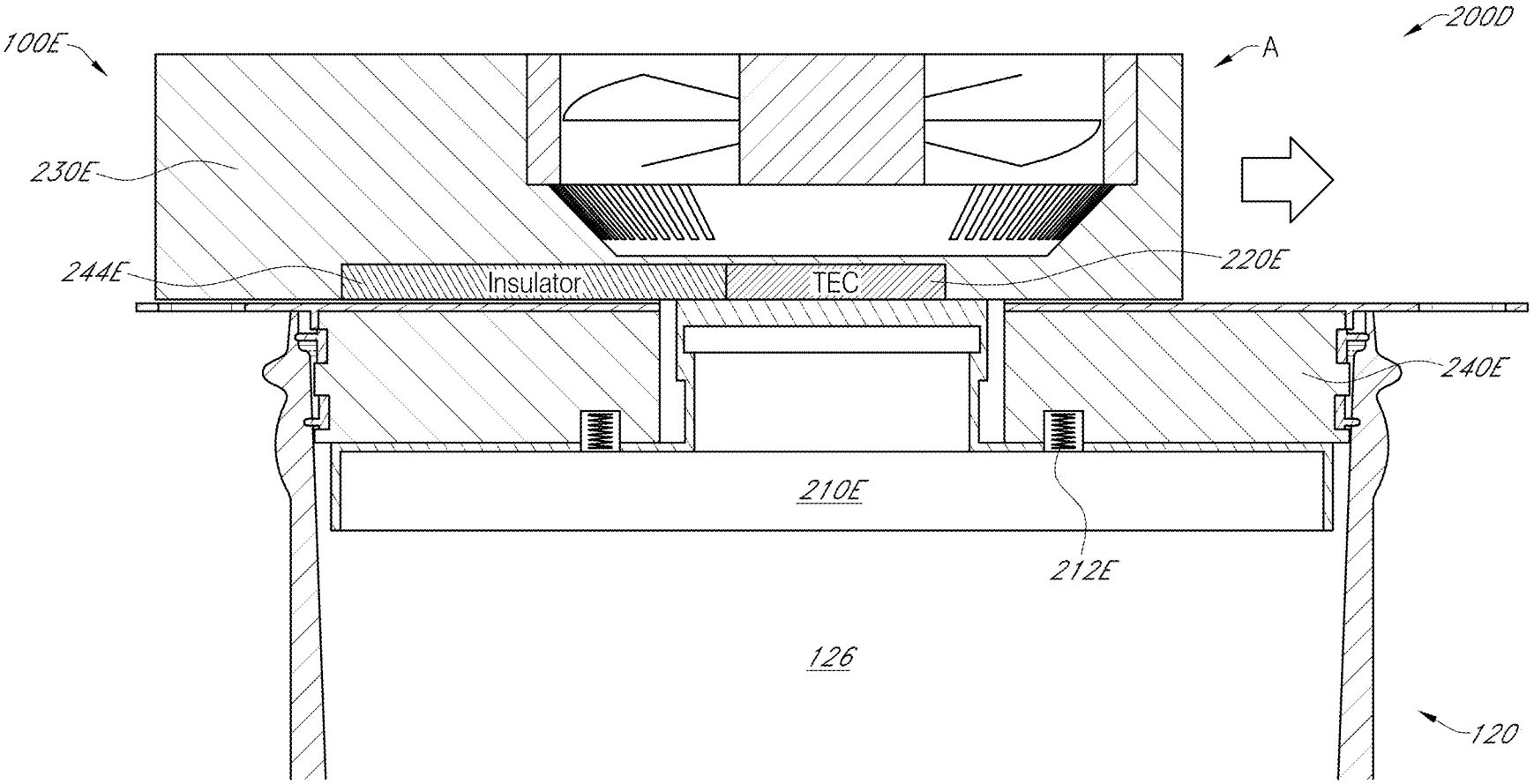
FIGS. 5A-5B are schematic partial views of another embodiment of a cooler container.
Figure 5B:
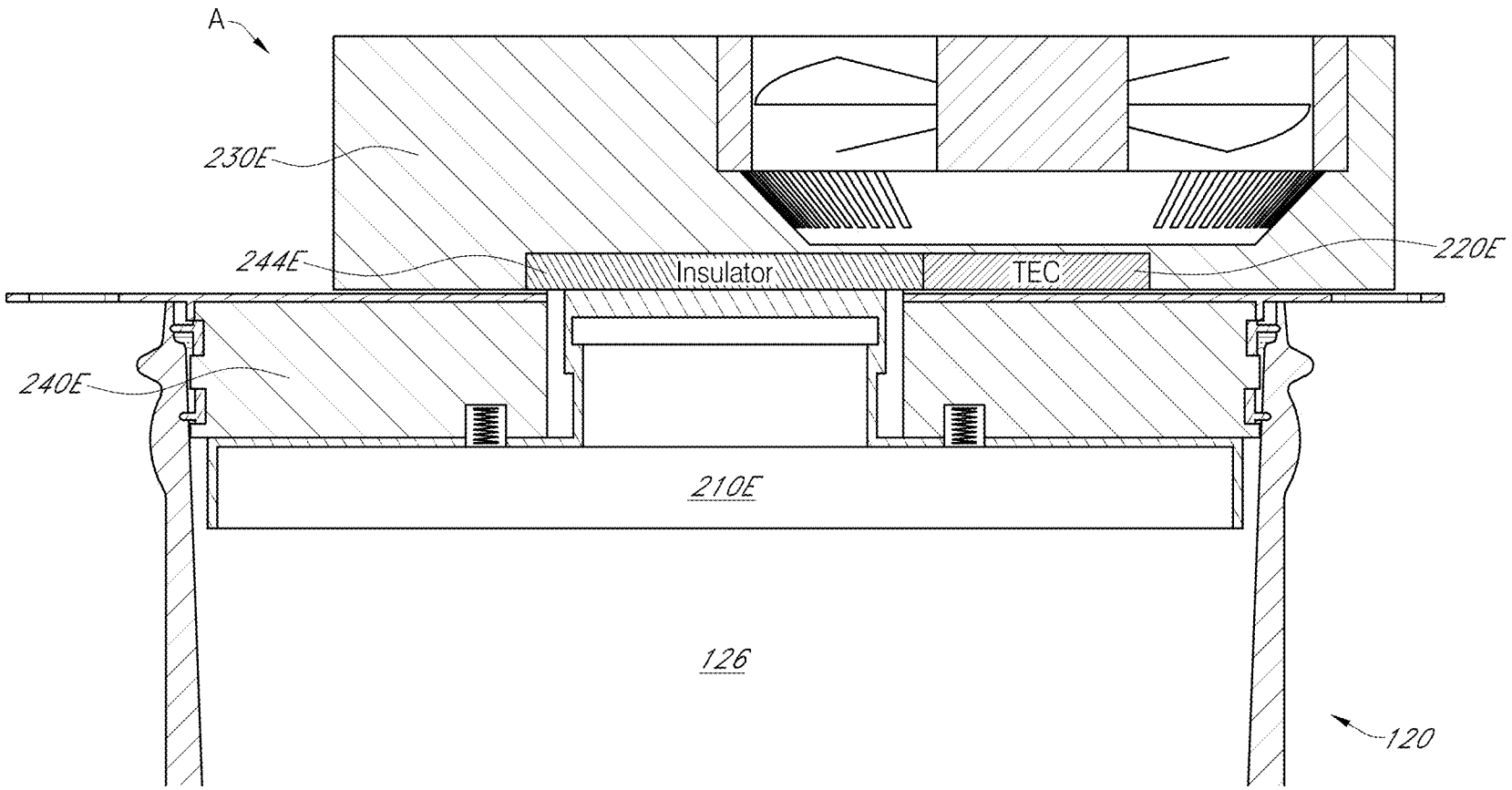

FIGS. 5A-5B schematically illustrate a container system 100E that includes the cooling system 200E. The container system 100E can include the vessel 120 (as described above). Some of the features of the cooling system 200D are similar to features in the cooling system 200B in FIGS. 2A-2B. Thus, references numerals used to designate the various components of the cooling system 200E are identical to those used for identifying the corresponding components of the cooling system 200B in FIGS. 2A-2B, except that an "E" is used instead of a "B". Therefore, the structure and description for the various components of the cooling system 200B in FIGS. 2A-2B are understood to also apply to the corresponding components of the cooling system 200E in FIGS. 5A-5B, except as described below.

An assembly A including the hot side heat sink 230E, fan 280E, TEC 220E and an insulator segment 244E can optionally be selectively slid relative to the vessel 120 to bring the TEC 220E into alignment (e.g., contact) between the cold side heat sink 210E and the hot side heat sink 230E, such that operation of the TEC 220E draws heat from the chamber 126 via the cold side heat sink 210E and transfers it to the hot side heat sink 230E. The fan 280E is optionally operated to further dissipate heat from the hot side heat sink 230E, allowing it to draw more heat from the chamber 126 via the TEC 220E. Optionally, one or more springs 212E (e.g., coil springs) resiliently couple the cold side heat sink 210E with the insulator 240E to maintain an efficient thermal connection between the cold side heat sink 210E and the TEC 220E when aligned together.

The assembly A can optionally be selectively slid to move the TEC 200E out of alignment (e.g., contact) between the cold side heat sink 210E and the hot side heat sink 230E. This causes the insulator segment 244E to instead be placed in alignment (e.g., contact) between the cold side heat sink 210E and the hot side heat sink 230E, which disallows heat transfer through the TEC 220E (e.g., once the desired temperature in the chamber 126 has been achieved).

The assembly A can be slid with a number of suitable mechanisms. In one implementation, an electric motor can drive a gear in contact with a gear rack (e.g., rack and pinion), where the assembly A can be attached to the rack that linearly moves via rotation of the gear by the electric motor. In another implementation, a solenoid motor and be attached to assembly A to effect the linear movement of the assembly A. In still another implementation a pneumatic or electromechanical system can actuate movement of a piston attached to the assembly A to effect the linear movement of the assembly A.

Figure 6A:
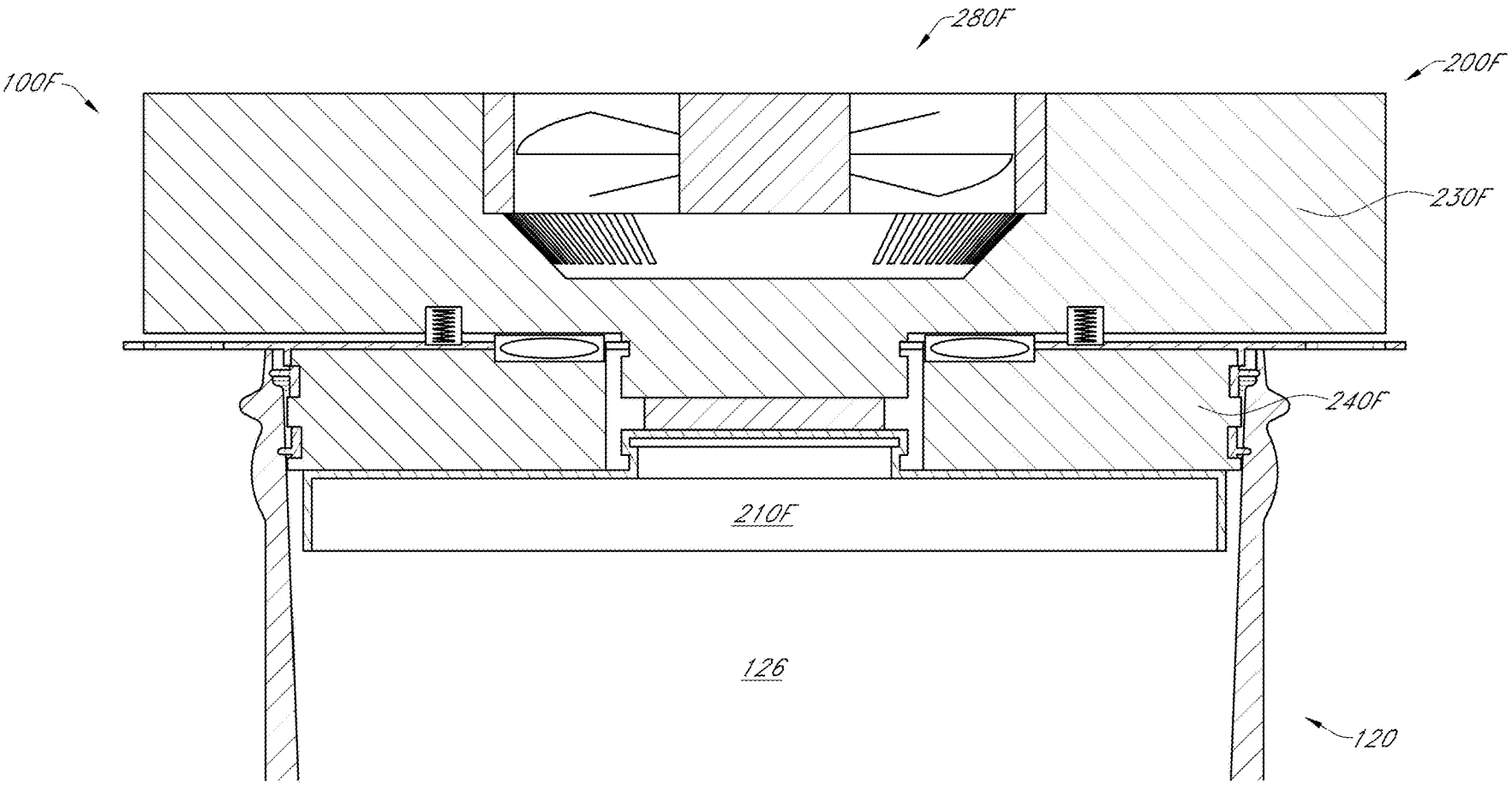
FIGS. 6A-6B are schematic partial views of another embodiment of a cooler container.
Figure 6B:
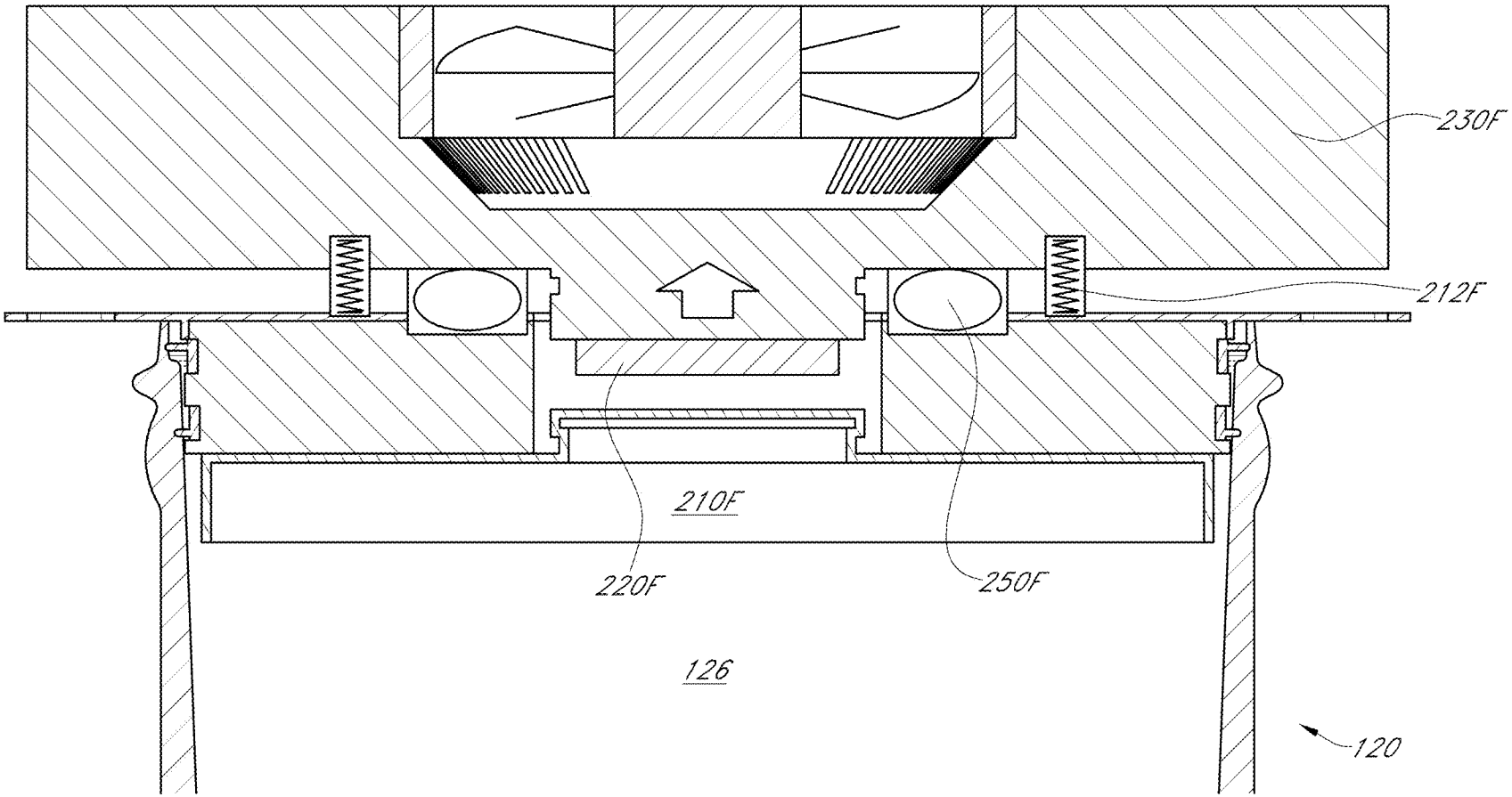

FIGS. 6A-6B schematically illustrate a container system 100F that includes the cooling system 200F. The container system 100F can include the vessel 120 (as described above). Some of the features of the cooling system 200F are similar to features in the cooling system 200 in FIGS. 1A-1D. Thus, references numerals used to designate the various components of the cooling system 200F are identical to those used for identifying the corresponding components of the cooling system 200 in FIGS. 1A-1D, except that a "G" is added to the numerical identifiers. Therefore, the structure and description for the various components of the cooling system 200 in FIGS. 1A-1D are understood to also apply to the corresponding components of the cooling system 200F in FIGS. 6A-6B, except as described below.

As shown in FIGS. 6A-6B, the hot side heat sink 230F is in contact with the TEC 220F. One or more springs 212F (e.g., coil springs) can be disposed between the hot side heat sink 230F and the insulator member 240F. The one or more springs 212F exert a (bias) force on the hot side heat sink 230F to bias it toward contact with the insulator member 240F. One or more expandable bladders 250F are disposed between the insulator member 240F and the hot side heat sink 230F.

When the one or more expandable bladders 250F are in a collapsed state (see FIG. 6A), the one or more springs 212F draw the hot side heat sink 230F toward the insulator member 240F so that the TEC 220F contacts the cold side heat sink 210F. The TEC 220F can be operated to draw heat out of the chamber 126 via the cold side heat sink 210F, which is then transferred via the TEC 220F to the hot side heat sink 230F. Optionally, the fan 280F can be operated to dissipate heat from the hot side heat sink 230F, allowing the hot side heat sink 230F to draw additional heat from the chamber 126 via the contact between the cold side heat sink 210F, the TEC 220F and the hot side heat sink 230F. Accordingly, with the one or more expandable bladders 250F in the collapsed state, the cooling system 200F can be operated to draw heat from the chamber 126 to cool the chamber to a predetermined temperature or temperature range.

When the one or more expandable bladders 250F are in an expanded state (see FIG. 6B), they can exert a force on the hot side heat sink 230F in a direction opposite to the bias force of the one or more springs 212F, causing the hot side heat sink 230F to separate from (e.g., lift from) the insulator member 240F. Such separation between the hot side heat sink 230F and the insulator member 240F also causes the TEC 220F to become spaced apart from the cold side heat sink 210F, inhibiting (e.g., preventing) heat transfer between the cold side heat sink 210F and the TEC 220F. Accordingly, once the predetermined temperature or temperature range has been achieved in the chamber 126, the one or more expandable bladders 250F can be transitioned to the expanded state to thermally disconnect the cold side heat sink 210F from the TEC 220F to thereby maintain the chamber 126 in a prolonged cooled state.

In one implementation, the one or more expandable bladders 250F form part of a pneumatic system (e.g., having a pump, one or more valves, and/or a gas reservoir) that selectively fills the bladders 250F with a gas to move the bladders 250F to the expanded state and selectively empties the one or more expandable bladders 250F to move the bladders 250F to the collapsed state.

In another implementation, the one or more expandable bladders 250F form part of a hydraulic system (e.g., having a pump, one or more valves, and/or a liquid reservoir) that selectively fills the bladders 250F with a liquid to move the bladders 250F to the expanded state and selectively empties the one or more expandable bladders 250F to move the bladders 250F to the collapsed state.

Figure 7A:
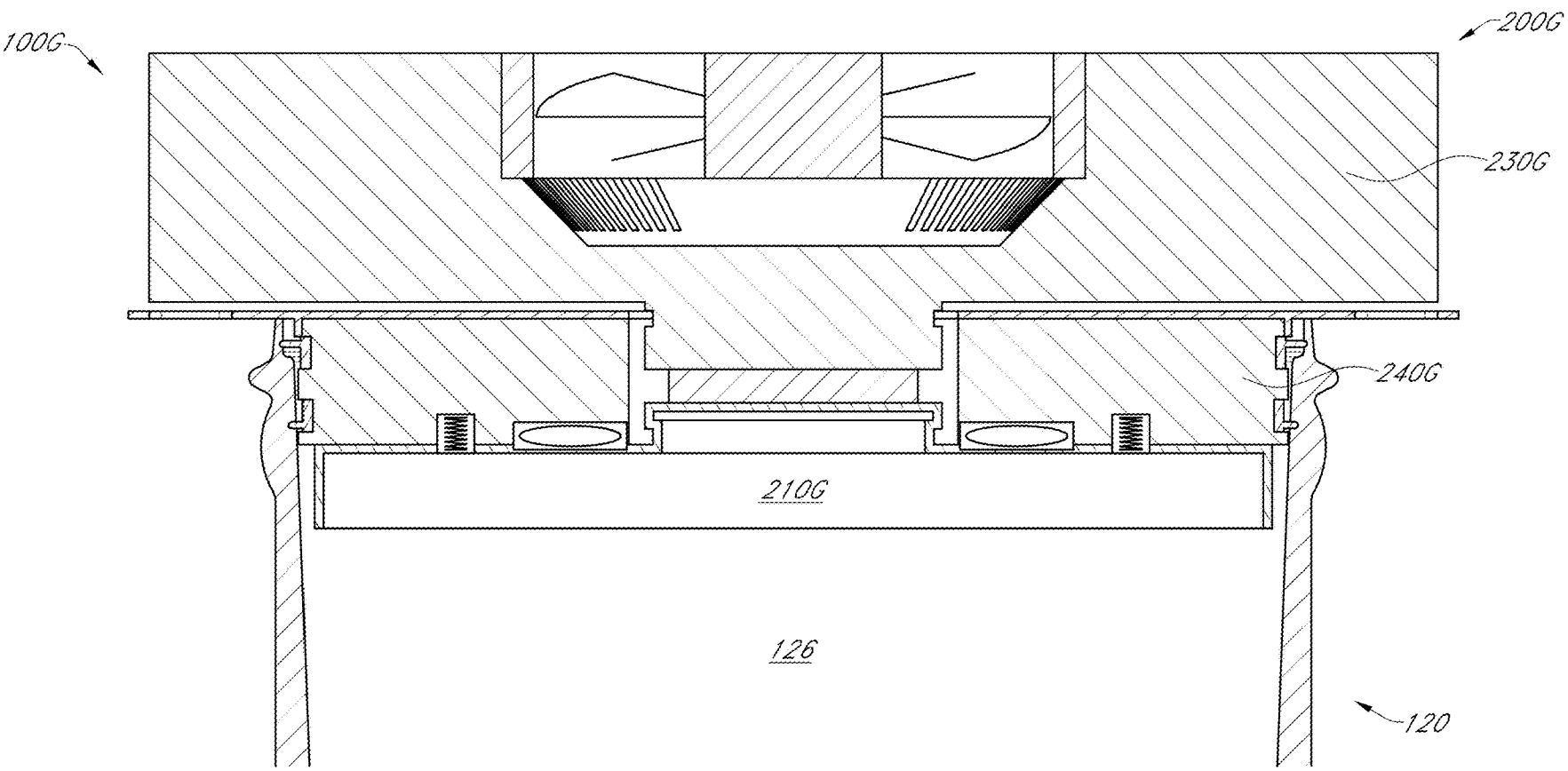
FIGS. 7A-7B are schematic partial views of another embodiment of a cooler container.
Figure 7B:
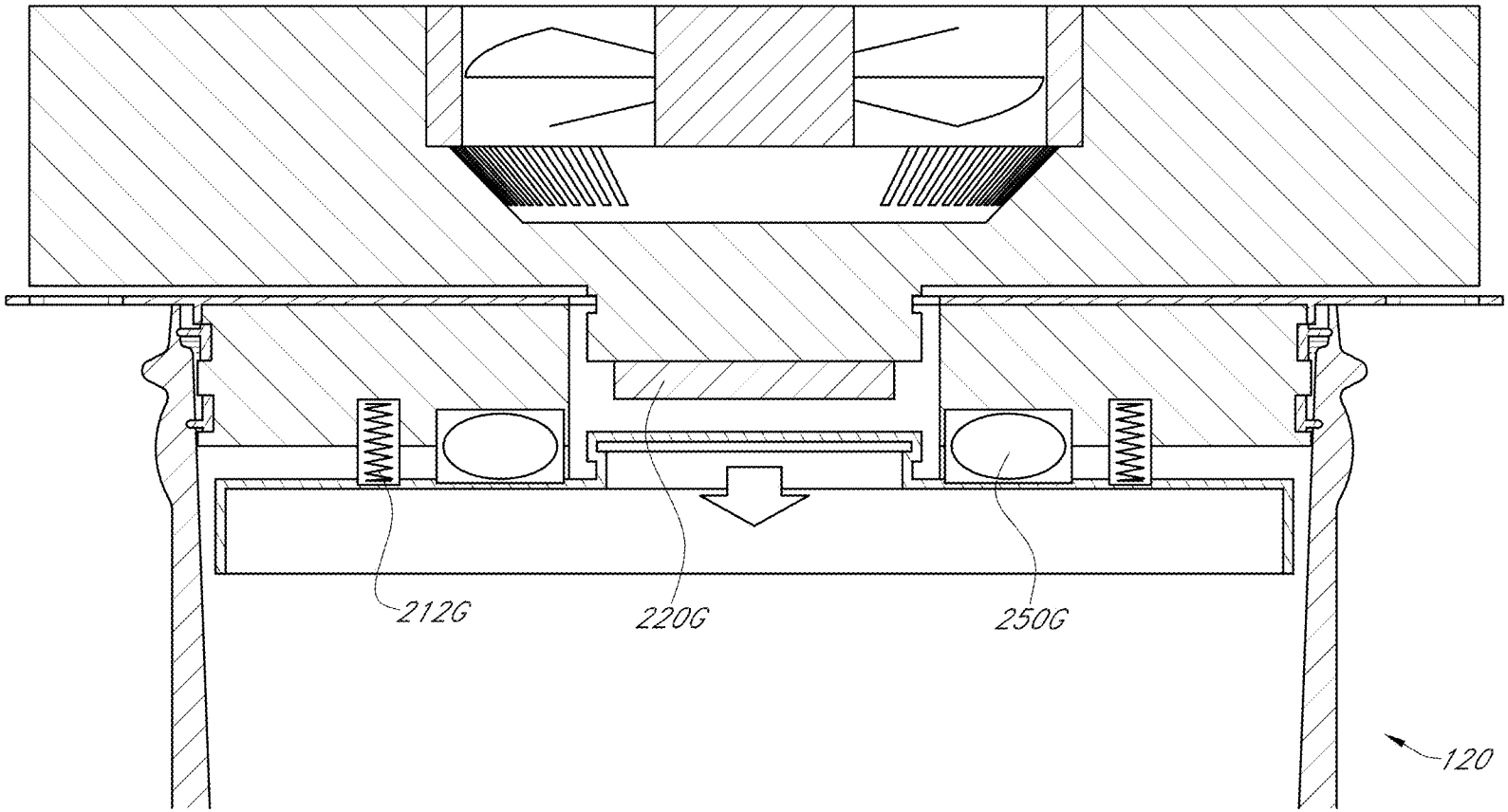

FIGS. 7A-7B schematically illustrate a container system 100G that includes the cooling system 200G. The container system 100G can include the vessel 120 (as described above). Some of the features of the cooling system 200G are similar to features in the cooling system 200F in FIGS. 6A-6B. Thus, references numerals used to designate the various components of the cooling system 200G are identical to those used for identifying the corresponding components of the cooling system 200F in FIGS. 6A-6B, except that a "G" is used instead of an "F". Therefore, the structure and description for the various components of the cooling system 200F in FIGS. 6A-6B are understood to also apply to the corresponding components of the cooling system 200G in FIGS. 7A-7B, except as described below.

The cooling system 200G differs from the cooling system 200F in the position of the one or more springs 212G and the one or more expandable bladders 250G. As shown in FIGS. 7A-7B, the one or more springs 212G (e.g., coil springs) can be disposed between the cold side heat sink 210G and the insulator member 240G. The one or more springs 212G exert a (bias) force on the cold side heat sink 210G to bias it toward contact with the insulator member 240G. The one or more expandable bladders 250G are disposed between the insulator member 240G and the cold side heat sink 230G.

When the one or more expandable bladders 250G are in a collapsed state (see FIG. 7A), the one or more springs 212G draw the cold side heat sink 230G (up) toward the insulator member 240G so that the TEC 220G contacts the cold side heat sink 210G. The TEC 220G can be operated to draw heat out of the chamber 126 via the cold side heat sink 210G, which is then transferred via the TEC 220G to the hot side heat sink 230G. Optionally, the fan 280G can be operated to dissipate heat from the hot side heat sink 230G, allowing the hot side heat sink 230G to draw additional heat from the chamber 126 via the contact between the cold side heat sink 210G, the TEC 220G and the hot side heat sink 230G. Accordingly, with the one or more expandable bladders 250G in the collapsed state, the cooling system 200G can be operated to draw heat from the chamber 126 to cool the chamber to a predetermined temperature or temperature range.

When the one or more expandable bladders 250G are in an expanded state (see FIG. 7B), they can exert a force on the cold side heat sink 210G in a direction opposite to the bias force of the one or more springs 212G, causing the cold side heat sink 210G to separate from (e.g., move down relative to) the insulator member 240G. Such separation between the cold side heat sink 210G and the insulator member 240G also causes the TEC 220G to become spaced apart from the cold side heat sink 210G, inhibiting (e.g., preventing) heat transfer between the cold side heat sink 210G and the TEC 220G. Accordingly, once the predetermined temperature or temperature range has been achieved in the chamber 126, the one or more expandable bladders 250G can be transitioned to the expanded state to thermally disconnect the cold side heat sink 210G from the TEC 220G to thereby maintain the chamber 126 in a prolonged cooled state.

In one implementation, the one or more expandable bladders 250G form part of a pneumatic system (e.g., having a pump, one or more valves, and/or a gas reservoir) that selectively fills the bladders 250G with a gas to move the bladders 250G to the expanded state and selectively empties the one or more expandable bladders 250G to move the bladders 250G to the collapsed state.

In another implementation, the one or more expandable bladders 250G form part of a hydraulic system (e.g., having a pump, one or more valves, and/or a liquid reservoir) that selectively fills the bladders 250G with a liquid to move the bladders 250G to the expanded state and selectively empties the one or more expandable bladders 250G to move the bladders 250G to the collapsed state.

Figure 8A:
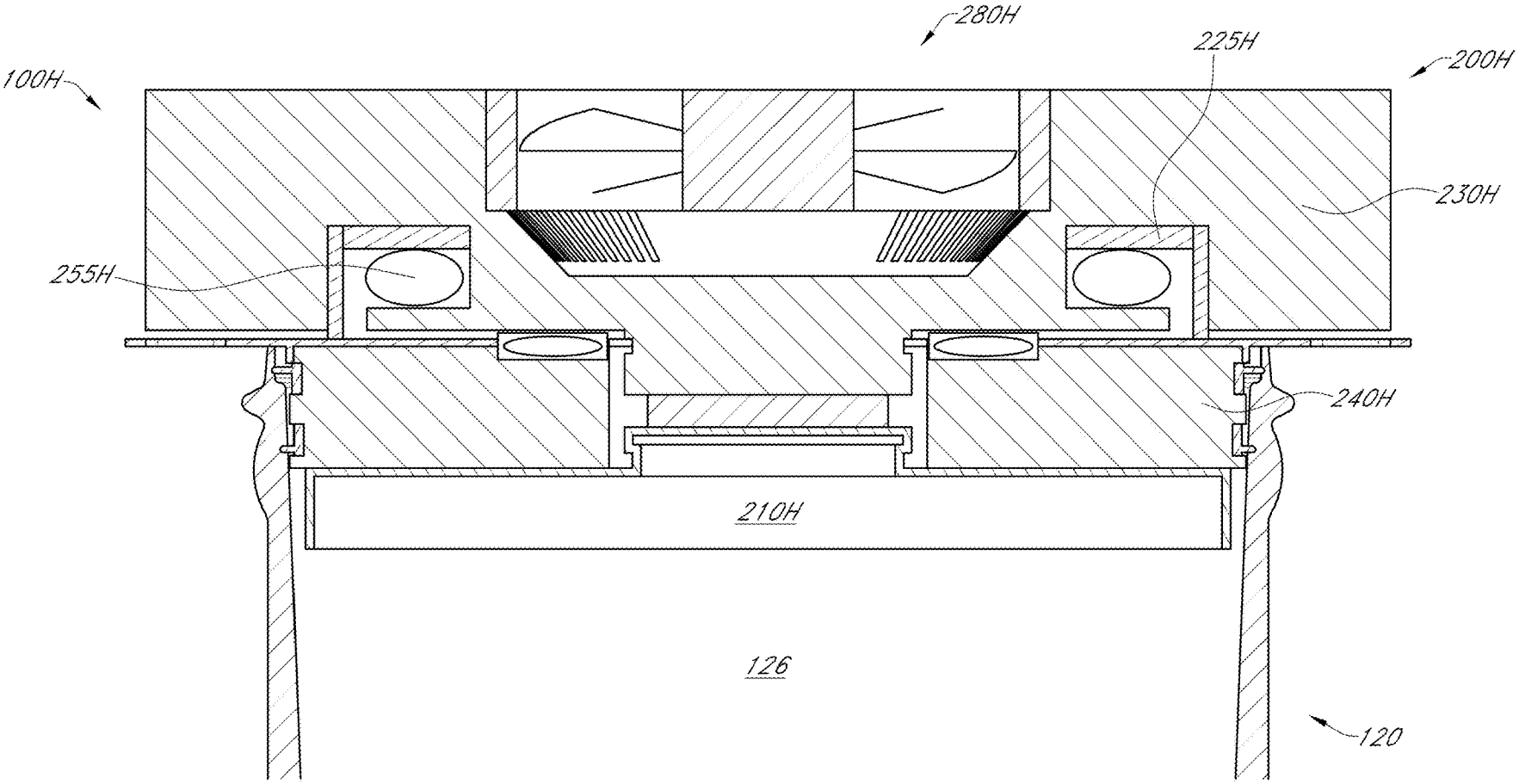
FIGS. 8A-8B are schematic partial views of another embodiment of a cooler container.
Figure 8B:
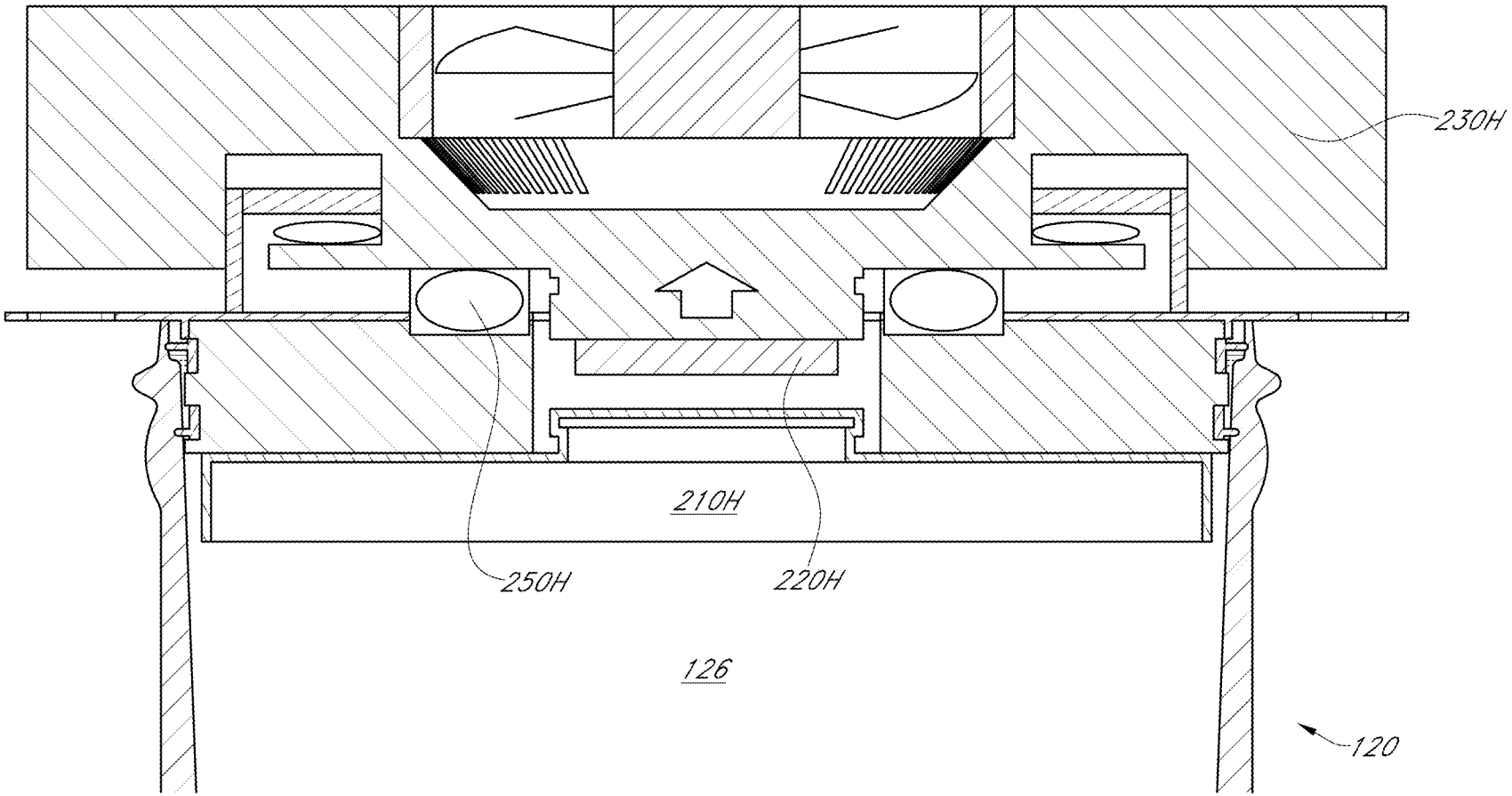

FIGS. 8A-8B schematically illustrate a container system 100H that includes the cooling system 200H. The container system 100H can include the vessel 120 (as described above). Some of the features of the cooling system 200H are similar to features in the cooling system 200F in FIGS. 6A-6B. Thus, references numerals used to designate the various components of the cooling system 200H are identical to those used for identifying the corresponding components of the cooling system 200F in FIGS. 6A-6B, except that an "H" is used instead of an "F". Therefore, the structure and description for the various components of the cooling system 200F in FIGS. 6A-6B are understood to also apply to the corresponding components of the cooling system 200H in FIGS. 8A-8B, except as described below.

The cooling system 200H differs from the cooling system 200F in that one or more expandable bladders 255H are included instead of the one or more springs 212F to provide a force in a direction opposite to the force exerted by the one or more expandable bladders 250H. As shown in FIGS. 8A-8B, the one or more expandable bladders 255H are disposed between a housing 225H and a portion of the hot side heat sink 230H, and one or more expandable bladders 250H are disposed between the insulator member 240H and the hot side heat sink 230H. Optionally, the one or more expandable bladders 250H are in fluid communication with the one or more expandable bladders 255H, and the fluid is moved between the two expandable bladders 250H, 255H. That is, when the one or more expandable bladders 250H are in the expanded state, the one or more expandable bladders 255H are in the collapsed state, and when the expandable bladders 250H are in the collapsed state, the expandable bladders 255H are in the expanded state.

When the one or more expandable bladders 250H are in a collapsed state (see FIG. 8A), the one or more expandable bladders 255H are in the expanded state and exert a force on the hot side heat sink 230H toward the insulator member 240H so that the TEC 220H contacts the cold side heat sink 210H. The TEC 220H can be operated to draw heat out of the chamber 126 via the cold side heat sink 210H, which is then transferred via the TEC 220H to the hot side heat sink 230H. Optionally, the fan 280H can be operated to dissipate heat from the hot side heat sink 230H, allowing the hot side heat sink 230H to draw additional heat from the chamber 126 via the contact between the cold side heat sink 210H, the TEC 220H and the hot side heat sink 230H. Accordingly, with the one or more expandable bladders 250H in the collapsed state, the cooling system 200H can be operated to draw heat from the chamber 126 to cool the chamber to a predetermined temperature or temperature range.

When the one or more expandable bladders 250H are in an expanded state (see FIG. 8B), the one or more expandable bladders 255H are in a collapsed state. The expanded state of the expandable bladders 250H exerts a force on the hot side heat sink 230H that causes the hot side heat sink 230H to separate from (e.g., lift from) the insulator member 240H. Such separation between the hot side heat sink 230H and the insulator member 240H also causes the TEC 220H to become spaced apart from (e.g., lift from) the cold side heat sink 210H, thereby thermally disconnecting (e.g., inhibiting heat transfer between) the cold side heat sink 210H and the TEC 220H. Accordingly, once the predetermined temperature or temperature range has been achieved in the chamber 126, the one or more expandable bladders 250H can be transitioned to the expanded state (e.g., by transferring the fluid from the expandable bladders 255H to the expandable bladders 250H) to thermally disconnect the cold side heat sink 210H from the TEC 220H to thereby maintain the chamber 126 in a prolonged cooled state.

In one implementation, the one or more expandable bladders 250H, 255H form part of a pneumatic system (e.g., having a pump, one or more valves, and/or a gas reservoir) that selectively fills and empties the bladders 250H, 255H with a gas to move them between an expanded and a collapsed state.

In one implementation, the one or more expandable bladders 250H, 255H form part of a hydraulic system (e.g., having a pump, one or more valves, and/or a liquid reservoir) that selectively fills and empties the bladders 250H, 255H with a liquid to move them between an expanded and a collapsed state.

Figure 9A:
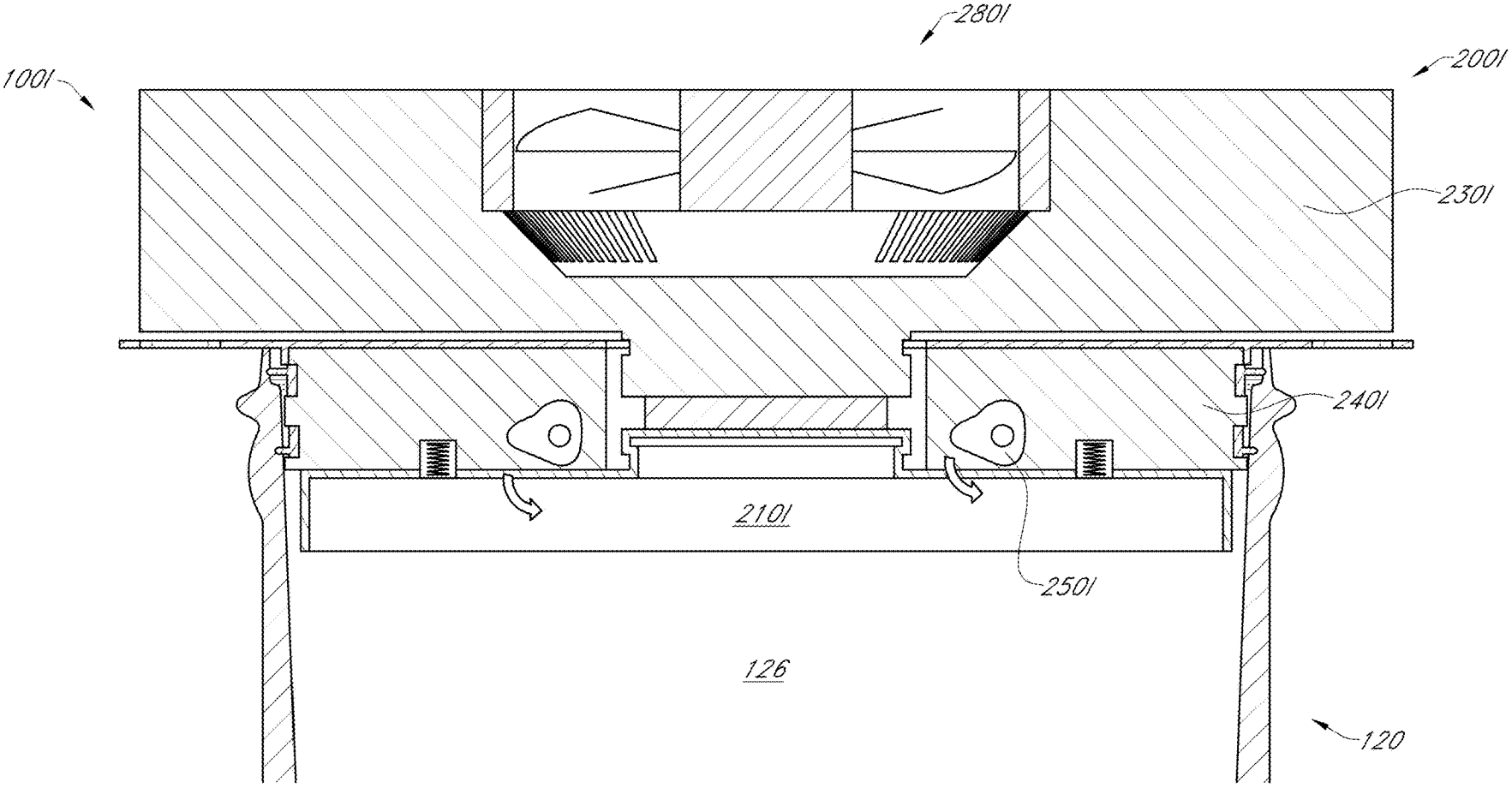
FIGS. 9A-9B are schematic partial views of another embodiment of a cooler container.
Figure 9B:
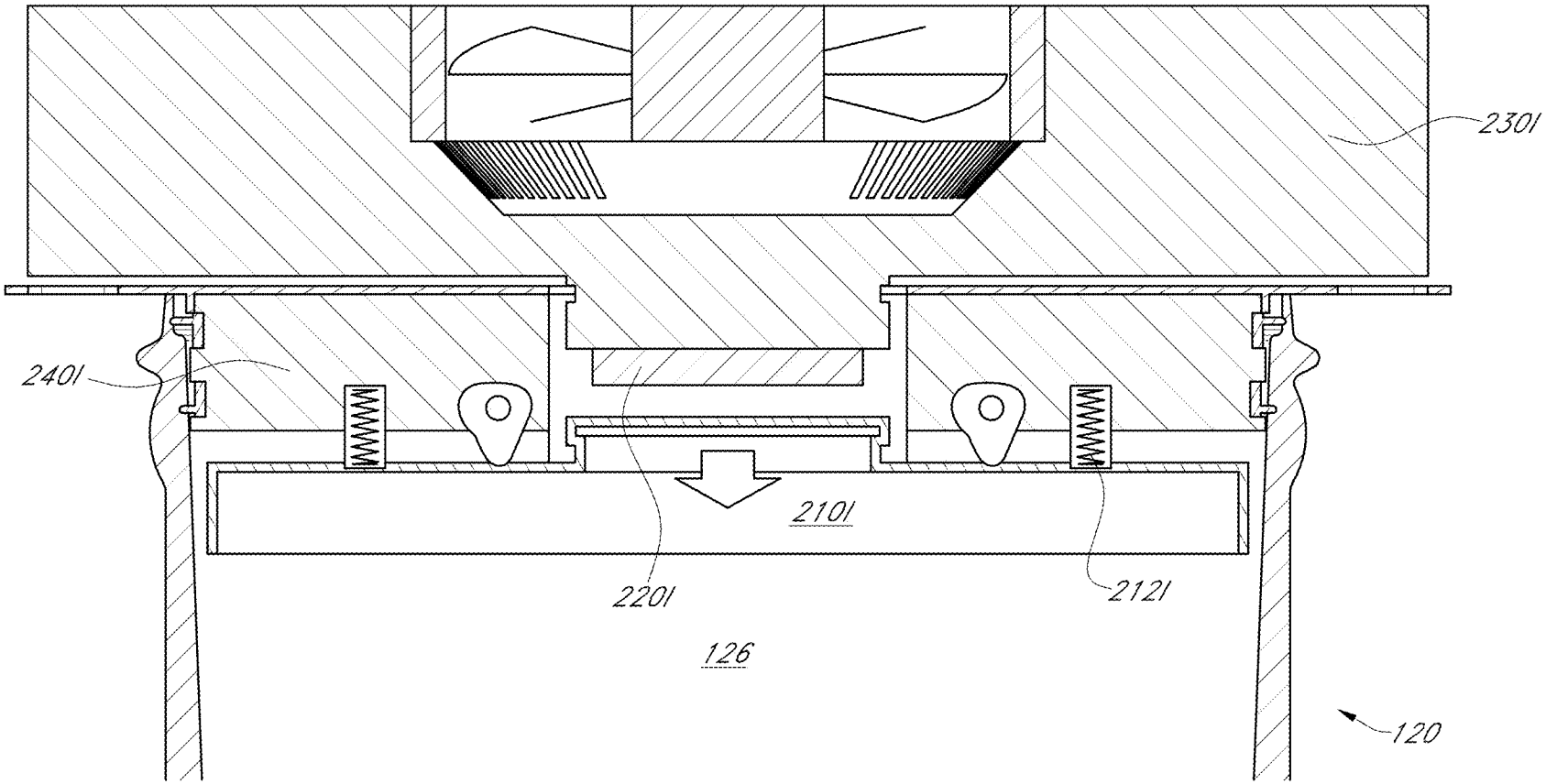

FIGS. 9A-9B schematically illustrate a container system 100I that includes the cooling system 200I. The container system 100I can include the vessel 120 (as described above). Some of the features of the cooling system 200I are similar to features in the cooling system 200G in FIGS. 7A-7B. Thus, references numerals used to designate the various components of the cooling system 200I are identical to those used for identifying the corresponding components of the cooling system 200G in FIGS. 7A-7B, except that an "I" is used instead of a "G". Therefore, the structure and description for the various components of the cooling system 200G in FIGS. 7A-7B are understood to also apply to the corresponding components of the cooling system 200I in FIGS. 9A-9B, except as described below.

The cooling system 200I differs from the cooling system 200G in that the one or more rotatable cams 250I are used instead of one or more expandable bladders 250G. As shown in FIGS. 9A-9B, the one or more springs 212I (e.g., coil springs) can be disposed between the cold side heat sink 210I and the insulator member 240I. The one or more springs 212I exert a (bias) force on the cold side heat sink 210I to bias it toward contact with the insulator member 240I. The one or more rotatable cams 250I are rotatably coupled to the insulator member 240I and rotatable to selectively contact a proximal surface of the cold side heat sink 230I.

In a cooling state (see FIG. 9A), the rotatable cams 250I are not in contact with the cold side heat sink 210I, such that the one or more springs 212I bias the cold side heat sink 210I into contact with the TEC 220I, thereby allowing heat transfer therebetween. The TEC 220I can be operated to draw heat out of the chamber 126 via the cold side heat sink 210I, which is then transferred via the TEC 220I to the hot side heat sink 230I. Optionally, the fan 280I can be operated to dissipate heat from the hot side heat sink 230I, allowing the hot side heat sink 230I to draw additional heat from the chamber 126 via the contact between the cold side heat sink 210I, the TEC 220I and the hot side heat sink 230I. Accordingly, with the one or more rotatable cams 250I in a retracted state, the cooling system 200I can be operated to draw heat from the chamber 126 to cool the chamber to a predetermined temperature or temperature range.

When the one or more rotatable cams 250I are moved to the deployed state (see FIG. 9B), the cams 250I bear against the cold side heat sink 210I, overcoming the bias force of the springs 212I. In the deployed state, the one or more cams 250I exert a force on the cold side heat sink 210I that causes the cold side heat sink 210I to separate from (e.g., move down relative to) the insulator member 240I. Such separation between the cold side heat sink 210I and the insulator member 240I also causes the cold side heat sink 210I to become spaced apart from (e.g., move down relative to) the TEC 220I, thereby thermally disconnecting (e.g., inhibiting heat transfer between) the cold side heat sink 210I and the TEC 220I. Accordingly, once the predetermined temperature or temperature range has been achieved in the chamber 126, the one or more rotatable cams 250I can be moved to the deployed state to thermally disconnect the cold side heat sink 210I from the TEC 220I to thereby maintain the chamber 126 in a prolonged cooled state.

Figure 10A:
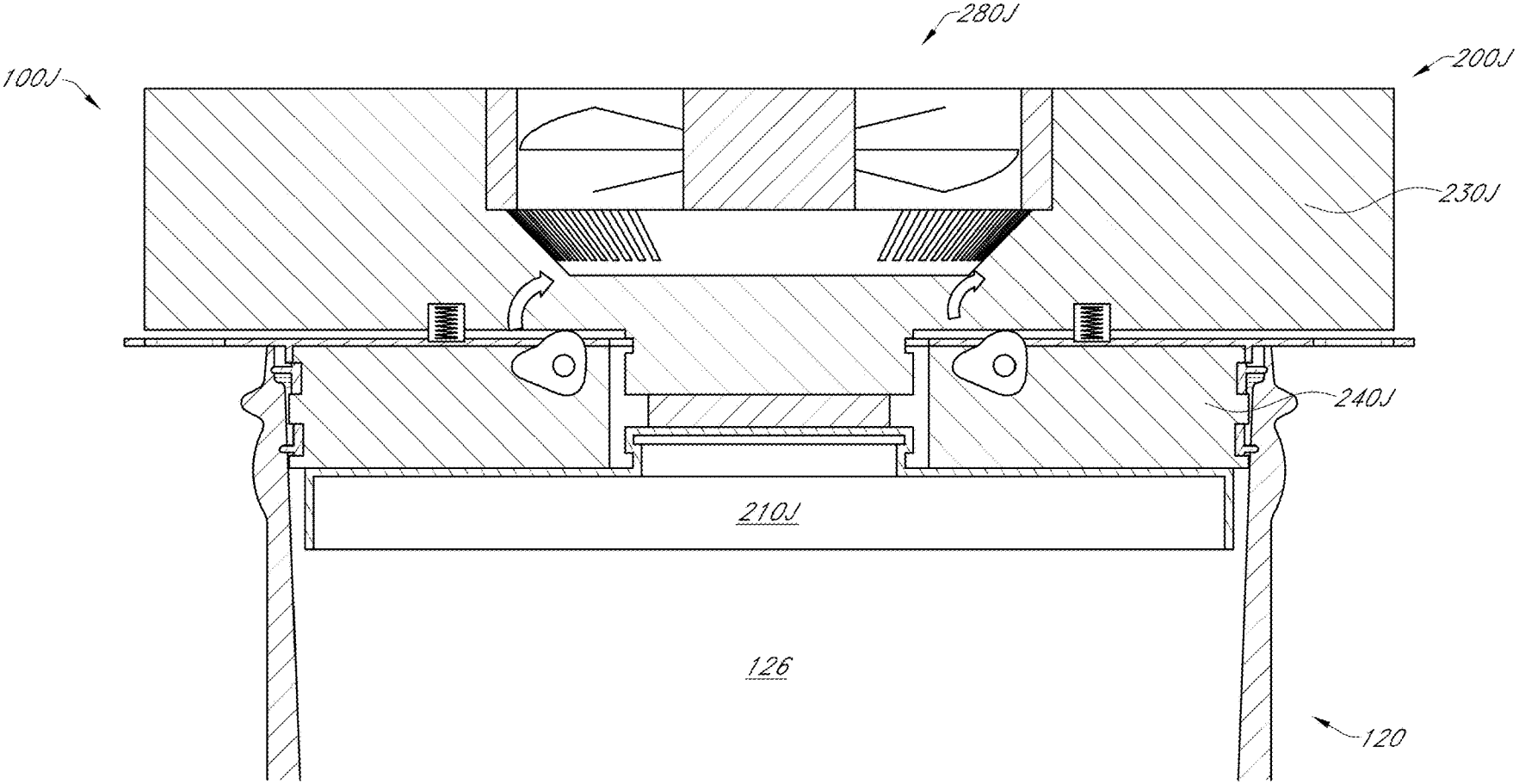
FIGS. 10A-10B are schematic partial views of another embodiment of a cooler container.
Figure 10B:
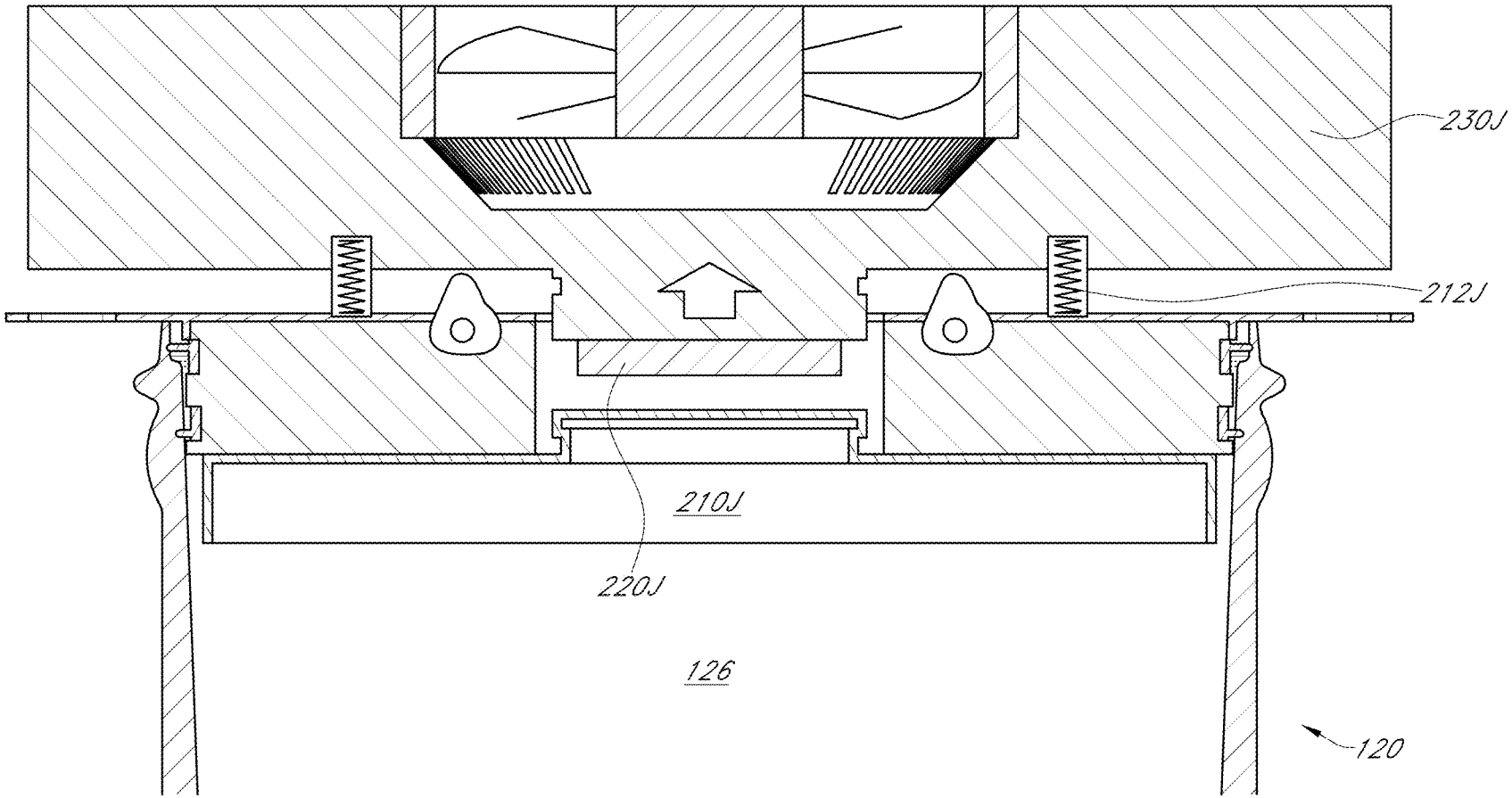

FIGS. 10A-10B schematically illustrate a container system 100J that includes the cooling system 200J. The container system 100J can include the vessel 120 (as described above). Some of the features of the cooling system 200J are similar to features in the cooling system 200I in FIGS. 9A-9B. Thus, references numerals used to designate the various components of the cooling system 200J are identical to those used for identifying the corresponding components of the cooling system 200I in FIGS. 9A-9B, except that an "J" is used instead of an "I". Therefore, the structure and description for the various components of the cooling system 200I in FIGS. 9A-9B are understood to also apply to the corresponding components of the cooling system 200J in FIGS. 10A-10B, except as described below.

The cooling system 200J differs from the cooling system 200I in the location of the one or more springs 212J and the one or more cams 250J. As shown in FIGS. 10A-10B, the one or more springs 212J are disposed between the insulator member 240J and the hot side heat sink 230J and exert a bias force between the two biasing the hot side heat sink 230J down toward contact with the insulator member 240J. Such bias force also biases the TEC 220J (which is attached to or in contact with the hot side heat sink 230J) into contact with the cold side heat sink 210J.

When the one or more rotatable cams 250J are in a retracted state (see FIG. 10A), the cams 250J allow the TEC 220J to contact the cold side heat sink 210J. The TEC 220J can be operated to draw heat out of the chamber 126 via the cold side heat sink 210J, which is then transferred via the TEC 220J to the hot side heat sink 230J. Optionally, the fan 280J can be operated to dissipate heat from the hot side heat sink 230J, allowing the hot side heat sink 230J to draw additional heat from the chamber 126 via the contact between the cold side heat sink 210J, the TEC 220J and the hot side heat sink 230J. Accordingly, with the one or more rotatable cams 250J in a retracted state, the cooling system 200J can be operated to draw heat from the chamber 126 to cool the chamber to a predetermined temperature or temperature range.

When the one or more rotatable cams 250J are moved to the deployed state (see FIG. 10B), the cams 250J bear against the hot side heat sink 230J, overcoming the bias force of the springs 212J. In the deployed state, the one or more cams 250J exert a force on the hot side heat sink 230J that causes the hot side heat sink 230J to separate from (e.g., lift from) the insulator member 240J. Such separation also causes the TEC 220J (attached to the hot side heat sink 230J) to become spaced apart from (e.g., lift from) the cold side heat sink 210J, thereby thermally disconnecting (e.g., inhibiting heat transfer between) the cold side heat sink 210J and the TEC 220J. Accordingly, once the predetermined temperature or temperature range has been achieved in the chamber 126, the one or more rotatable cams 250J can be moved to the deployed state to thermally disconnect the cold side heat sink 210J from the TEC 220J to thereby maintain the chamber 126 in a prolonged cooled state.

Figure 11A:
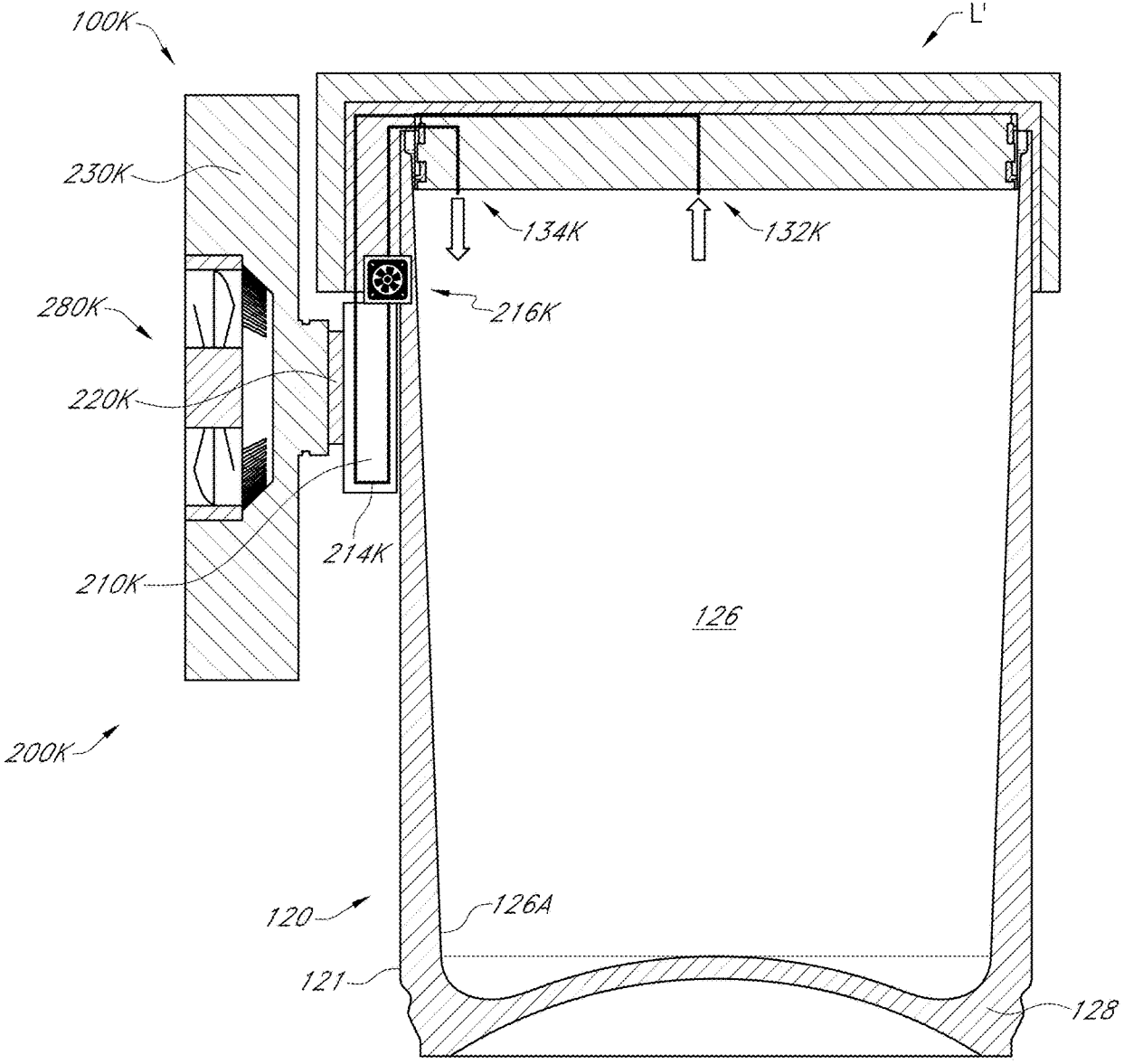
FIG. 11A is a schematic view of another embodiment of a cooler container.

FIG. 11A schematically illustrates a container system 100K that includes the cooling system 200K. The container system 100K can include the vessel 120 (as described above) removably sealed by a lid L'. Some of the features of the cooling system 200K are similar to features in the cooling system 200 in FIGS. 1A-1D. Thus, reference numerals used to designate the various components of the cooling system 200K are similar to those used for identifying the corresponding components of the cooling system 200 in FIGS. 1A-1D, except that an "K" is used. Therefore, the structure and description for said similar components of the cooling system 200 in FIGS. 1A-1D are understood to also apply to the corresponding components of the cooling system 200K in FIG. 11, except as described below.

With reference to FIG. 11A, the vessel 120 optionally has a cavity 128 (e.g., annular cavity or chamber) between the inner wall 126A and the outer wall 121. The cavity 128 can be under vacuum, so that the vessel 120 is vacuum sealed. The lid L' that removably seals the vessel 120 is optionally also a vacuum sealed lid. The vacuum sealed vessel 120 and/or lid L' advantageously inhibits heat transfer therethrough, thereby inhibiting a passive change in temperature in the chamber 126 when the lid L' is attached to the vessel 120 (e.g., via passive loss of cooling through the wall of the vessel 120 and/or lid L').

The cooling system 200K includes a hot side heat sink 230K in thermal communication with the thermoelectric element (TEC) (e.g., Peltier element) 220K, so that the heat sink 230K can draw heat away from the TEC 220K. Optionally, a fan 280K can be in thermal communication with the hot side heat sink 230K and be selectively operable to further dissipate heat from the hot side heat sink 230K, thereby allowing the heat sink 230K to further draw heat from the TEC 230K.

The TEC 230K is in thermal communication with a cold side heat sink 210K, which is in turn in thermal communication with the chamber 126 in the vessel 120. The cold side heat sink 210K optionally includes a flow path 214K that extends from an opening 132K in the lid L' adjacent the chamber 126 to an opening 134K in the lid L' adjacent the chamber 126. In one implementation, the opening 132K is optionally located generally at a center of the lid L', as shown in FIG. 11. In one implementation, the opening 134K is optionally located in the lid L' at a location proximate the inner wall 126A of the vessel 120 when the lid L' is attached to the vessel 120. Optionally, the cold side heat sink 210K includes a fan 216K disposed along the flow path 214K between the openings 132K, 134K. As shown in FIG. 11, at least a portion of the flow path 214K is in thermal communication with the TEC 220K (e.g., with a cold side of the TEC).

In operation, air in the chamber 126 enters the flow path 214K via the opening 132K and flows through the flow path 214K so that it passes through the portion of the flow path 214K that is proximate the TEC 220K, where the TEC 220K is selectively operated to cool (e.g., reduce the temperature of) the air flow passing therein. The cooled airflow continues to flow through the flow path 214K and exits the flow path 214K at opening 134K where it enters the chamber 126. Optionally, the fan 216K is operable to draw (e.g., cause or facilitate) the flow of air through the flow path 214K.

Though FIG. 11A shows the cooling system 200 disposed on a side of the vessel 120, one of skill in the art will recognize that the cooling system 200 can be disposed in other suitable locations (e.g., on the bottom of the vessel 120, on top of the lid L', in a separate module attachable to the top of the lid L', etc.) and that such implementations are contemplated by the invention.

Figure 11B:
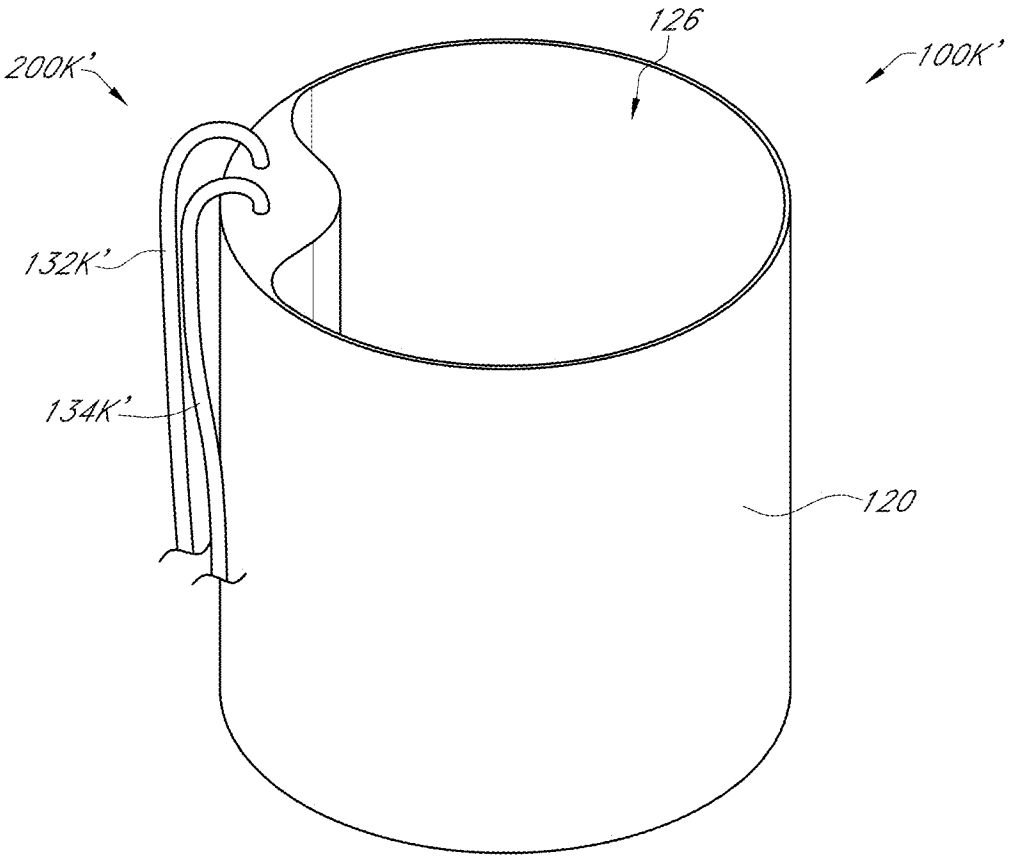
FIG. 11B is a schematic view of another embodiment of a cooler container.

FIG. 11B schematically illustrates a container system 100K' that includes the cooling system 200K'. The container system 100K' can include the vessel 120 (as described above). Some of the features of the cooling system 200K' are similar to features in the cooling system 200K in FIG. 11A. Thus, reference numerals used to designate the various components of the cooling system 200K' are similar to those used for identifying the corresponding components of the cooling system 200K in FIG. 11A, except that an "'" is used. Therefore, the structure and description for said similar components of the cooling system 200K in FIG. 11A are understood to also apply to the corresponding components of the cooling system 200K' in FIG. 11B, except as described below.

The container system 100K' is optionally a self-chilled container (e.g. self-chilled water container, such as a water bottle). The cooling system 200K' differs from the cooling system 200K in that a liquid is used as a cooling medium that is circulated through the body of the vessel 120. A conduit 134K' can deliver chilled liquid to the body of the vessel 120, and a conduit 132K' can remove a warm liquid from the body of the vessel 120. In the body of the vessel 120, the chilled liquid can absorb energy from one or more walls of the vessel 120 (e.g., one or more walls that define the chamber 126) of a liquid in the chamber 126, and the heated liquid can exit the body of the vessel 120 via conduit 132K'. In this manner, one or more surfaces of the body of the vessel 120 (e.g., of the chamber 126) are maintained in the cooled state. Though not shown, the conduits 132K', 134K' connect to a cooling system, such as one having a TEC 220K in contact with a hot side heat sink 230K, as described above for container system 100K.

Figure 12A:
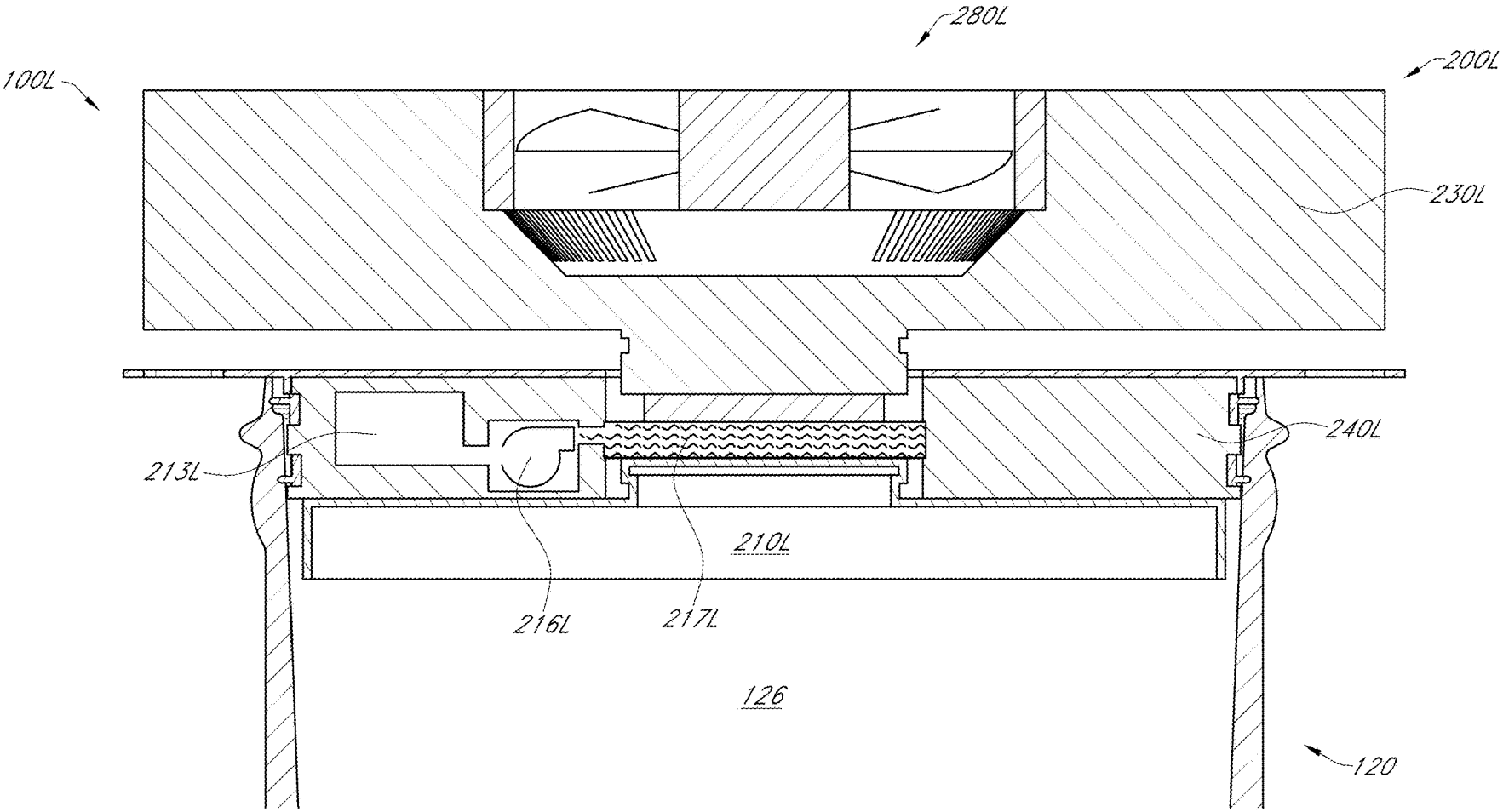
FIGS. 12A-12B are schematic partial views of another embodiment of a cooler container.
Figure 12B:
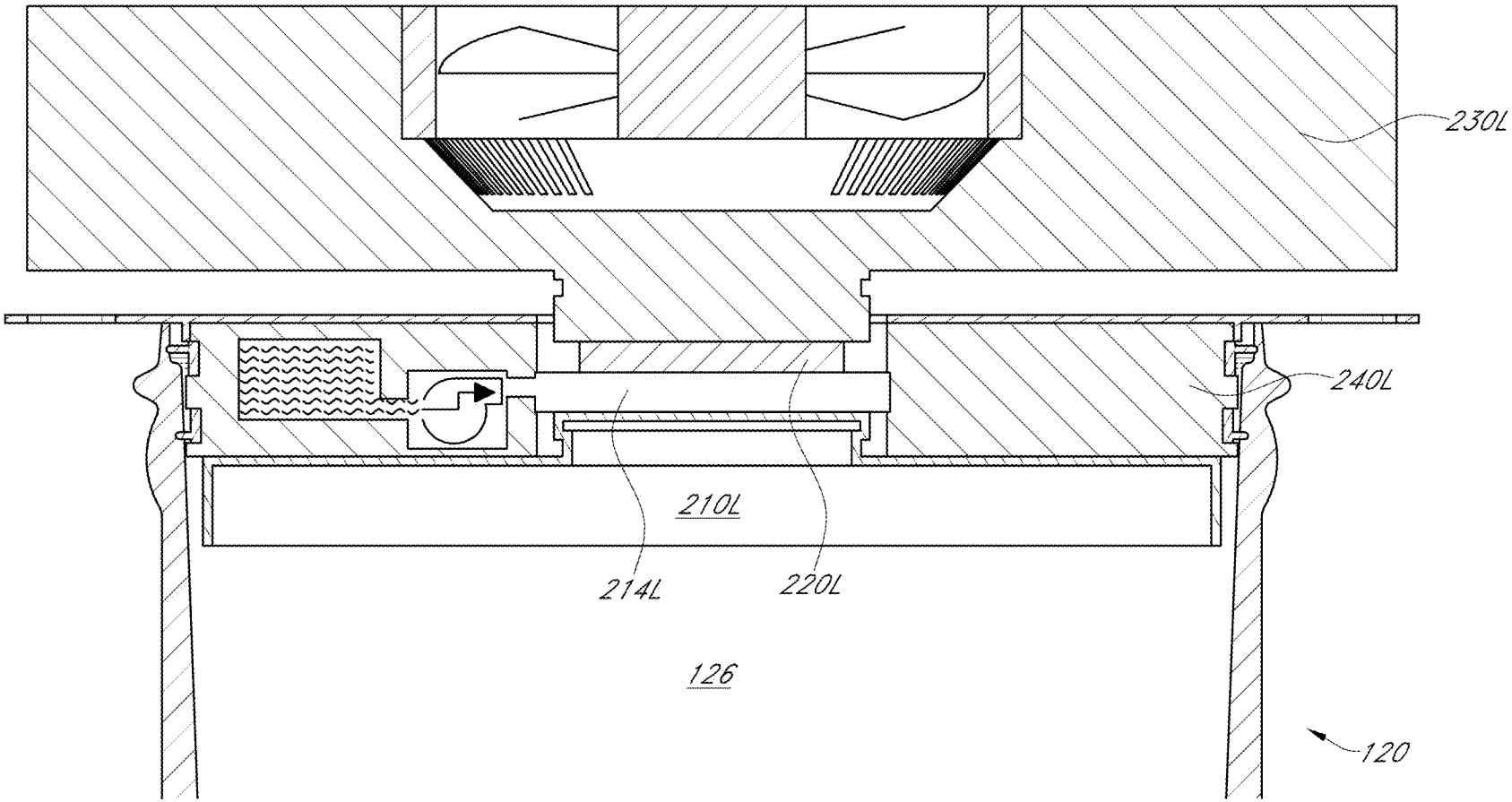

FIGS. 12A-12B schematically illustrate a container system 100L that includes the cooling system 200L. The container system 100L can include the vessel 120 (as described above). Some of the features of the cooling system 200L, which optionally serves as part of the lid L that selectively seals the vessel 120, are similar to features in the cooling system 200 in FIGS. 1A-1D. Thus, references numerals used to designate the various components of the cooling system 200L are similar to those used for identifying the corresponding components of the cooling system 200 in FIGS. 1A-1D, except that an "L" is used. Therefore, the structure and description for said similar components of the cooling system 200 in FIGS. 1A-1D are understood to also apply to the corresponding components of the cooling system 200L in FIGS. 12A-12B, except as described below.

With reference to FIGS. 12A-12B, the cooling system 200L can optionally include a cavity 214L disposed between the thermoelectric element (TEC) 220L and the cold side heat sink 210L. The cooling system 200L can optionally include a pump 216L (e.g., a peristaltic pump) in fluid communication with the cavity 214L and with a reservoir 213L. The pump 216L is operable to move a conductive fluid 217L (e.g., a conductive liquid), such as a volume of conductive fluid 217L, between the reservoir 213L and the cavity 214L. Optionally, the conductive fluid 217L can be mercury; however, the conductive fluid 217L can be other suitable liquids.

In operation, when the cooling system 200L is operated in a cooling stage, the pump 216L is selectively operable to pump the conductive fluid 217L into the cavity 214L (e.g., to fill the cavity 214L), thereby allowing heat transfer between the cold side heat sink 210L and the TEC 220L (e.g., allowing the TEC 220L to be operated to draw heat from the cold side heat sink 210L and transfer it to the hot side heat sink 230L). Optionally, the fan 280L is selectively operable to dissipate heat from the hot side heat sink 230L, thereby allowing the TEC 220L to draw further heat from the chamber 126 via the cold side heat sink 210L and the conductive fluid 217L.

With reference to FIG. 12A, when the cooling system 200L is operated in an insulating state, the pump 216L is selectively operated to remove (e.g., drain) the conductive fluid 217L from the cavity 214L (e.g., by moving the conductive fluid 217L into the reservoir 213L), thereby leaving the cavity 214L unfilled (e.g., empty). Such removal (e.g., complete removal) of the conductive fluid 217L from the cavity 214L thermally disconnects the cold side heat sink 210L from the TEC 220L, thereby inhibiting (e.g., preventing) heat transfer between the TEC 220L and the chamber 126 via the cold side heat sink 210L, which advantageously prevents heat in the hot side heat sink 230L or due to ambient temperature from flowing back to the cold side heat sink 210L, thereby prolonging the cooled state in the chamber 126.

Figure 12C:
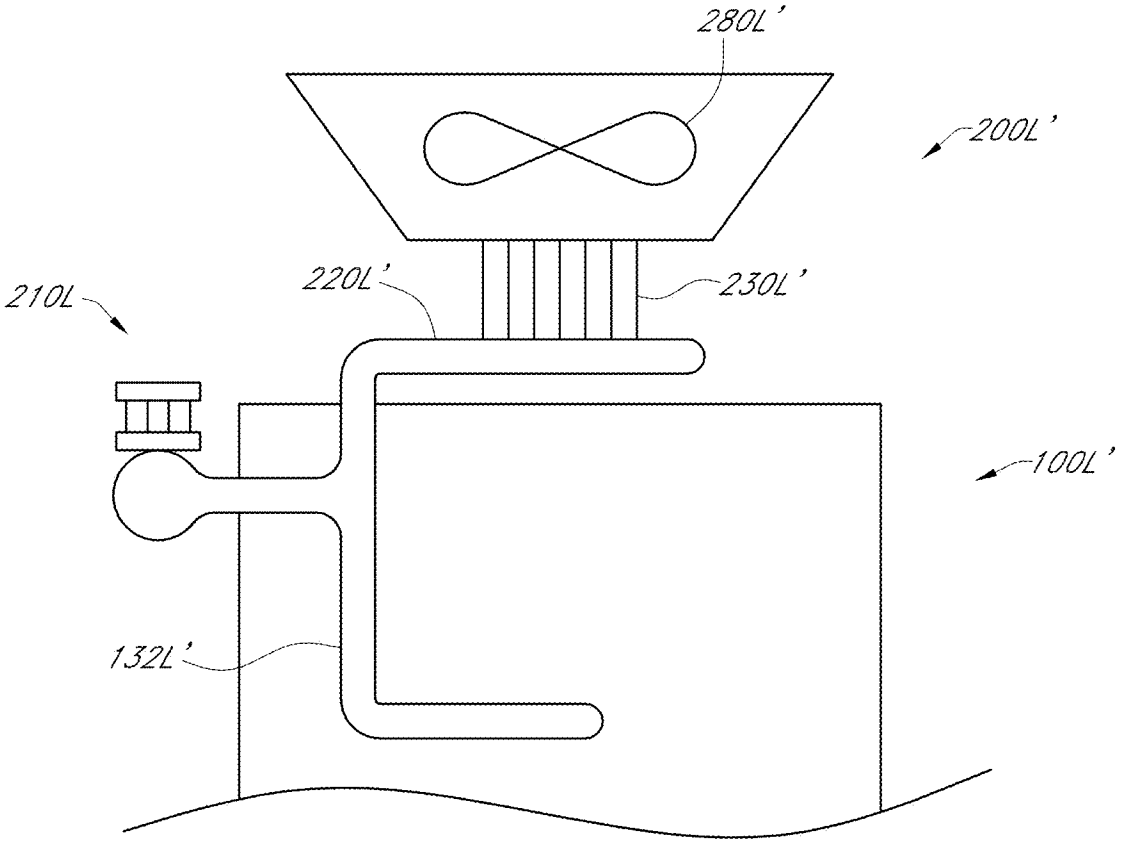
FIG. 12C is a schematic view of another embodiment of a cooler container.

FIG. 12C schematically illustrate a container system 100L' that includes the cooling system 200L'. The container system 100L' can include the vessel 120 (as described above). Some of the features of the cooling system 200L' are similar to features in the cooling system 200L in FIGS. 12A-12B. Thus, references numerals used to designate the various components of the cooling system 200L' are similar to those used for identifying the corresponding components of the cooling system 200L in FIGS. 12A-12B, except that an " ' " is used. Therefore, the structure and description for said similar components of the cooling system 200L in FIGS. 12A-12B are understood to also apply to the corresponding components of the cooling system 200L' in FIG. 12C, except as described below.

The cooling system 200L' differs from the cooling system 200L in that a heat pipe 132L' is used to connect the hot side heat sink 230L' to the cold side heat sink 210L'. The heat pipe 132L' can be selectively turned on and off. Optionally, the heat pipe 132L' can include a phase change material (PCM). Optionally, the heat pipe 132L' can be turned off by removing the working fluid from inside the heat pipe 132L', and turned on by inserting or injecting the working fluid in the heat pipe 132L'. For example, the TEC 210L, when in operation, can freeze the liquid in the heat pipe 132L', to thereby provide a thermal break within the heat pipe 132L', disconnecting the chamber of the vessel 120 from the TEC 220L' that is operated to cool the chamber. When the TEC 210L is not in operation, the liquid in the heat pipe 132L' can flow along the length of the heat pipe 132L'. For example, the fluid can flow within the heat pipe 132L' into thermal contact with a cold side of the TEC 220L', which can cool the liquid, the liquid can then flow to the hot side of the heat pipe 132L' and draw heat away from the chamber of the vessel 120 which heats such liquid, and the heated liquid can then again flow to the opposite end of the heat pipe 132L' where the TEC 220L' can again remove heat from it to cool the liquid before it again flows back to the other end of the heat pipe 132L' to draw more heat from the chamber.

Figure 13A:
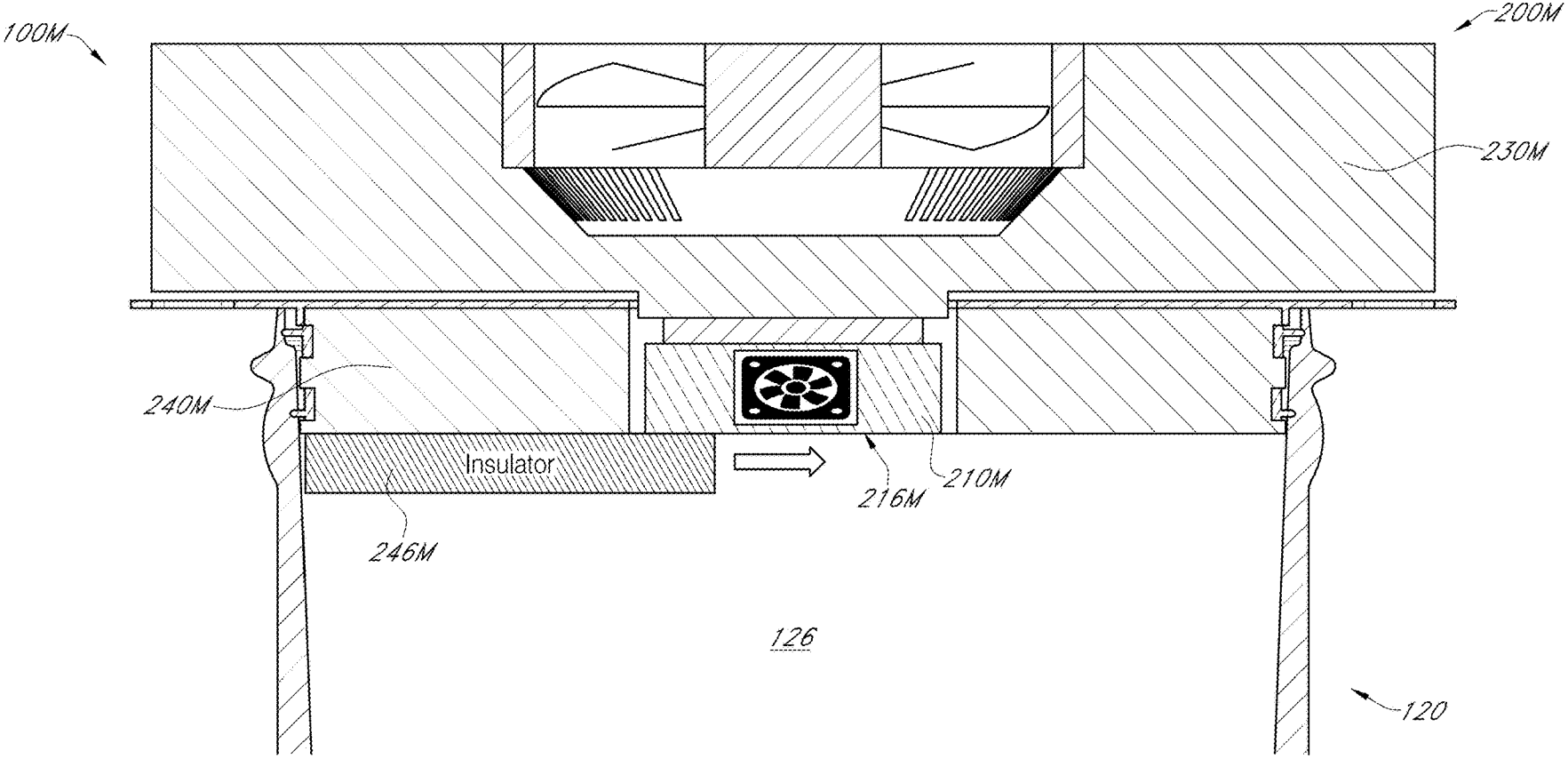
FIGS. 13A-13B are schematic partial views of another embodiment of a cooler container.
Figure 13B:
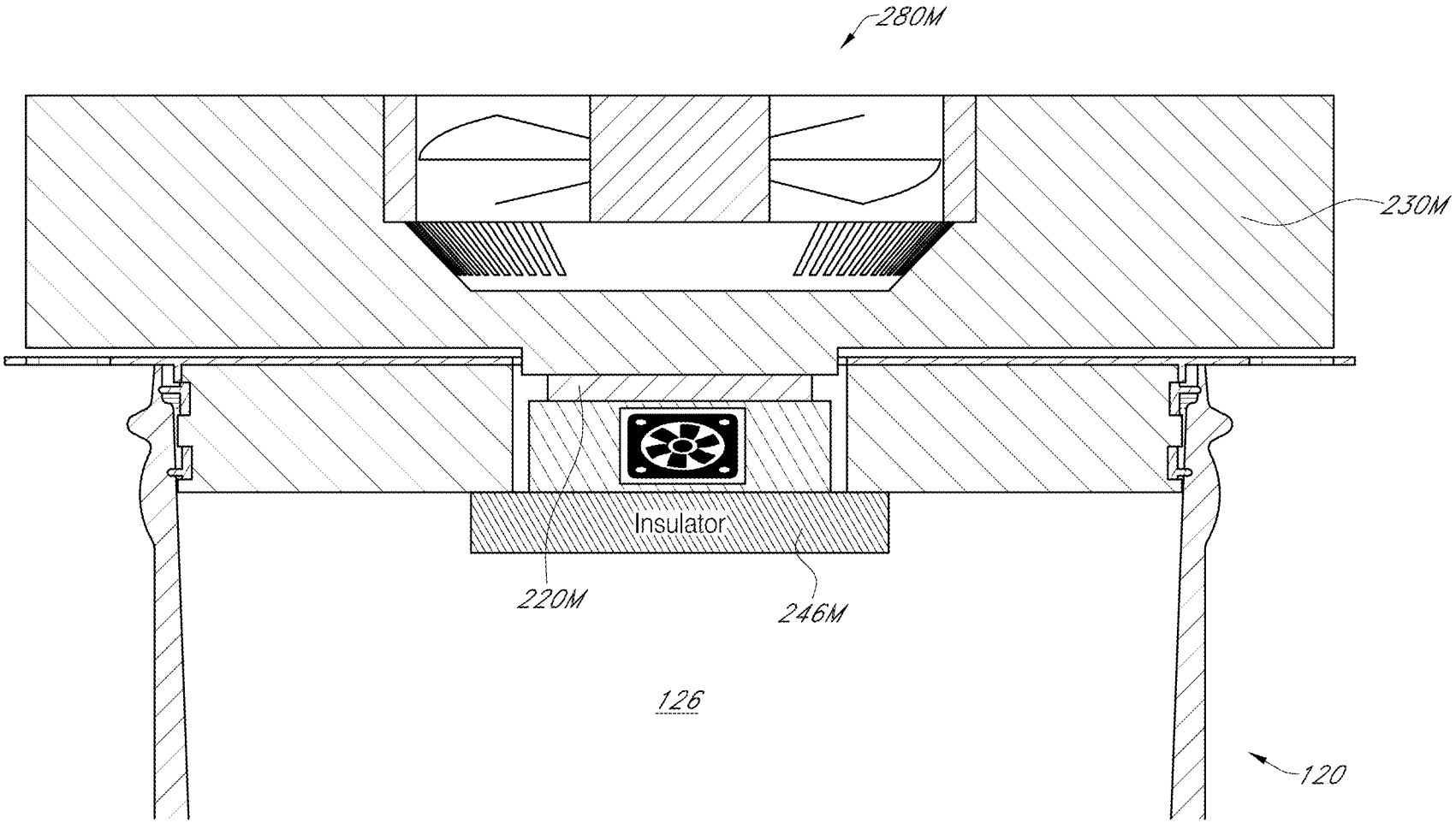

FIGS. 13A-13B schematically illustrate a container system 100M that includes the cooling system 200M. The container system 100M can include the vessel 120 (as described above). Some of the features of the cooling system 200M, which optionally serves as part of the lid L that selectively seals the vessel 120, are similar to features in the cooling system 200 in FIGS. 1A-1D. Thus, references numerals used to designate the various components of the cooling system 200M are similar to those used for identifying the corresponding components of the cooling system 200 in FIGS. 1A-1D, except that an "M" is used. Therefore, the structure and description for said similar components of the cooling system 200 in FIGS. 1A-1D are understood to also apply to the corresponding components of the cooling system 200M in FIGS. 13A-13B, except as described below.

With reference to FIGS. 13A-13B, the cooling system 200M can include a cold side heat sink 210M in thermal communication with a thermoelectric element (TEC) 220M and can selectively be in thermal communication with the chamber 126 of the vessel. Optionally, the cooling system 200 can include a fan 216M selectively operable to draw air from the chamber 126 into contact with the cold side heat sink 210M. Optionally, cooling system 200M can include an insulator member 246M selectively movable (e.g., slidable) between one or more positions. As shown in FIGS. 13A-13B, the insulator member 246M can be disposed adjacent or in communication with the chamber 126.

With reference to FIG. 13A, when the cooling system 200M is operated in a cooling state, the insulator member 246M is disposed at least partially apart (e.g., laterally apart) relative to the cold side heat sink 210M and fan 216M. The TEC 220M is selectively operated to draw heat from the cold side heat sink 210M and transfer it to the hot side heat sink 230M. Optionally, a fan 280M is selectively operable to dissipate heat from the hot side heat sink 230M, thereby allowing the TEC 220M to draw further heat from the chamber 126 via the cold side heat sink 210M.

With reference to FIG. 13B, when the cooling system 200M is operated in an insulating stage, the insulator member 246M is moved (e.g., slid) into a position adjacent to the cold side heat sink 210M so as to be disposed between the cold side heat sink 210M and the chamber 126, thereby blocking air flow to the cold side heat sink 210M (e.g., thermally disconnecting the cold side heat sink 210M from the chamber 126) to thereby inhibit heat transfer to and from the chamber 126 (e.g., to maintain the chamber 126 in an insulated state).

The insulator member 246M can be moved between the position in the cooling state (see FIG. 13A) and the position in the insulating stage (see FIG. 13B) using any suitable mechanism (e.g., electric motor, solenoid motor, a pneumatic or electromechanical system actuating a piston attached to the insulator member 246M, etc.). Though the insulator member 246M is shown in FIGS. 13A-13B as sliding between said positions, in another implementation, the insulator member 246M can rotate between the cooling stage position and the insulating stage position.

Figure 14A:
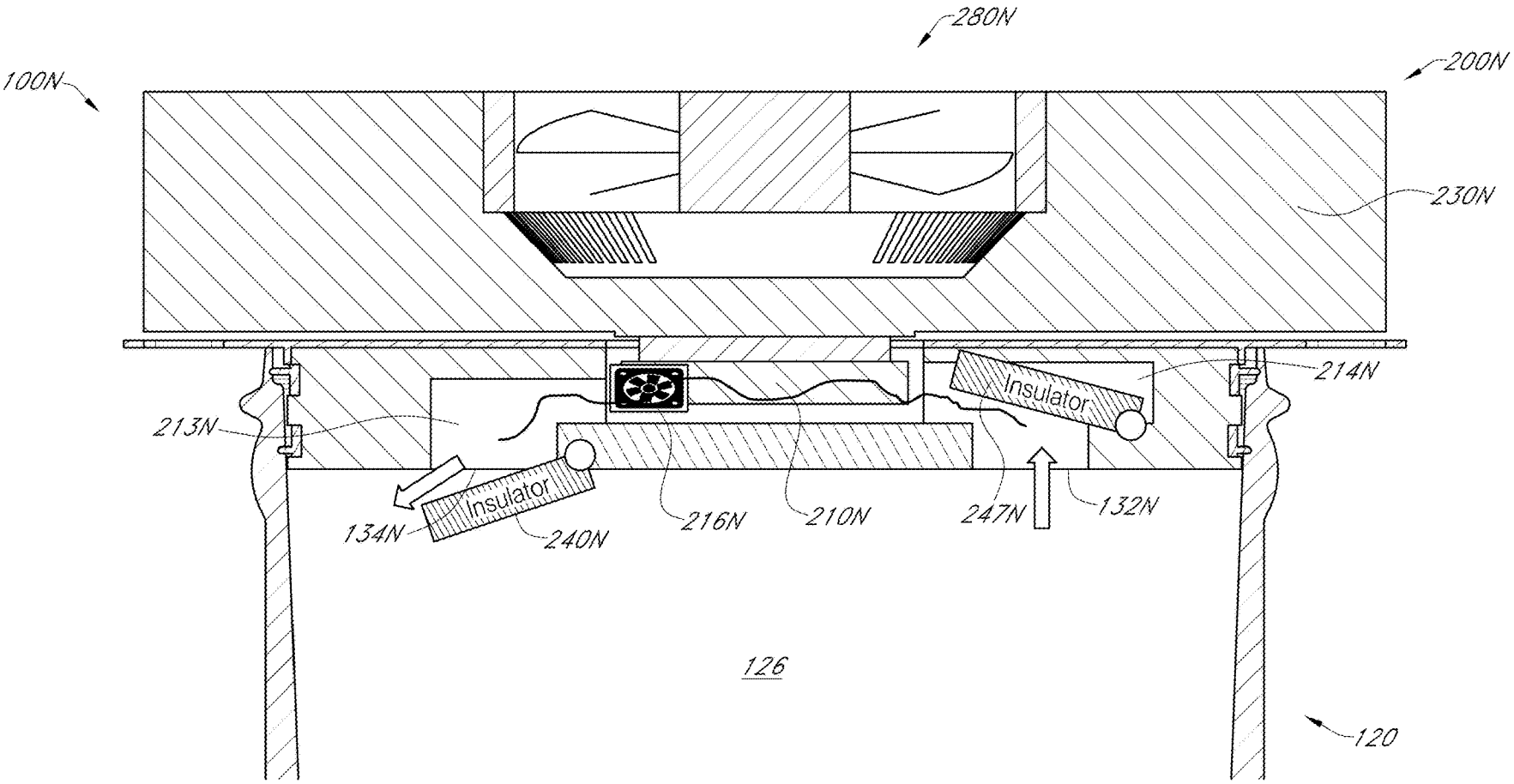
FIGS. 14A-14B are schematic partial views of another embodiment of a cooler container.
Figure 14B:
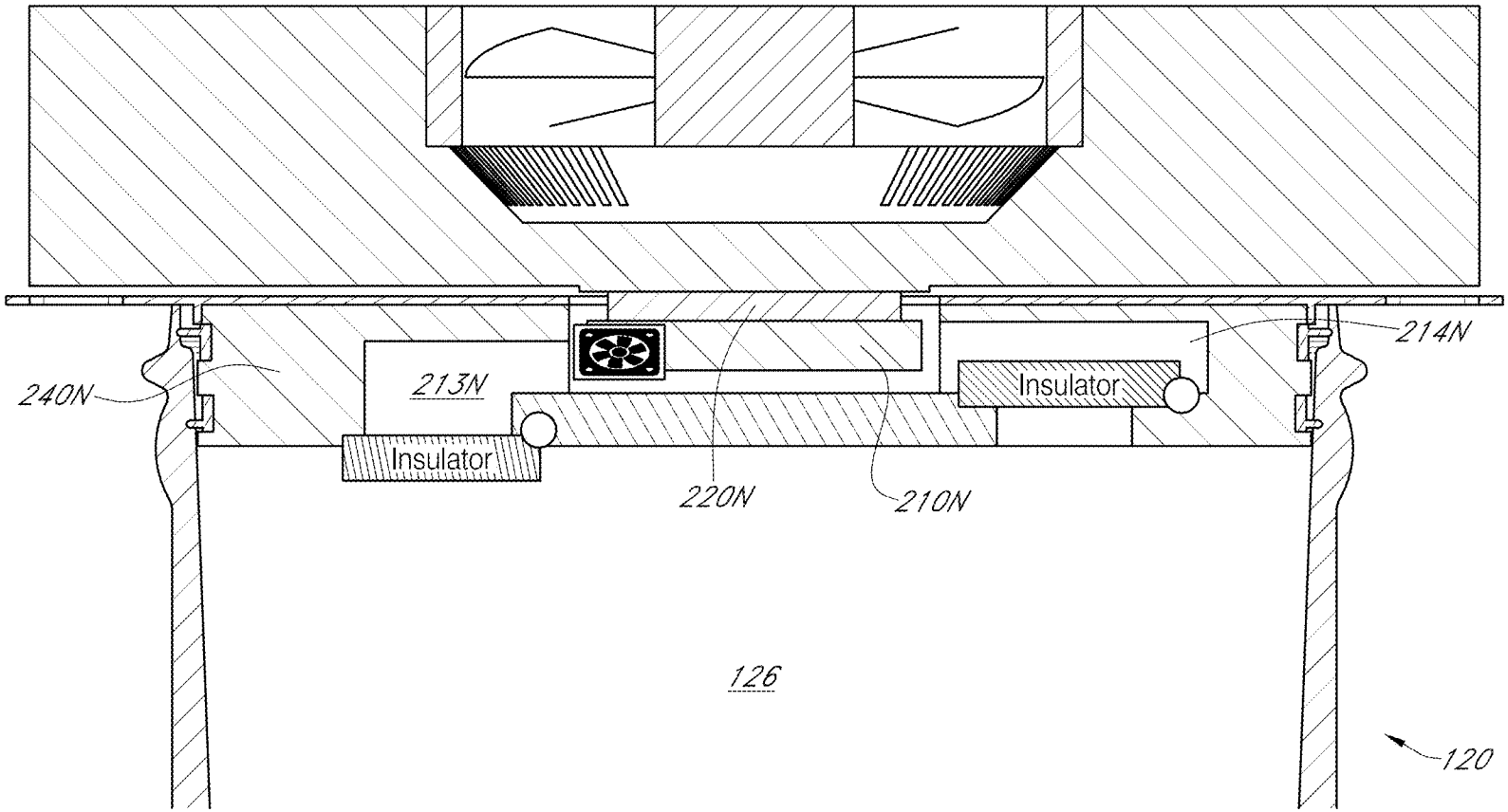

FIGS. 14A-14B schematically illustrate a container system 100N that includes the cooling system 200N. The container system 100N can include the vessel 120 (as described above). Some of the features of the cooling system 200N, which optionally serves as part of the lid L that selectively seals the vessel 120, are similar to features in the cooling system 200M in FIGS. 13A-13B. Thus, references numerals used to designate the various components of the cooling system 200N are similar to those used for identifying the corresponding components of the cooling system 200M in FIGS. 13A-13B, except that an "N" is used. Therefore, the structure and description for said similar components of the cooling system 200M in FIGS. 13A-13B are understood to also apply to the corresponding components of the cooling system 200N in FIGS. 14A-14B, except as described below.

With reference to FIGS. 14A-14B, the cooling system 200N can include a cold side heat sink 210N in thermal communication with a thermoelectric element (TEC) 220N and can selectively be in thermal communication with the chamber 126 of the vessel 120. Optionally, the cooling system 200N can include a fan 216N selectively operable to draw air from the chamber 126 into contact with the cold side heat sink 210N via openings 132N, 134N and cavities or chambers 213N, 214N. Optionally, cooling system 200N can include insulator members 246N, 247N selectively movable (e.g., pivotable) between one or more positions relative to the openings 134N, 132N, respectively. As shown in FIGS. 14A-14B, the insulator member 246N can be disposed adjacent or in communication with the chamber 126 and be movable to selectively allow and disallow airflow through the opening 134N, and the insulator member 247N can be disposed in the chamber 214N and be movable to selectively allow and disallow airflow through the opening 132N.

With reference to FIG. 14A, when the cooling system 200N is operated in a cooling state, the insulator members 246N, 247N are disposed at least partially apart from the openings 134N, 132N, respectively, allowing air flow from the chamber 126 through the openings 132N, 134N and cavities 213N, 214N. Optionally, the fan 216N can be operated to draw said airflow from the chamber 126, through the opening 132N into the chamber 214N and over the cold side heat sink 210N, then through the chamber 213N and opening 134N and back to the chamber 126. The TEC 220N is selectively operated to draw heat from the cold side heat sink 210N and transfer it to the hot side heat sink 230N. Optionally, a fan 280N is selectively operable to dissipate heat from the hot side heat sink 230N, thereby allowing the TEC 220N to draw further heat from the chamber 126 via the cold side heat sink 210N.

With reference to FIG. 14B, when the cooling system 200N is operated in an insulating stage, the insulator members 246N, 247N are moved (e.g., pivoted) into a position adjacent to the openings 134N, 132N, respectively to close said openings, thereby blocking air flow to the cold side heat sink 210N (e.g., thermally disconnecting the cold side heat sink 210N from the chamber 126) to thereby inhibit heat transfer to and from the chamber 126 (e.g., to maintain the chamber 126 in an insulated state).

The insulator members 246N, 247N can be moved between the position in the cooling state (see FIG. 14A) and the position in the insulating stage (see FIG. 14B) using any suitable mechanism (e.g., electric motor, solenoid motor, etc.). Optionally, the insulator members 246N, 247N are spring loaded into the closed position (e.g., adjacent the openings 134N, 132N), such that the insulator members 246N, 247N are pivoted to the open position (see FIG. 14A) automatically with an increase in air pressure generated by the operation of the fan 216N. Though the insulator members 246N, 247N are shown in FIGS. 14A-14B as pivoting between said positions, in another implementation, the insulator members 246N, 247N can slide or translate between the cooling stage position and the insulating stage position.

Figure 15A:
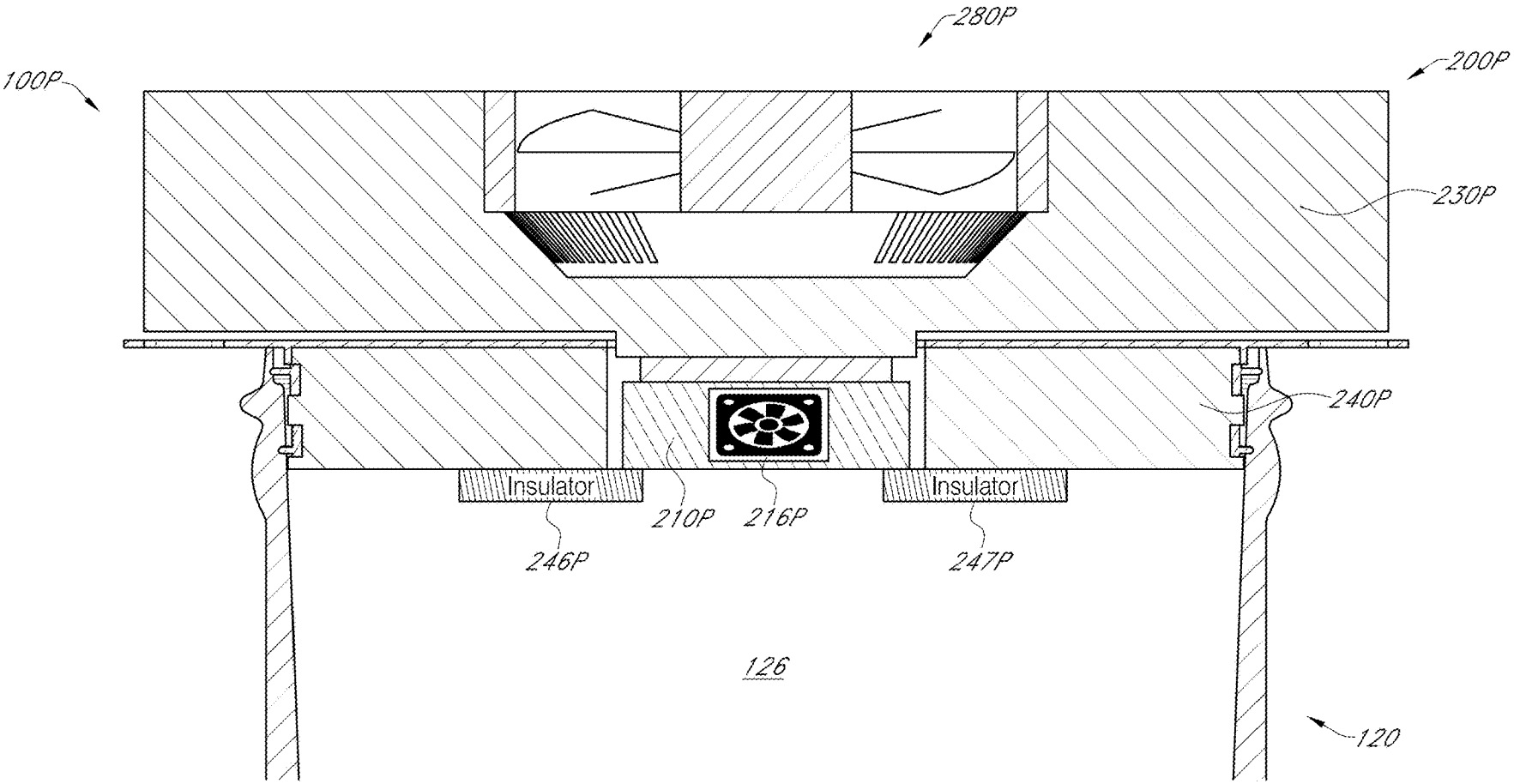
FIGS. 15A-15B are schematic partial views of another embodiment of a cooler container.
Figure 15B:
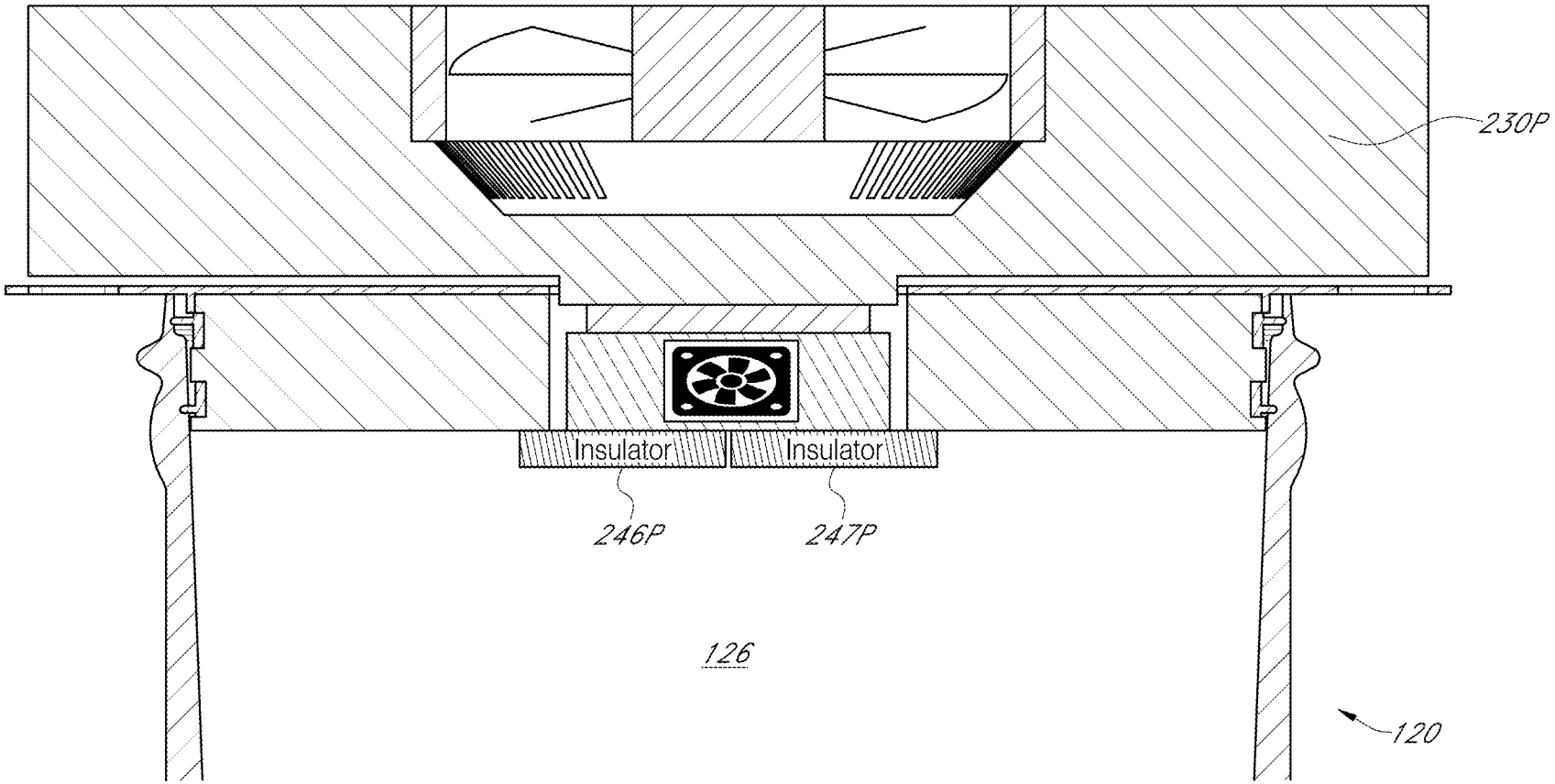

FIGS. 15A-15B schematically illustrate a container system 100P that includes the cooling system 200P. The container system 100P can include the vessel 120 (as described above). Some of the features of the cooling system 200P, which optionally serves as part of the lid L that selectively seals the vessel 120, are similar to features in the cooling system 200M in FIGS. 13A-13B. Thus, references numerals used to designate the various components of the cooling system 200P are similar to those used for identifying the corresponding components of the cooling system 200M in FIGS. 13A-13B, except that an "P" is used. Therefore, the structure and description for said similar components of the cooling system 200M in FIGS. 13A-13B are understood to also apply to the corresponding components of the cooling system 200P in FIGS. 15A-15B, except as described below.

With reference to FIGS. 15A-15B, the cooling system 200P can include a cold side heat sink 210P in thermal communication with a thermoelectric element (TEC) 220P and can selectively be in thermal communication with the chamber 126 of the vessel 120. Optionally, the cooling system 200P can include a fan 216P selectively operable to draw air from the chamber 126 into contact with the cold side heat sink 210P. Optionally, cooling system 200P can include insulator members 246P, 247P selectively movable (e.g., slidable) between one or more positions relative to the cold side heat sink 210P.

With reference to FIG. 15A, when the cooling system 200P is operated in a cooling state, the insulator members 246P, 247P are disposed at least partially apart from the cold side heat sink 210P, allowing air flow from the chamber 126 to contact (e.g., be cooled by) the cold side heat sink 210P. Optionally, the fan 216P can be operated to draw said airflow from the chamber 126 and over the cold side heat sink 210P. The TEC 220P is selectively operated to draw heat from the cold side heat sink 210P and transfer it to the hot side heat sink 230P. Optionally, a fan 280P is selectively operable to dissipate heat from the hot side heat sink 230P, thereby allowing the TEC 220P to draw further heat from the chamber 126 via the cold side heat sink 210P.

With reference to FIG. 15B, when the cooling system 200P is operated in an insulating stage, the insulator members 246P, 247P are moved (e.g., slid) into a position between the cold side heat sink 210P and the chamber 126, thereby blocking air flow to the cold side heat sink 210P (e.g., thermally disconnecting the cold side heat sink 210P from the chamber 126) to thereby inhibit heat transfer to and from the chamber 126 (e.g., to maintain the chamber 126 in an insulated state).

The insulator members 246P, 247P can be moved between the position in the cooling state (see FIG. 15A) and the position in the insulating stage (see FIG. 15B) using any suitable mechanism (e.g., electric motor, solenoid motor, etc.). Though the insulator members 246P, 247P are shown in FIGS. 15A-15B as sliding between said positions, in another implementation, the insulator members 246P, 247P can pivot between the cooling stage position and the insulating stage position.

Figure 16A:
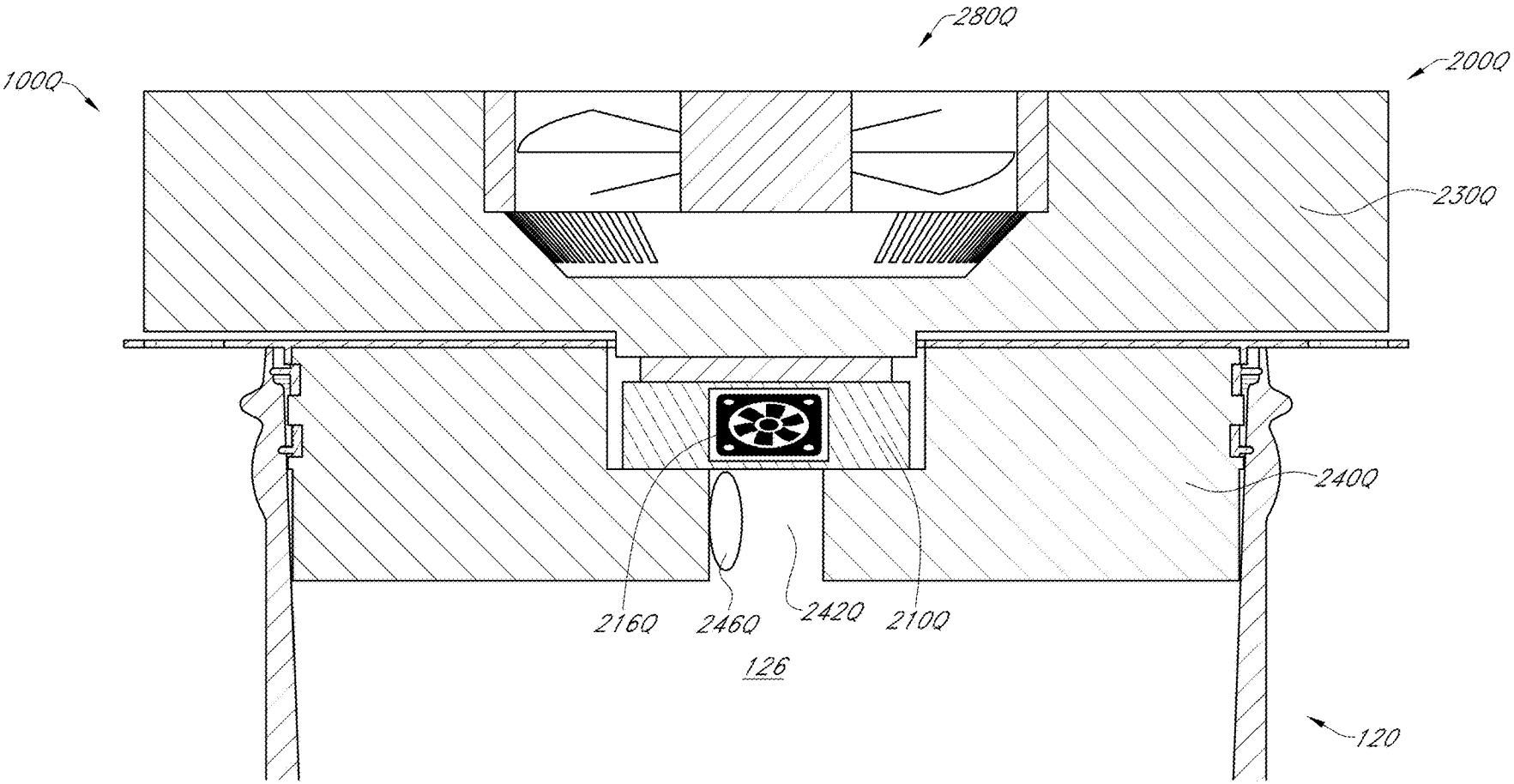
FIGS. 16A-16B are schematic partial views of another embodiment of a cooler container.
Figure 16B:
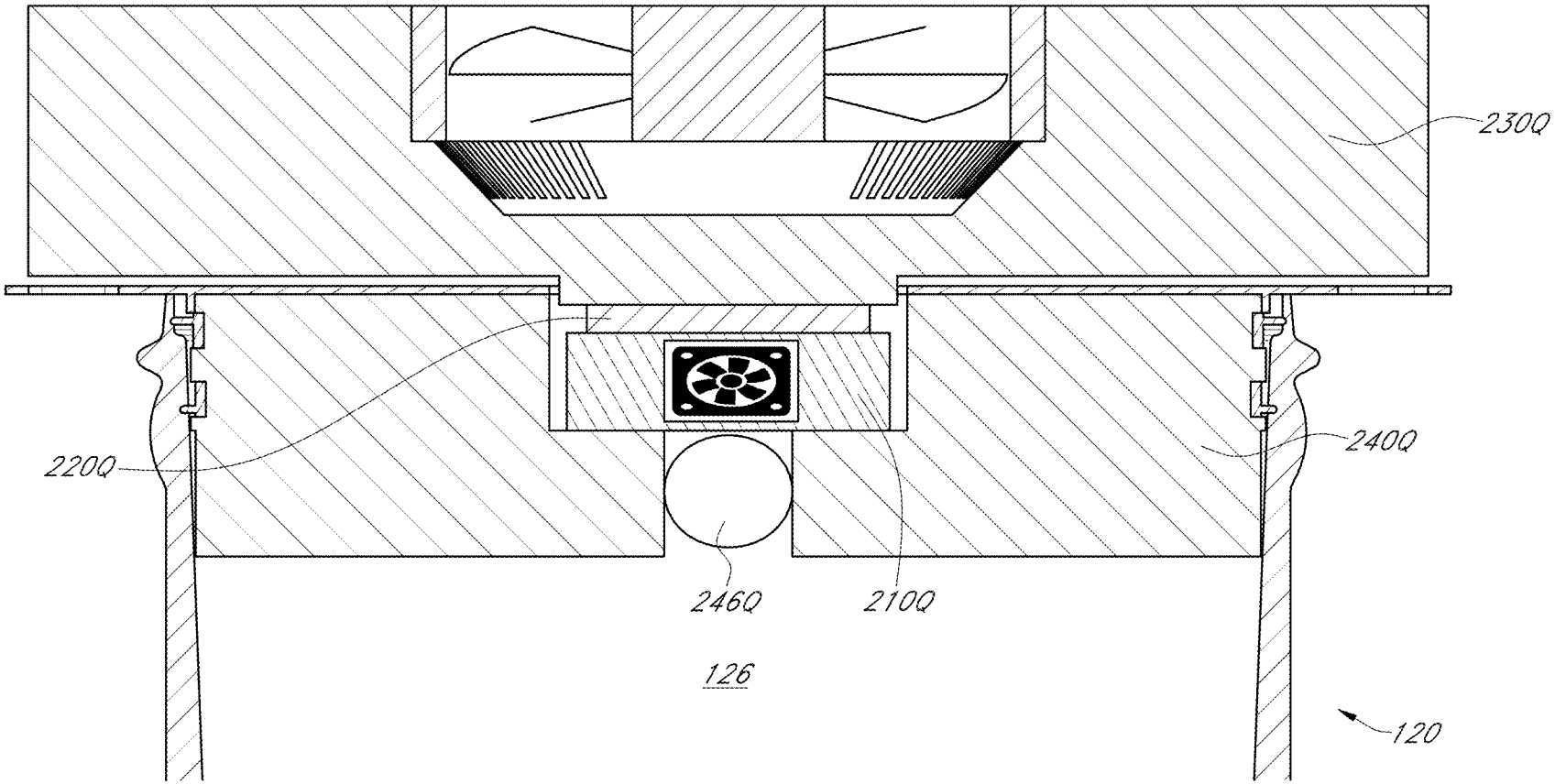

FIGS. 16A-16B schematically illustrate a container system 100Q that includes the cooling system 200Q. The container system 100Q can include the vessel 120 (as described above). Some of the features of the cooling system 200Q, which optionally serves as part of the lid L that selectively seals the vessel 120, are similar to features in the cooling system 200M in FIGS. 13A-13B. Thus, references numerals used to designate the various components of the cooling system 200Q are similar to those used for identifying the corresponding components of the cooling system 200M in FIGS. 13A-13B, except that an "Q" is used. Therefore, the structure and description for said similar components of the cooling system 200M in FIGS. 13A-13B are understood to also apply to the corresponding components of the cooling system 200Q in FIGS. 16A-16B, except as described below.

With reference to FIGS. 16A-16B, the cooling system 200Q can include a cold side heat sink 210Q in thermal communication with a thermoelectric element (TEC) 220Q and can selectively be in thermal communication with the chamber 126 of the vessel 120. Optionally, the cooling system 200Q can include a fan 216Q selectively operable to draw air from the chamber 126 into contact with the cold side heat sink 210Q. Optionally, the cooling system 200Q can include an expandable members 246Q selectively movable between A deflated state and an expanded state relative to the cold side heat sink 210P.

With reference to FIG. 16A, when the cooling system 200Q is operated in a cooling state, the expandable member 246Q is in the deflated state, allowing air flow from the chamber 126 to contact (e.g., be cooled by) the cold side heat sink 210Q. Optionally, the fan 216Q can be operated to draw said airflow from the chamber 126 and over the cold side heat sink 210Q. The TEC 220Q is selectively operated to draw heat from the cold side heat sink 210Q and transfer it to the hot side heat sink 230Q. Optionally, a fan 280Q is selectively operable to dissipate heat from the hot side heat sink 230Q, thereby allowing the TEC 220Q to draw further heat from the chamber 126 via the cold side heat sink 210Q.

With reference to FIG. 16B, when the cooling system 200Q is operated in an insulating stage, the expandable member 246Q is moved into the expanded state so that the expandable member 246Q is between the cold side heat sink 210Q and the chamber 126, thereby blocking air flow to the cold side heat sink 210Q (e.g., thermally disconnecting the cold side heat sink 210Q from the chamber 126) to thereby inhibit heat transfer to and from the chamber 126 (e.g., to maintain the chamber 126 in an insulated state).

The expandable member 246Q is optionally disposed or house in a cavity or chamber 242Q defined in the insulator member 240Q. Optionally, the expandable member 246Q is part of a pneumatic system and filled with a gas (e.g., air) to move it into the expanded state. In another implementation, the expandable member 246Q is part of a hydraulic system and filled with a liquid (e.g., water) to move it into the expanded state.

Figure 17A:
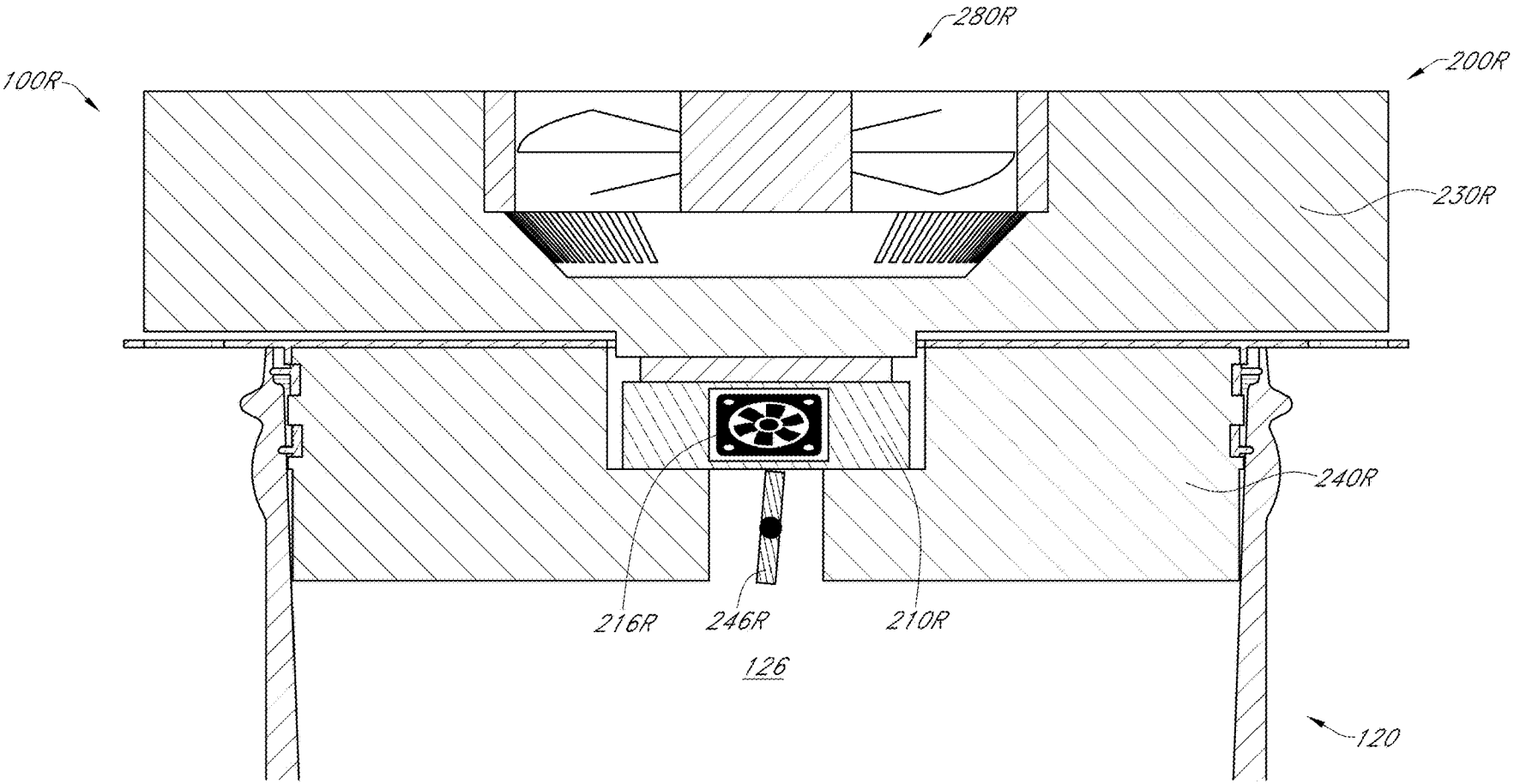
FIGS. 17A-17B are schematic partial views of another embodiment of a cooler container.
Figure 17B:
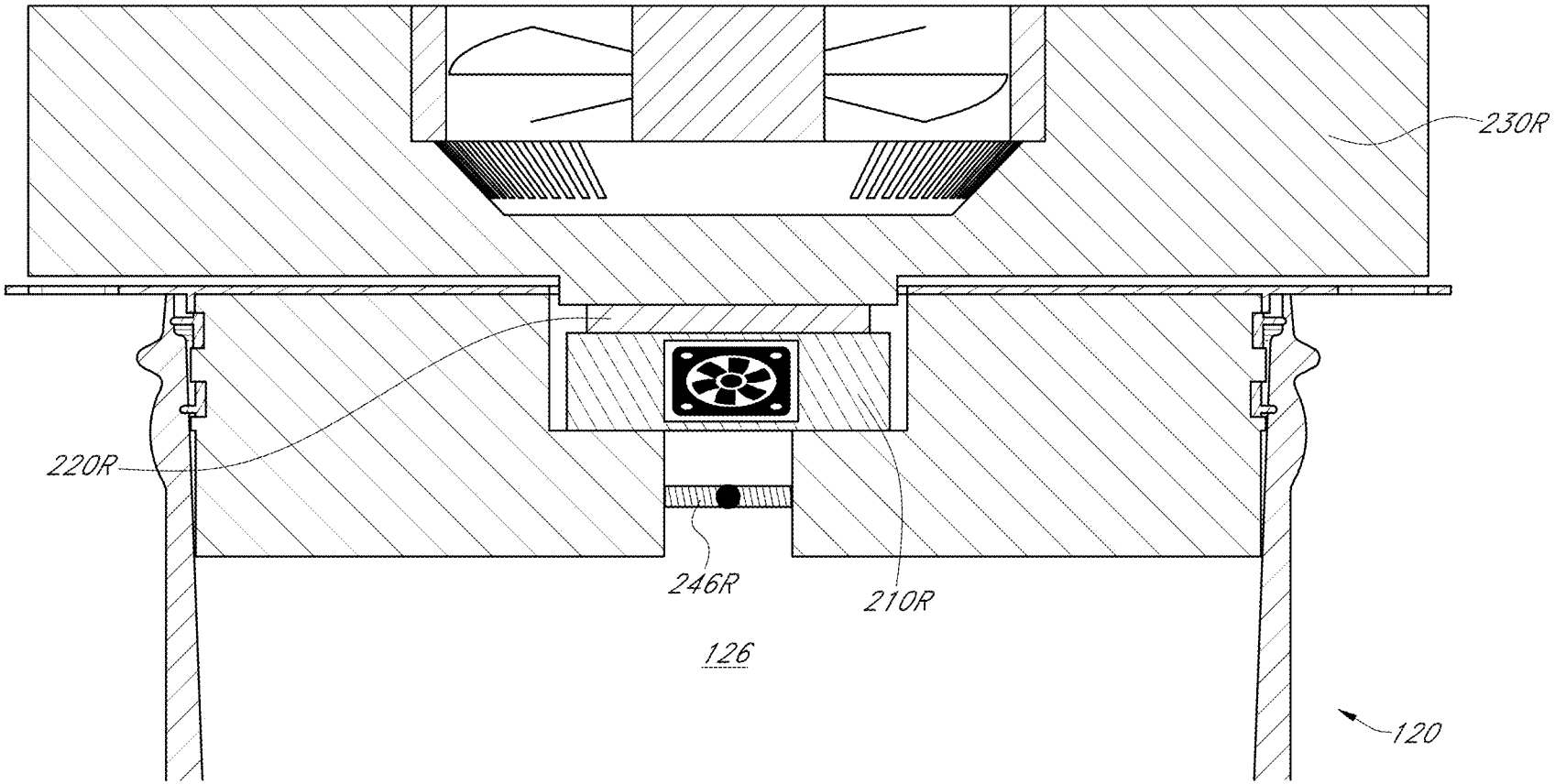

FIGS. 17A-17B schematically illustrate a container system 100R that includes the cooling system 200R. The container system 100R can include the vessel 120 (as described above). Some of the features of the cooling system 200R, which optionally serves as part of the lid L that selectively seals the vessel 120, are similar to features in the cooling system 200M in FIGS. 13A-13B. Thus, references numerals used to designate the various components of the cooling system 200R are similar to those used for identifying the corresponding components of the cooling system 200M in FIGS. 13A-13B, except that an "R" is used. Therefore, the structure and description for said similar components of the cooling system 200M in FIGS. 13A-13B are understood to also apply to the corresponding components of the cooling system 200R in FIGS. 17A-17B, except as described below.

With reference to FIGS. 17A-17B, the cooling system 200R can include a cold side heat sink 210R in thermal communication with a thermoelectric element (TEC) 220R and can selectively be in thermal communication with the chamber 126 of the vessel. Optionally, the cooling system 200 can include a fan 216R selectively operable to draw air from the chamber 126 into contact with the cold side heat sink 210R. Optionally, cooling system 200R can include an insulator element 246R selectively movable (e.g., pivotable) between one or more positions. As shown in FIGS. 17A-17B, the insulator element 246R can be disposed in a cavity or chamber 242R defined in the insulator member 240R.

With reference to FIG. 17A, when the cooling system 200R is operated in a cooling state, the insulator element 246R is disposed relative to the cold side heat sink 210R so as to allow air flow through the chamber 242R from the chamber 126 to the cold side heat sink 210R. Optionally, the fan 216R is selectively operated to draw air from the chamber 126 into contact with the cold side heat sink 210R (e.g., to cool said air flow and return it to the chamber 126). The TEC 220R is selectively operated to draw heat from the cold side heat sink 210R and transfer it to the hot side heat sink 230R. Optionally, a fan 280R is selectively operable to dissipate heat from the hot side heat sink 230R, thereby allowing the TEC 220R to draw further heat from the chamber 126 via the cold side heat sink 210R.

With reference to FIG. 17B, when the cooling system 200R is operated in an insulating stage, the insulator element 246R is moved (e.g., rotated, pivoted) into a position relative to the cold side heat sink 210P so as to close off the chamber 242R, thereby blocking air flow from the chamber 126 to the cold side heat sink 210R (e.g., thermally disconnecting the cold side heat sink 210R from the chamber 126) to thereby inhibit heat transfer to and from the chamber 126 (e.g., to maintain the chamber 126 in an insulated state).

The insulator element 246R can be moved between the position in the cooling state (see FIG. 17A) and the position in the insulating stage (see FIG. 17B) using any suitable mechanism (e.g., electric motor, solenoid motor, etc.).

Figure 18A:
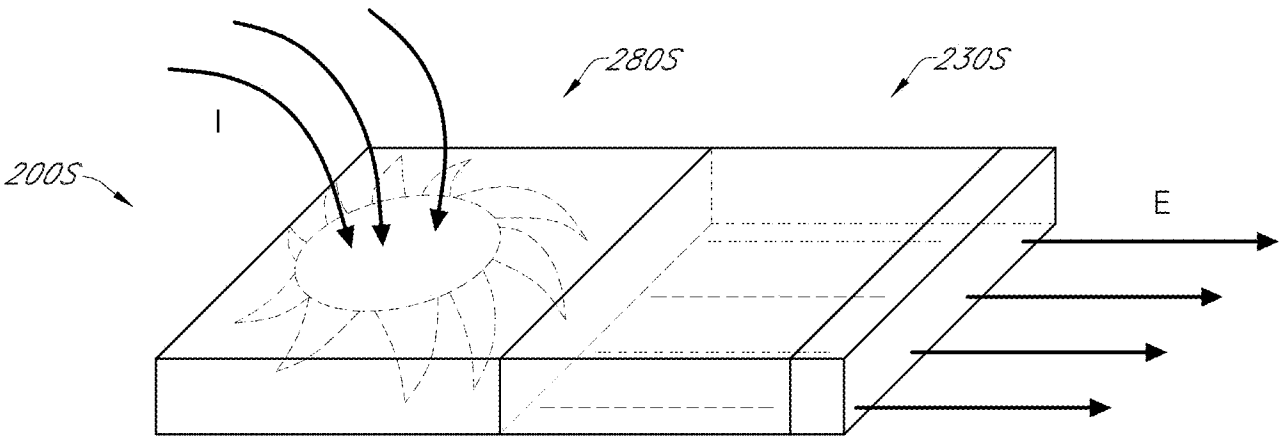
FIG. 18A is a schematic view of a portion of another embodiment of a cooler container.

FIG. 18A is a schematic view of a portion of a cooling system 200S. The cooling system 200S is similar to the cooling systems disclosed herein, such as cooling systems 200-200X, except as described below.

As shown in FIG. 18A, in the cooling system 200S, the fan 280S has air intake I that is generally vertical and air exhaust E that is generally horizontal, so that the air flows generally horizontally over one or more heat sink surfaces, such as surfaces of the hot side heat sink 230S.

Figure 18B:
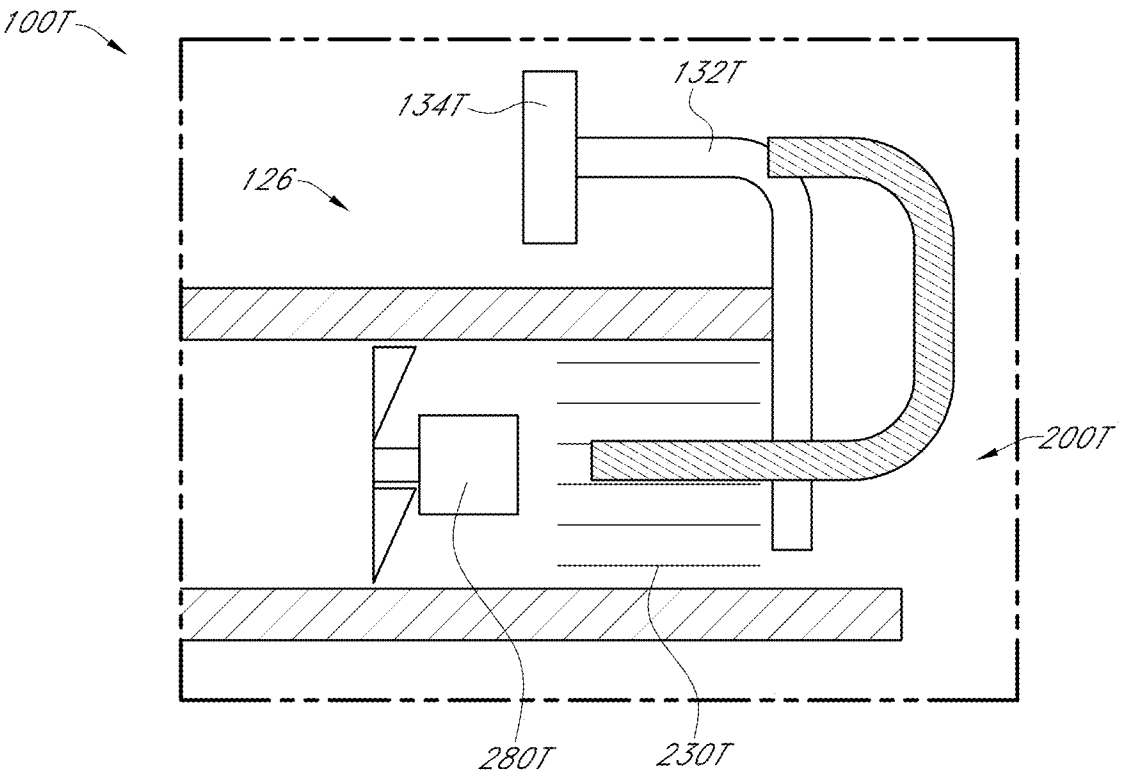
FIG. 18B is a schematic view of a portion of another embodiment of a cooler container.

FIG. 18B is a schematic view of a portion of a cooling system 200T. The cooling system 200T in a cylindrical container 100T has a fan 280T that optionally blows air over a heat sink 230T. Optionally, the cooling system 200T has a heat pipe 132T in thermal communication with another portion of the container 100T via end portion 134T of heat pipe 132T, allowing the fan 280T and heat sink 230T to remove heat from said portions via the heat pipe 132T.

Figure 18C:
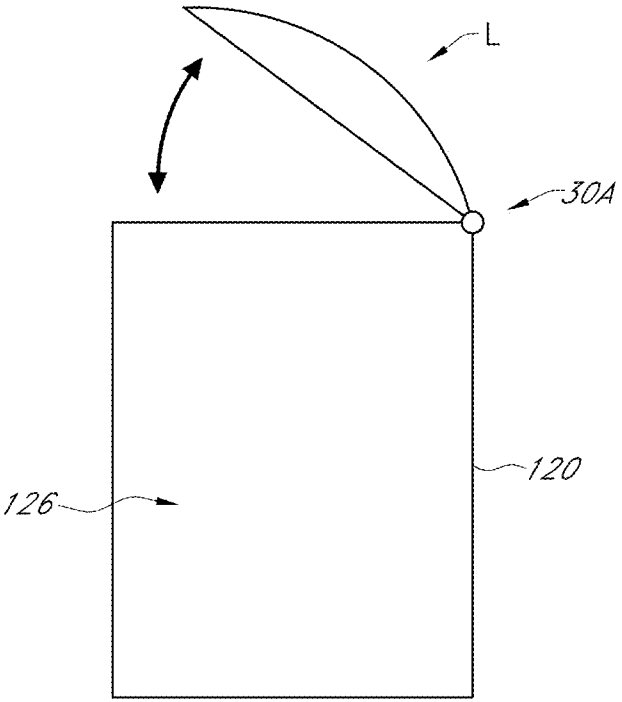
FIG. 18C is a schematic view of one embodiment of a coupling mechanism between the lid and vessel of the cooler container.

FIG. 18C is a schematic view of a coupling mechanism 30A for coupling the lid L and the vessel 120 for one or more implementations of the container system 100-100X disclosed herein. In the illustrated embodiment, the lid L can be connected to one or more portions of the vessel 120 via a hinge that allows the lid L to be selectively moved between an open position (see FIG. 18C) to allow access to the chamber 126, and a closed position to disallow access to the chamber 126.

Figure 18D:
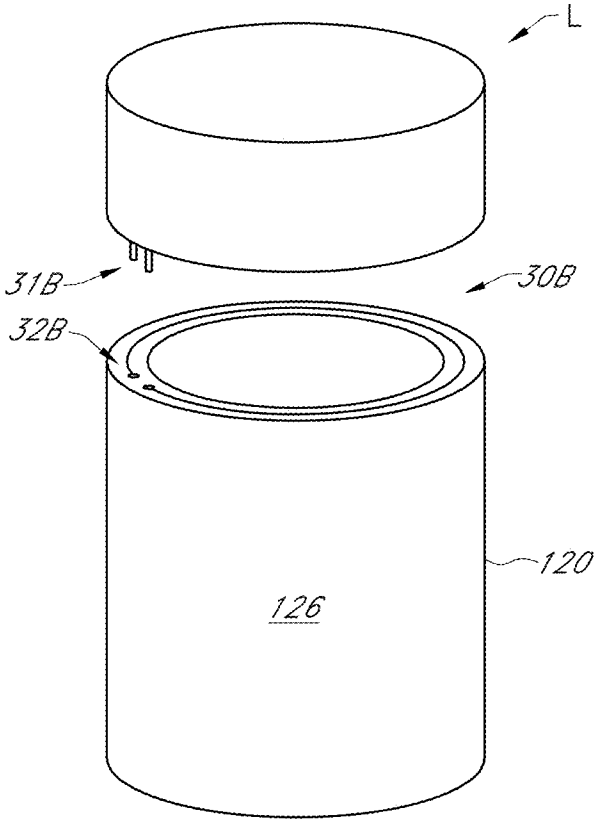
FIG. 18D is a schematic view of another embodiment of a coupling mechanism between the lid and the vessel of the cooler container.

FIG. 18D is a schematic view of another embodiment of a coupling mechanism 30B between the lid L and the vessel 120 of the container system 100-100X. In the illustrated embodiment, the lid L can have one or more electrical connectors 31B that communicate with one or more electrical contacts 32B on the vessel 120 when the lid L is coupled to the vessel 120, thereby allowing operation of the fan 280, TEC 220, etc. that are optionally in the lid L. Optionally, one of the electrical connectors 31B and electrical contacts 32B can be contact pins (e.g., Pogo pins) and the other of the electrical connectors 31B and electrical contacts 32B can be electrical contact pads (e.g., circular contacts) that optionally allows connection of the lid L to the vessel 120 irrespective of the angular orientation of the lid L relative to the vessel 120.

Figure 18E:
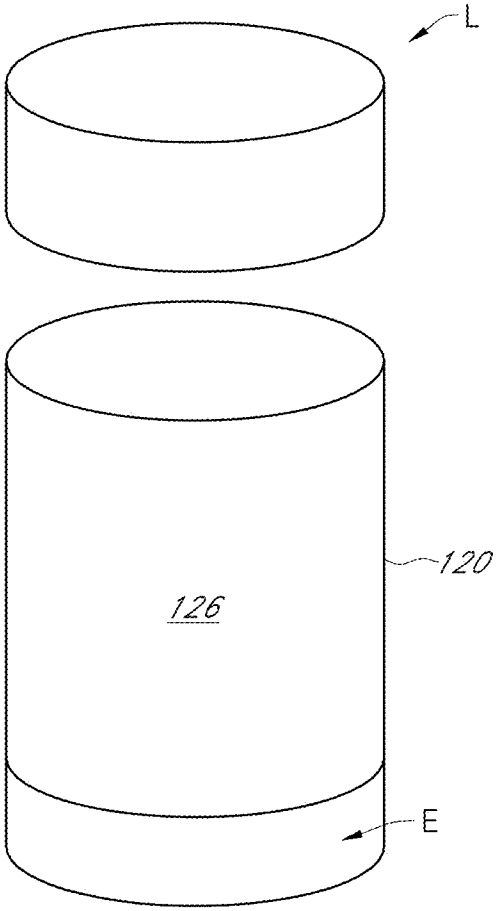
FIG. 18E is a schematic view of one embodiment of a vessel for the cooler container.

FIG. 18E shows a schematic view of an embodiment of a vessel for the cooler container system, such as the cooler container systems 100-100X disclosed herein. In the illustrated embodiment, the vessel 120 has electronics (e.g., one or more optional batteries, circuitry, optional transceiver)

housed in a compartment E on a bottom of the vessel 120. The electronics can communicate or connect to the fan 280, TEC 220 or other components in the lid L via electrical connections (such as those shown and described in connection with FIG. 18D), or via wires that extend through the hinge 30A (such as that shown in FIG. 18C).

Figure 18F:
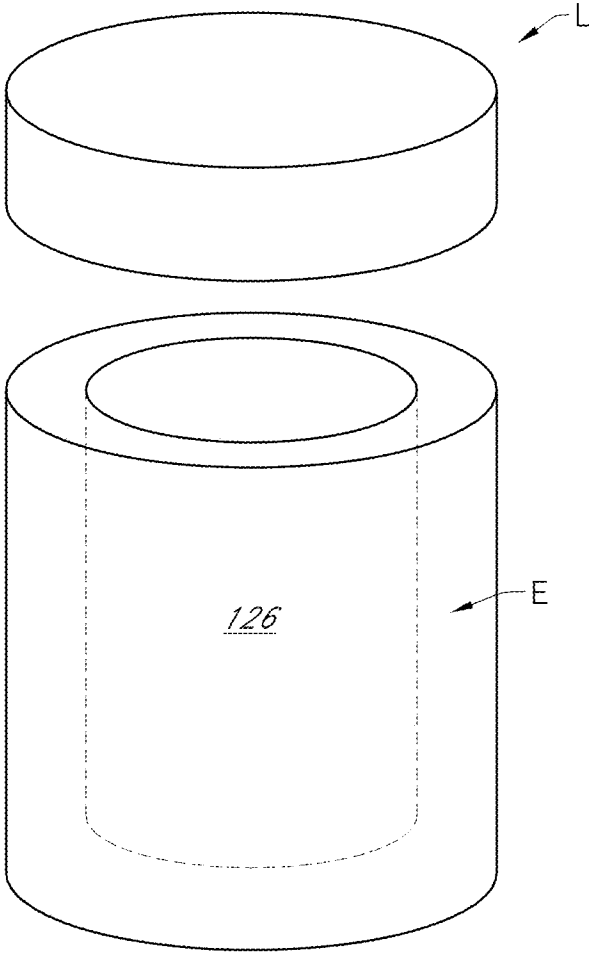
FIG. 18F is a schematic view of another embodiment of a vessel for the cooler container.

FIG. 18F shows a schematic view of an embodiment of a vessel for the cooler container system, such as the cooler container systems 100-100X disclosed herein. In the illustrated embodiment, the vessel 120 has electronics (e.g., one or more optional batteries, circuitry, optional transceiver) housed in a compartment E on a side of the vessel 120. The electronics can communicate or connect to the fan 280, TEC 220 or other components in the lid L via electrical connections (such as those shown and described in connection with FIG. 18D), or via wires that extend through the hinge 30A (such as that shown in FIG. 18C).

Figure 19:
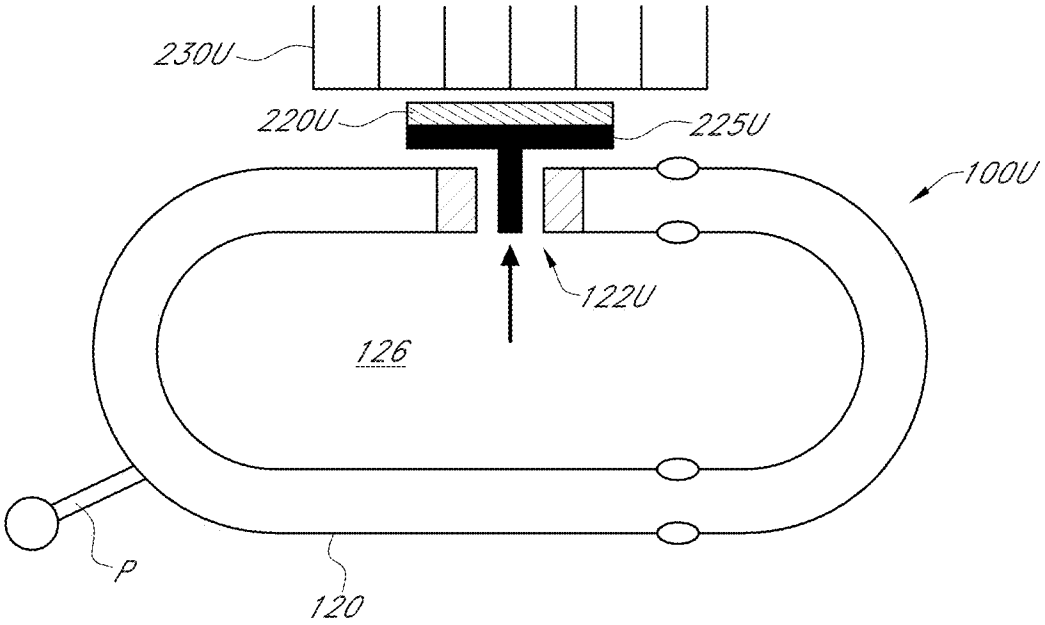
FIG. 19 is a schematic view of another embodiment of a cooler container.
Figure 20:
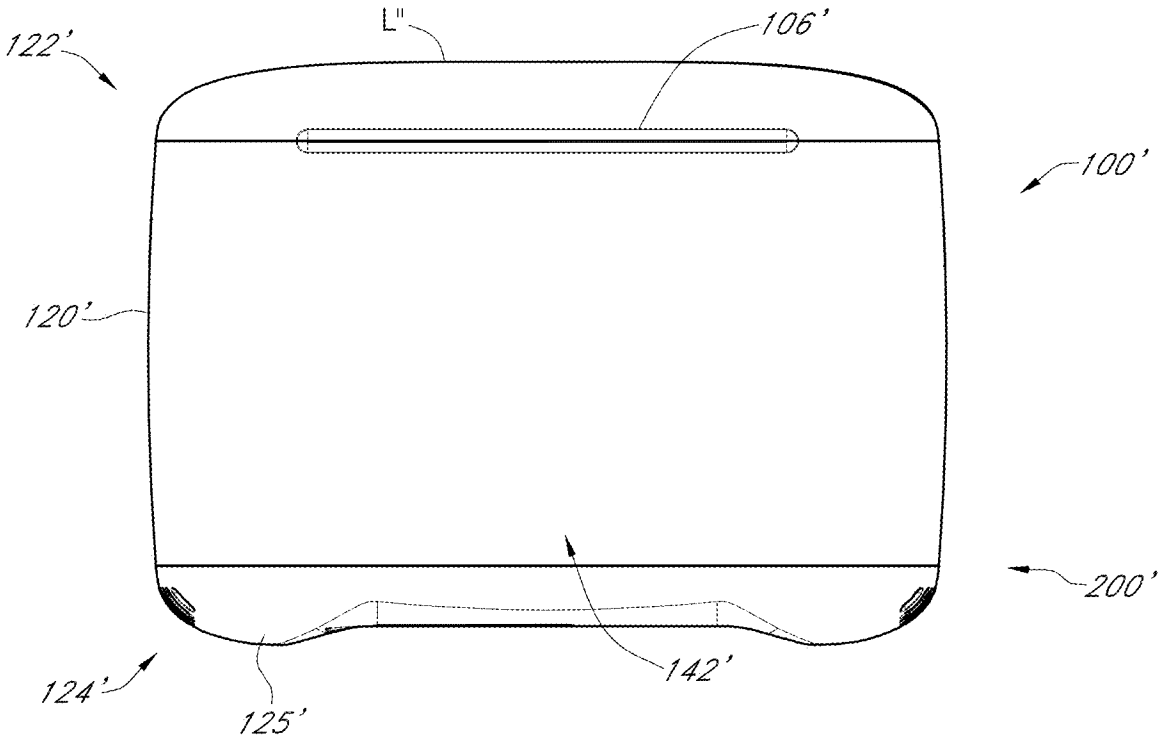
FIG. 20 is a schematic front view of another embodiment of a cooler container.
Figure 21:
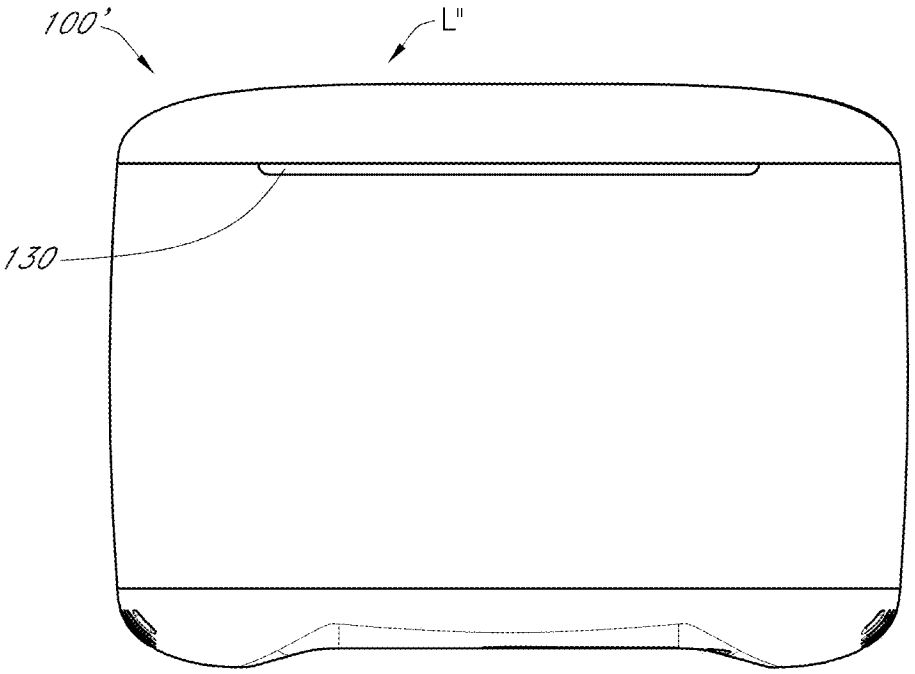
FIG. 21 is a schematic rear view of the cooler container of FIG. 20.

FIG. 19 shows another embodiment of a container system 100U having a cooling system 200U. The container system 100U includes a vessel 120 with a chamber 126. The vessel 120 can be double walled, as shown, with the space between the inner wall and outer wall under vacuum. A TEC 220U can be in contact with a cold delivery member (e.g., stud) 225U, which is in contact with the inner wall and can selectively thermally communicate with a hot side heat sink 230U. The cold delivery member 225 can be small relative to the size of the vessel 120, and can extend through an opening 122U in the vessel 120. Optionally, the container system 100U can have a pump P operable to pull a vacuum out from the cavity between the inner and outer walls of the vessel 120.

FIGS. 20-31 show a container system 100' that includes a cooling system 200'. The container system 100' has a body 120' that extends from a proximal end 122' to a distal end 124' and has an opening 123' selectively closed by a lid L". The body 120' can optionally be box shaped. The lid L" can optionally be connected to the proximal end 122' of the body 120' by a hinge 130' on one side of the body 120'. A groove or handle 106' can be defined on an opposite side of the body 120' (e.g., at least partially defined by the lid L" and/or body 120'), allowing a user to lift the lid L" to access a chamber 126' in the container 100'. Optionally, one or both of the lid L" and proximal end 122' of the body 120' can have one or more magnets (e.g., electromagnets, permanent magnets) that can apply a magnetic force between the lid L' and body 120' to maintain the lid L' in a closed state over the body 120' until a user overcomes said magnetic force to lift the lid L'. However, other suitable fasteners can be used to retain the lid L' in a closed position over the body 120'.

Figure 27:
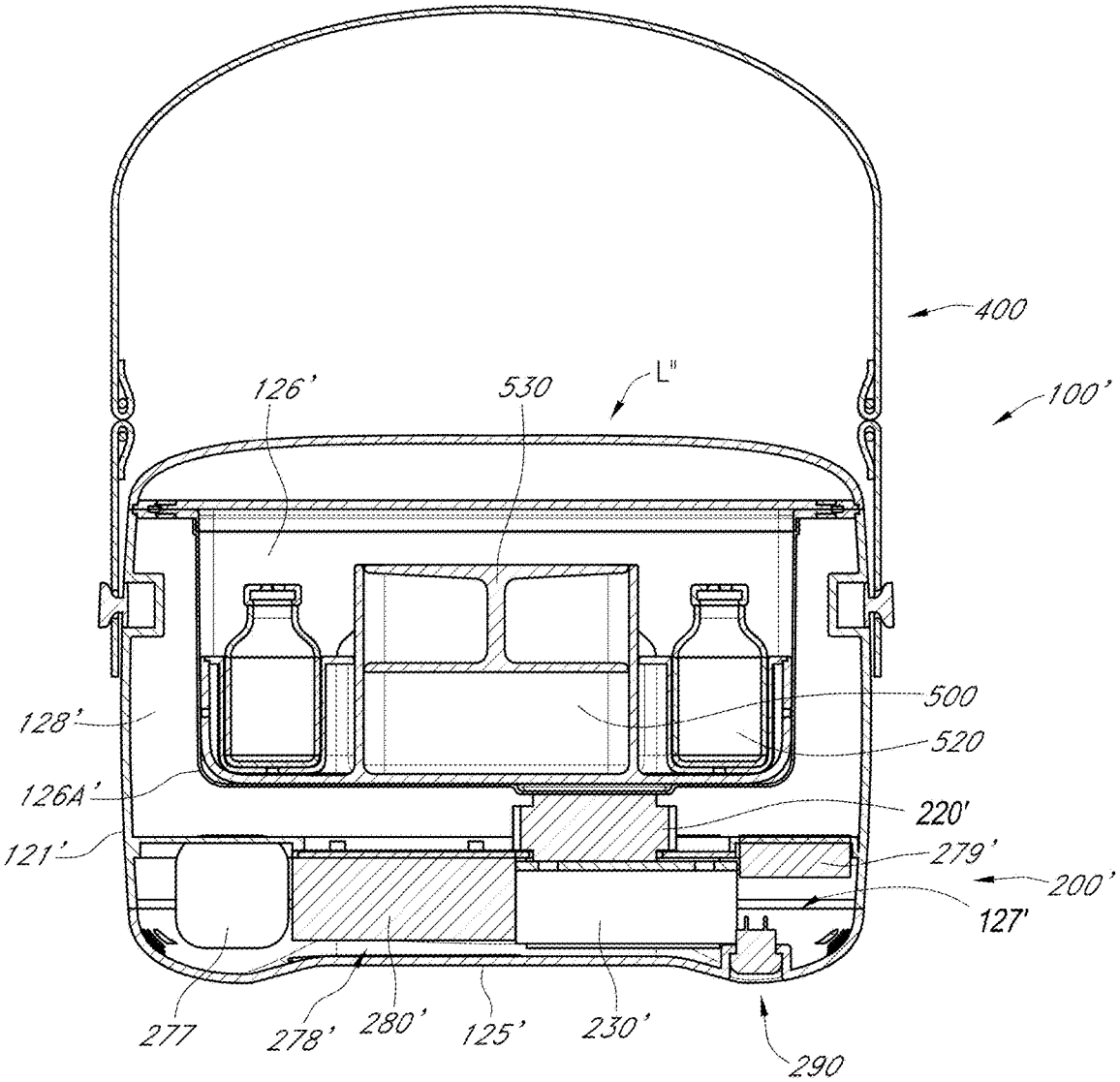
FIG. 27 is a schematic cross-sectional view of the cooler container of FIG. 20 with the tray disposed in the container.

With reference to FIG. 27, the body 120' can include an outer wall 121' and optionally include an inner wall 126A' spaced apart from the outer wall 121' to define a gap (e.g., annular gap, annular chamber) 128' therebetween. Optionally, the inner wall 126A' can be suspended relative to the outer wall 121' in a way that provides the inner wall 126A' with shock absorption (e.g., energy dissipation). For example, one or more springs can be disposed between the inner wall 126A' and the outer wall 121' that provide said shock absorption. Optionally, the container 100' includes one or more accelerometers (e.g., in communication with the circuitry of the container 100') that sense motion (e.g., acceleration) of the container 100'. Optionally, the one or more accelerometers communicate sensed motion information to the circuitry, and the circuitry optionally operates one or more components to adjust a shock absorption provided by the inner wall 126A' (e.g., by tuning a shock absorption property of one or more springs, such as magnetorheological (MRE) springs) that support the inner surface 126A'. In one implementation, the container 100' can include a plastic and/or rubber structure in the gap 128' between the inner wall 126A' and the outer wall 121' to aid in providing such shock absorption.

The gap 128' can optionally be filled with an insulative material (e.g., foam). In another implementation, the gap 128' can be under vacuum. In still another implementation, the gap 128' can be filled with a gas (e.g., air). Optionally, the inner wall 126A' can be made of metal. Optionally, the outer wall 121' can be made of plastic. In another implementation, the outer wall 121' and the inner wall 126A' are optionally made of the same material.

With continued reference to FIG. 27, the cooling system 200' can optionally be housed in a cavity 127' disposed between a base 125' of the container body 120' and the inner wall 126A'. The cooling system 200' can optionally include one or more thermoelectric elements (TEC) (e.g., Peltier elements) 220' in thermal communication with (e.g., in direct contact with) the inner wall 126A'. In one implementation, the cooling system 200' has only one TEC 220'. The one or more TECs 220' can optionally be in thermal communication with one or more heat sinks 230'. Optionally, the one or more heat sinks 230' can be a structure with a plurality of fins. Optionally, one or more fans 280' can be in thermal communication with (e.g., in fluid communication with) the one or more heat sinks 230'. The cooling system 200' can optionally have one or more batteries 277', optionally have a converter 279', and optionally have a power button 290', that communicate with circuitry (e.g., on a printed circuit board 278') that controls the operation of the cooling system 200'.

The optional batteries 277' provide power to one or more of the circuitry, one of more fans 280', one or more TECs 220', and one or more sensors (described further below). Optionally, at least a portion of the body 120' (e.g., a portion of the base 125') of the container 100' is removable to access the one or more optional batteries 277'. Optionally, the one or more optional batteries 277' can be provided in a removable battery pack, which can readily be removed and replaced from the container 100'. Optionally, the container 100' can include an integrated adaptor and/or retractable cable to allow connection of the container 100' to a power source (e.g., wall outlet, vehicle power connector) to one or both of power the cooling system 200' directly and charge the one or more optional batteries 277'.

Figure 22:
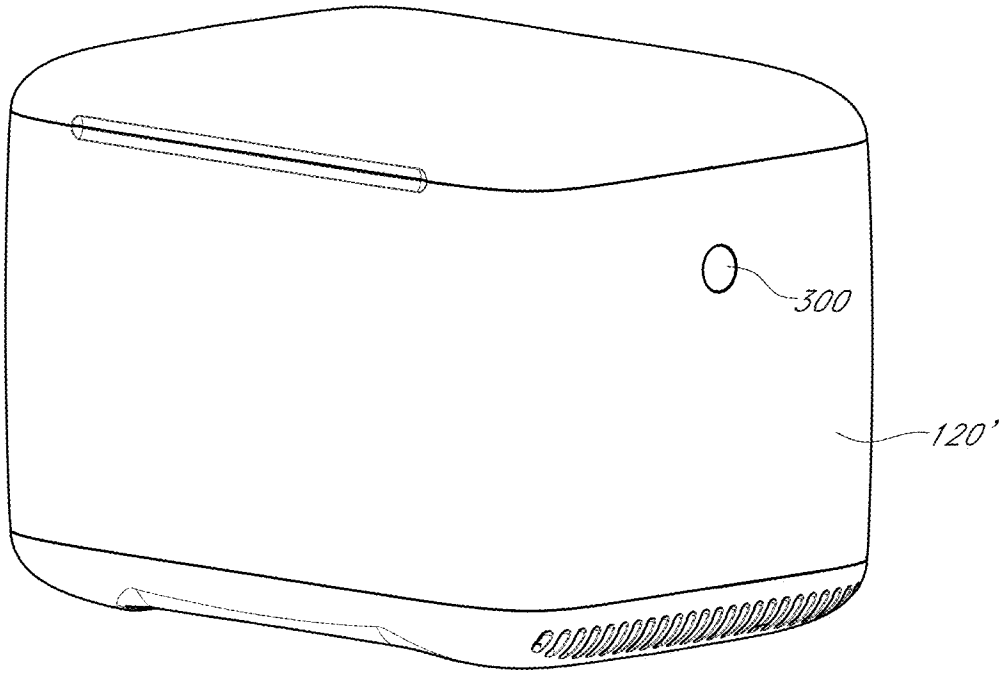
FIG. 22 is a schematic perspective view of the cooler container of FIG. 20.
Figure 23:
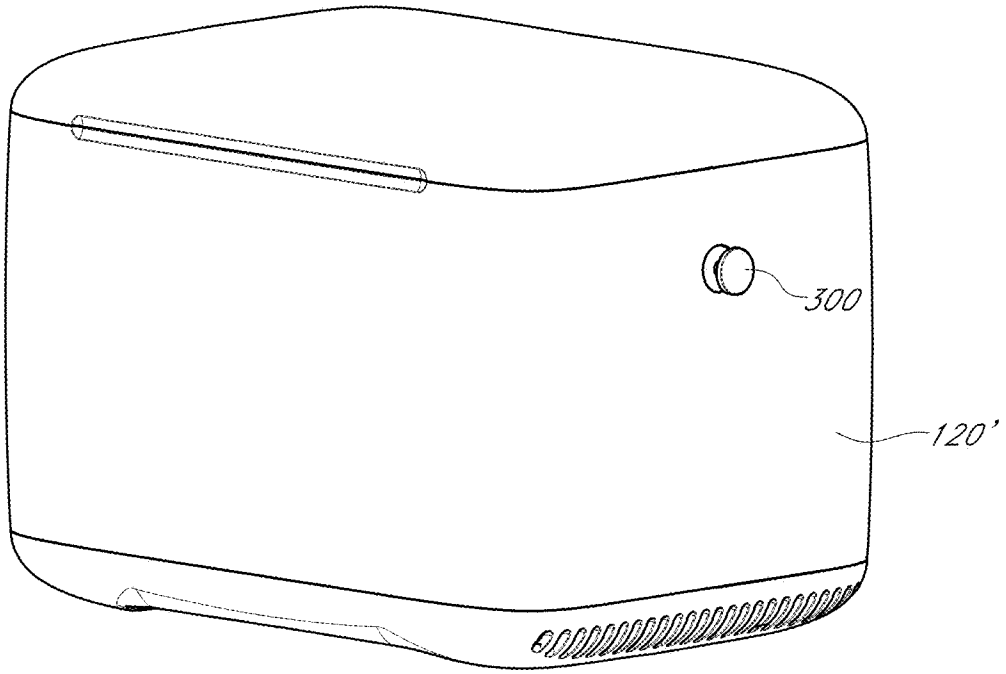
FIG. 23 is a schematic perspective view of the cooler container of FIG. 20.
Figure 24:
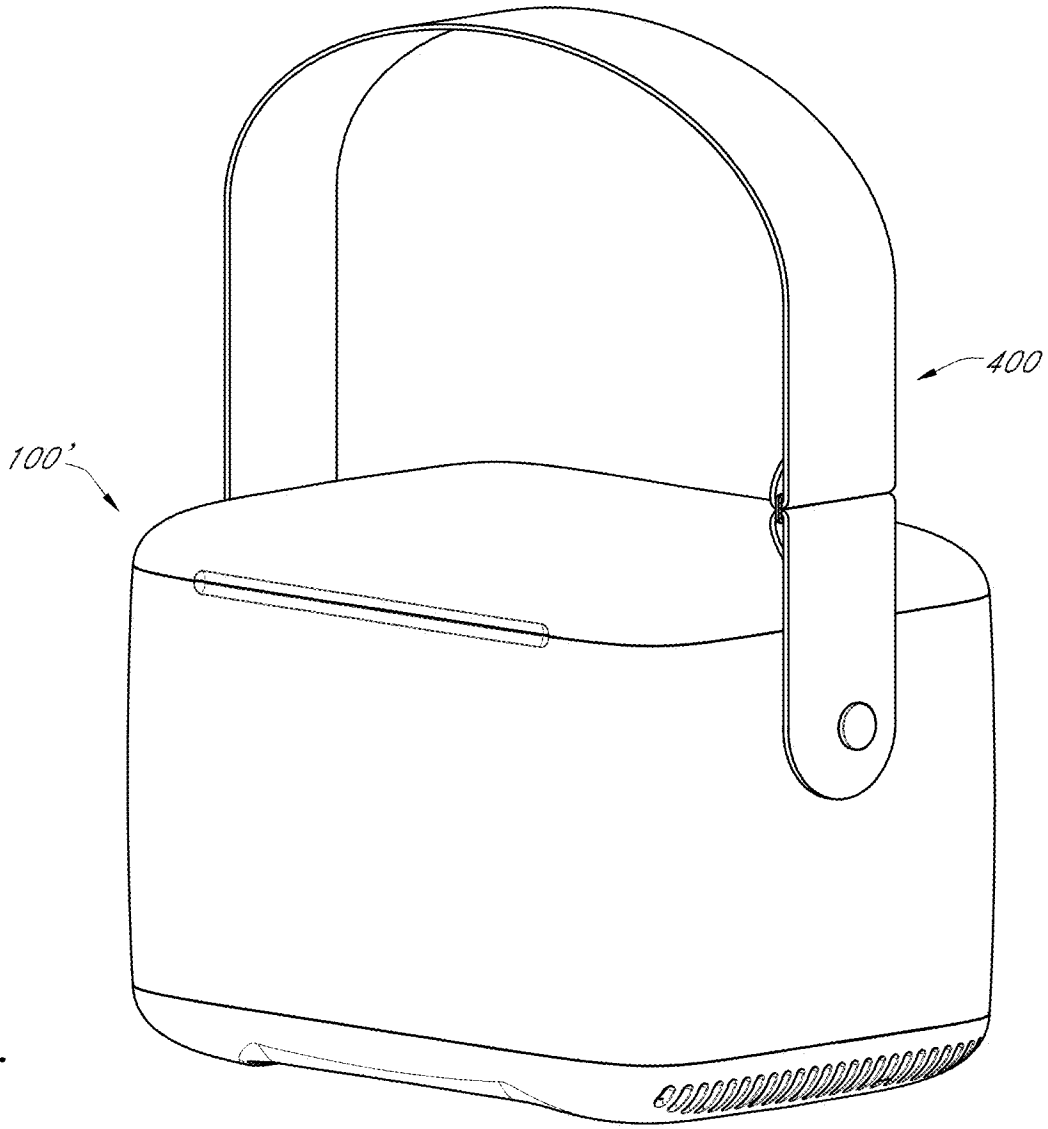
FIG. 24 is a schematic perspective view of the cooler container of FIG. 20.

With reference to FIGS. 22-23 and 27, the container system 100' can have two or more handles 300 on opposite sides of the body 120' to which a strap 400 can be removably coupled (see FIG. 24) to facilitate transportation of the container 100'. For example, the user can carry the container 100' by placing the strap 400 over their shoulder. Optionally, the strap 400 is adjustable in length. Optionally, the strap 400 can be used to secure the container system 100' to a vehicle (e.g., moped, bicycle, motorcycle, etc.) for transportation. Optionally, the one or more handles 300 can be movable relative to the outer surface 121' of the body 120'. For example, the handles 300 can be selectively movable between a retracted position (see e.g., FIG. 22) and an extended position (see e.g., FIG. 23). Optionally, the handles 300 can be mounted within the body 120' in a spring-loaded manner and be actuated in a push-to-open and push-to-close manner.

Figure 26:
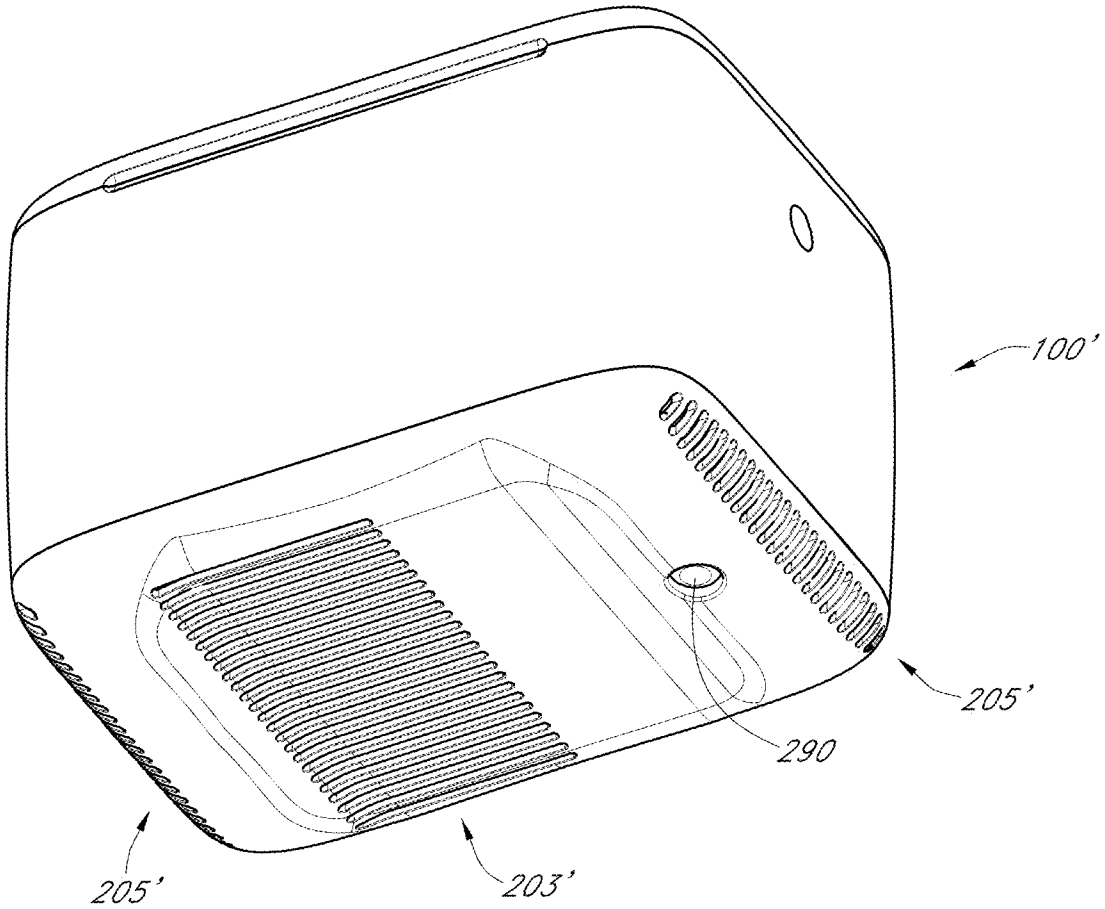
FIG. 26 is a schematic bottom view of the cooler container of FIG. 20.

With reference to FIGS. 26-27, the body 120' can include one or more sets of vents on a surface thereof to allow air flow into and out of the body 120'. For example, the body 120' can have one or more vents 203' defined on the bottom portion of the base 125' of the body 120' and can optionally have one or more vents 205' at one or both ends of the base 125'. Optionally, the vents 203' can be air intake vents, and the vents 205' can be air exhaust vents.

Figure 25A:
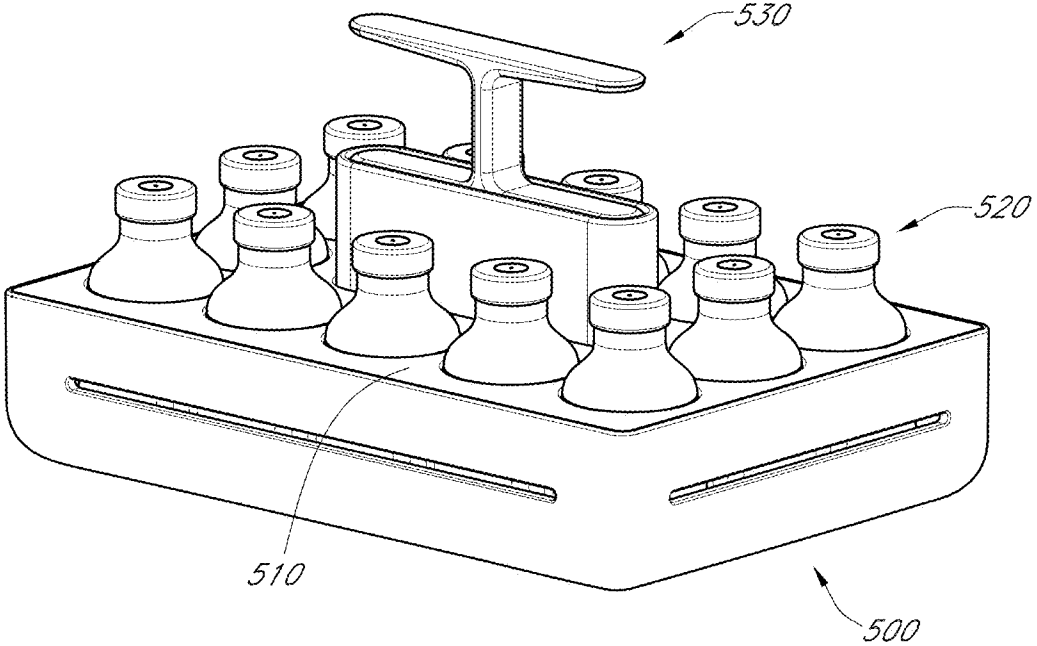
FIG. 25A is a schematic view of a tray removed from the container.

With reference to FIG. 25A, the chamber 126 is optionally sized to receive and hold one or more trays 500 therein (e.g., hold a plurality of trays in a stacked configuration). Each tray 500 optionally has a plurality of receptacles 510, where each receptacle 510 is sized to receive a container (e.g., a vial) 520 therein. The container 520 can optionally hold a liquid (e.g., a medication, such as insulin or a vaccine). Optionally, the tray 500 (e.g., the receptacle 510) can releasably lock the containers 520 therein (e.g., lock the containers 520 in the receptacles 510) to inhibit movement, dislodgement and/or damage to the containers 520 during transit of the container system 100'. Optionally, the tray 500 can have one or more handles 530 to facilitate carrying of the tray 500 and/or pulling the tray 500 out of the chamber 126 or placing the tray 500 in the chamber 126. Optionally, the one or more handles 530 are movable between a retracted position (see FIG. 28) and an extended position (see FIG. 26). Optionally, the one or more handles 530 can be mounted within the tray 500 in a spring-loaded manner and be actuated in a push-to-extend and push-to-retract manner. In another implementation, the one or more handles 530 are fixed (e.g., not movable between a retracted and an extended position).

Figure 25B:
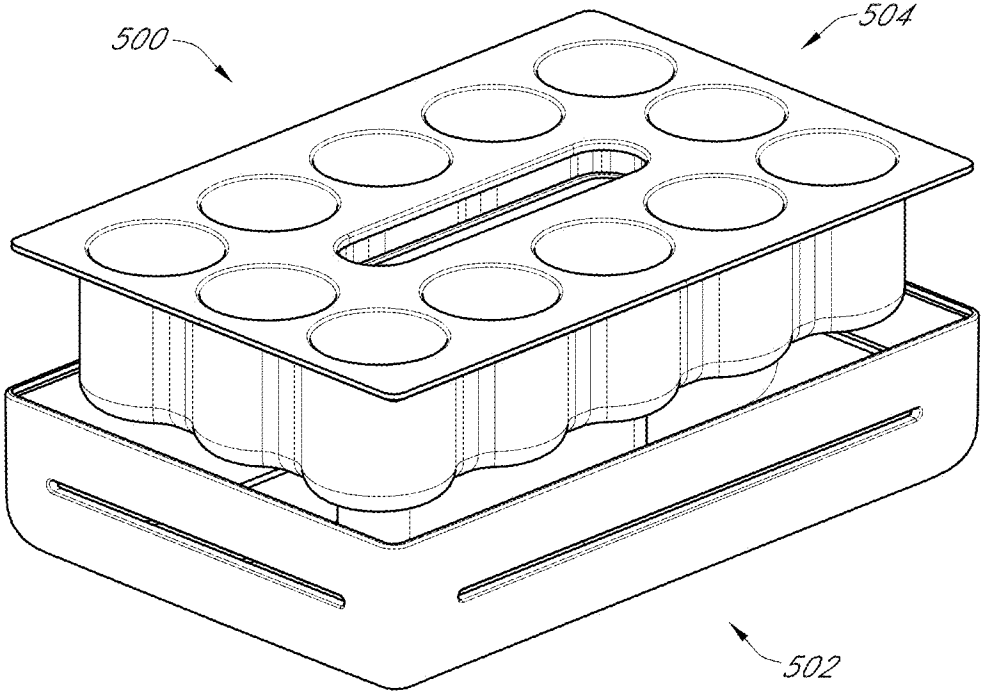
FIG. 25B is a schematic view of an interchangeable tray system for use with the container.
Figure 25D:
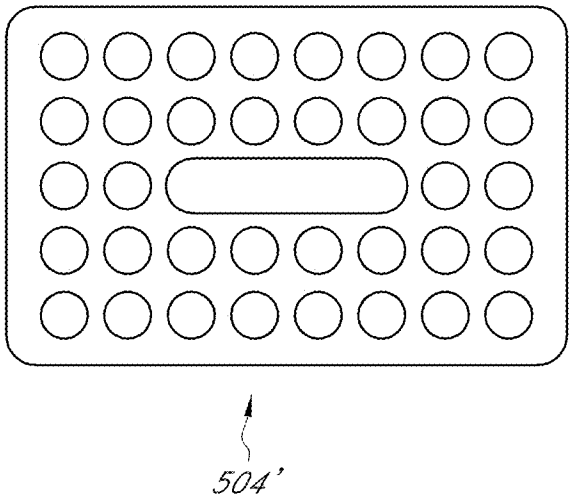
FIG. 25D is a schematic top view of another embodiment of a tray for use in the container of FIG. 20.
Figure 25C:
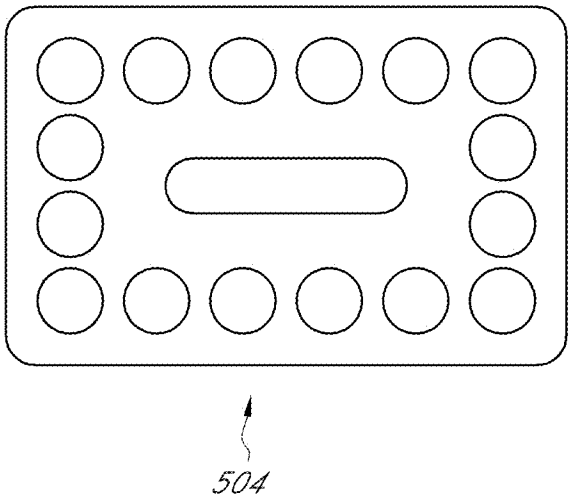
FIG. 25C is a schematic top view of one embodiment of a tray for use in the container of FIG. 20.

With reference to FIGS. 25B-25D, the tray 500 can include an outer tray 502 that removably receives one or more inner trays 504, 504', where different inner trays 504, 504' can have a different number and/or arrangement of the plurality of receptacles 510 that receive the one or more containers (e.g., vials) 520 therein, thereby advantageously allowing the container 100' to accommodate different number of containers 520 (e.g., for different medications, etc.). In one implementation, shown in FIG. 25C, the inner tray 504 can have a relatively smaller number of receptacles 510 (e.g., sixteen), for example to accommodate relatively larger sized containers 520 (e.g., vials of medicine, such as vaccines and insulin, biological fluid, such as blood, etc.), and in another implementation, shown in FIG. 25D, the inner tray 504' can have a relatively larger number of receptacles 510 (e.g., thirty-eight), for example to accommodate relatively smaller sized containers 520 (e.g., vials of medicine, biological fluid, such as blood, etc.).

Figure 28:
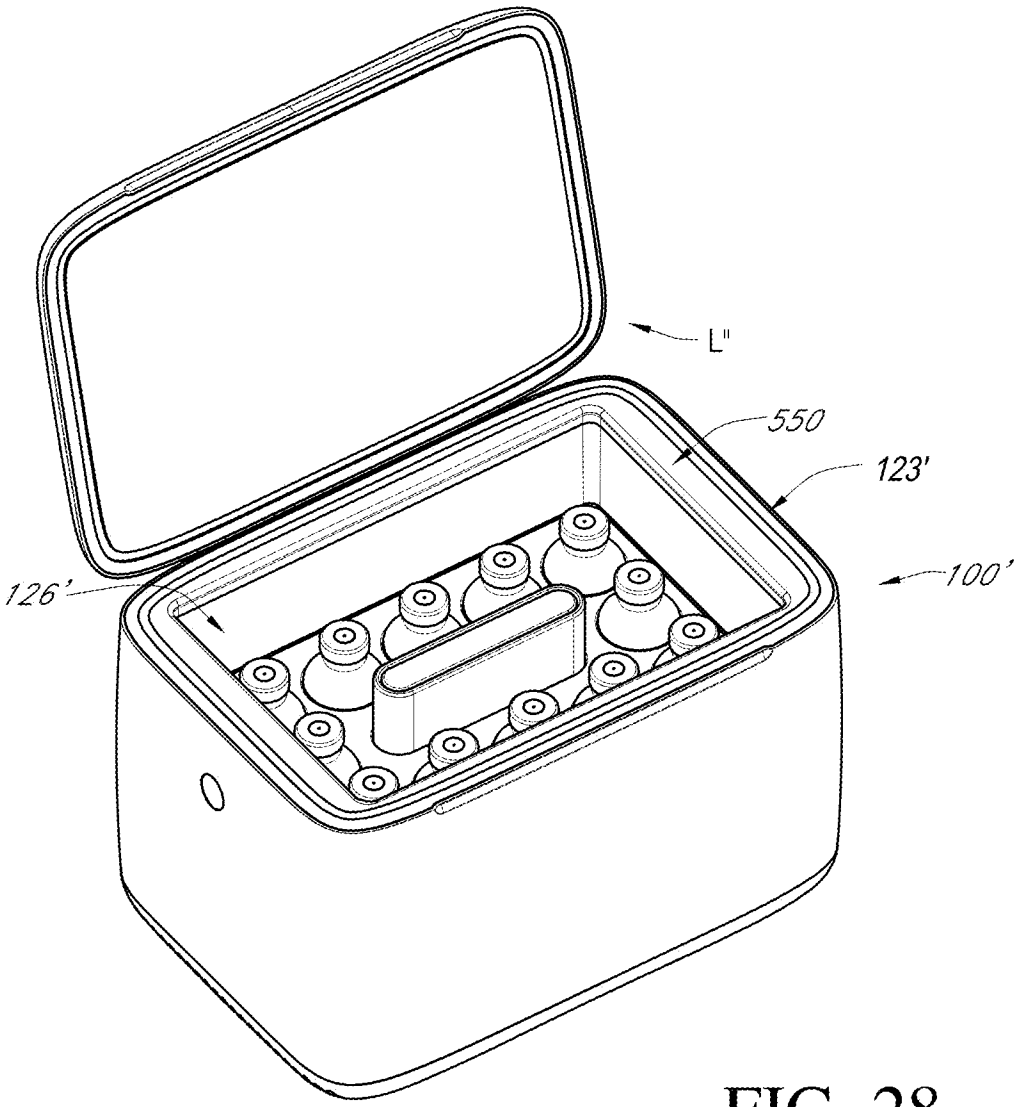
FIG. 28 is a schematic view of the container in an open position with one or more lighting elements.

With reference to FIG. 28, the container system 100' can have one or more lighting elements 550 that can advantageously facilitate users to readily see the contents in the chamber 126' when in a dark environment (e.g., outdoors at night, in a rural or remote environment, such as mountainous, desert or rainforest region). In one implementation, the one or more lighting elements can be one or more light strips (e.g., LED strips) disposed at least partially on one or more surfaces of the chamber 126' (e.g., embedded in a surface of the chamber 126', such as near the proximal opening of the chamber 126'). Optionally, the one or more lighting elements 550 can automatically illuminate when the lid L" is opened. Once illuminated, the one or more lighting elements 550 can optionally automatically shut off when the lid L" is closed over the chamber 126'. Optionally, the one or more lighting elements 550 can communicate with circuitry of the container 100', which can also communicate with a light sensor of the container 100' (e.g., a light sensor disposed on an outer surface of the container 100'). The light sensor can generate a signal when the sensed light is below a predetermined level (e.g., when container 100' in a building without power or is in the dark, etc.) and communicate said signal to the circuitry, and the circuitry can operate the one or more lighting elements 550 upon receipt of such signal (e.g., and upon receipt of the signal indicating the lid L" is open).

The container system 100' can have a housing with one of a plurality of colors. Such different color housings can optionally be used with different types of contents (e.g., medicines, biological fluids), allowing a user to readily identify the contents of the container 100' by its housing color. Optionally, such different colors can aid users in distinguishing different containers 100' in their possession/use without having to open the containers 100' to check their contents.

Figure 29A:
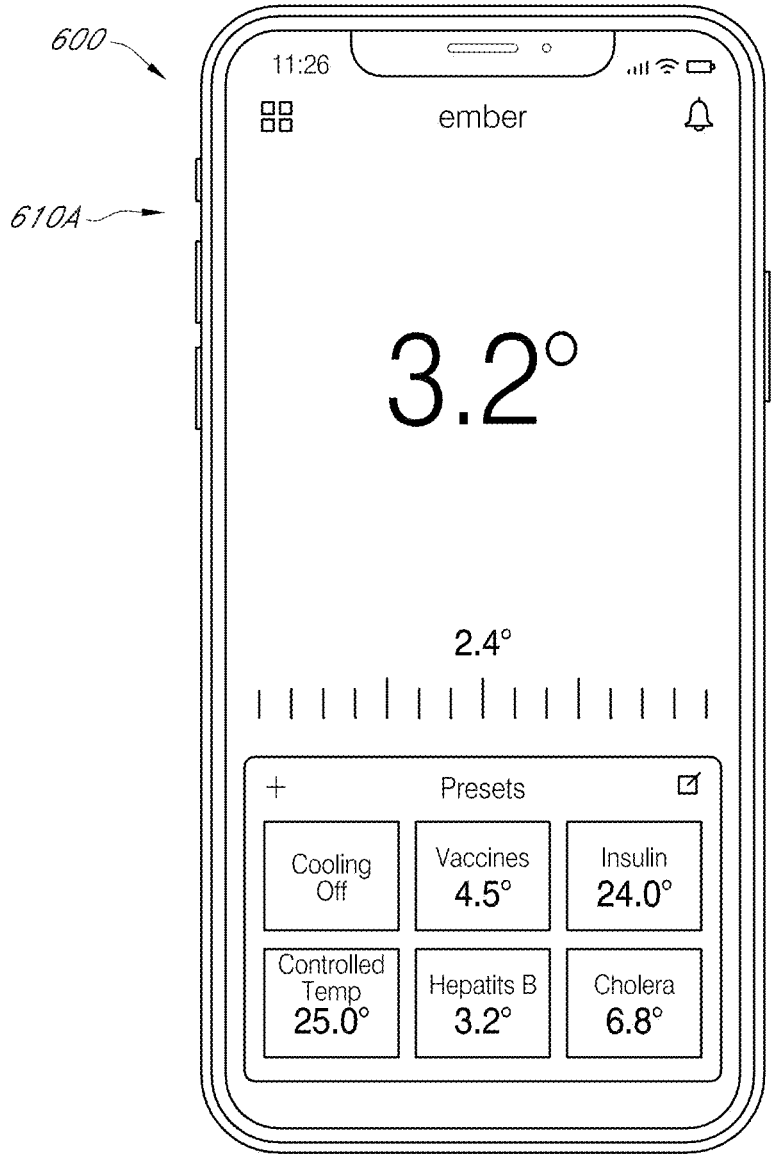
FIGS. 29A-29C are schematic views of a graphical user interface for use with the container.
Figure 29B:
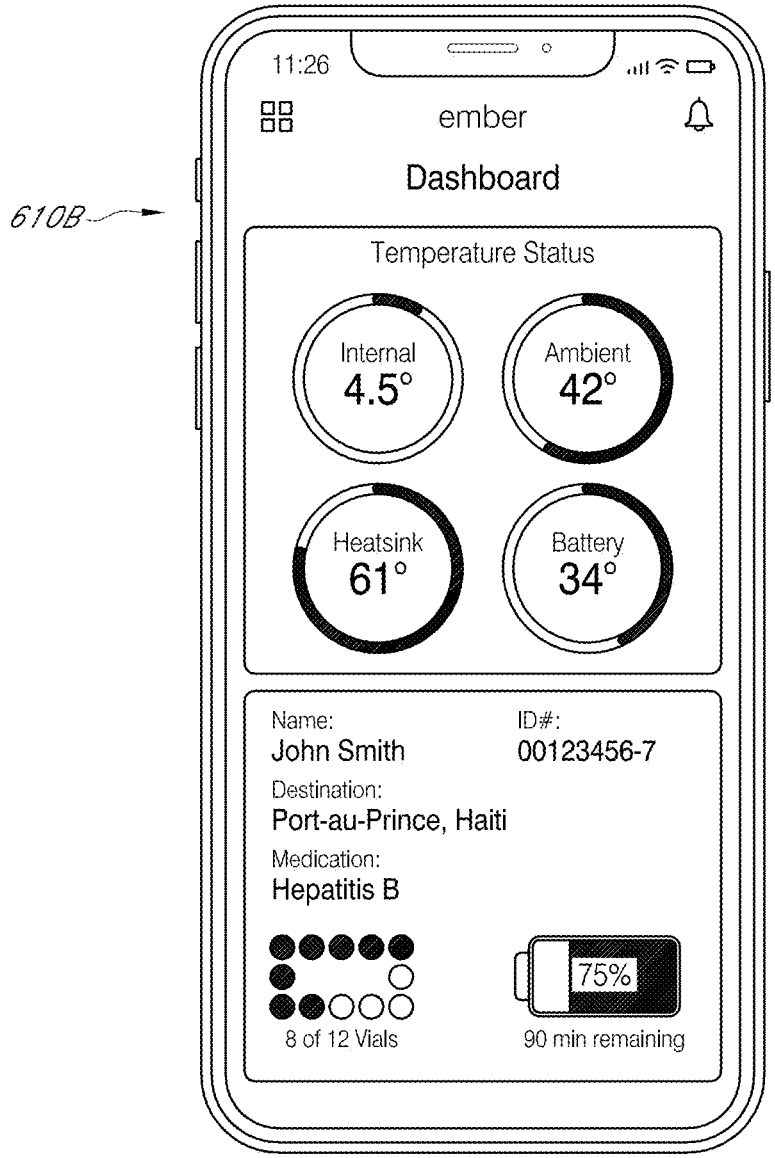
Figure 29C:
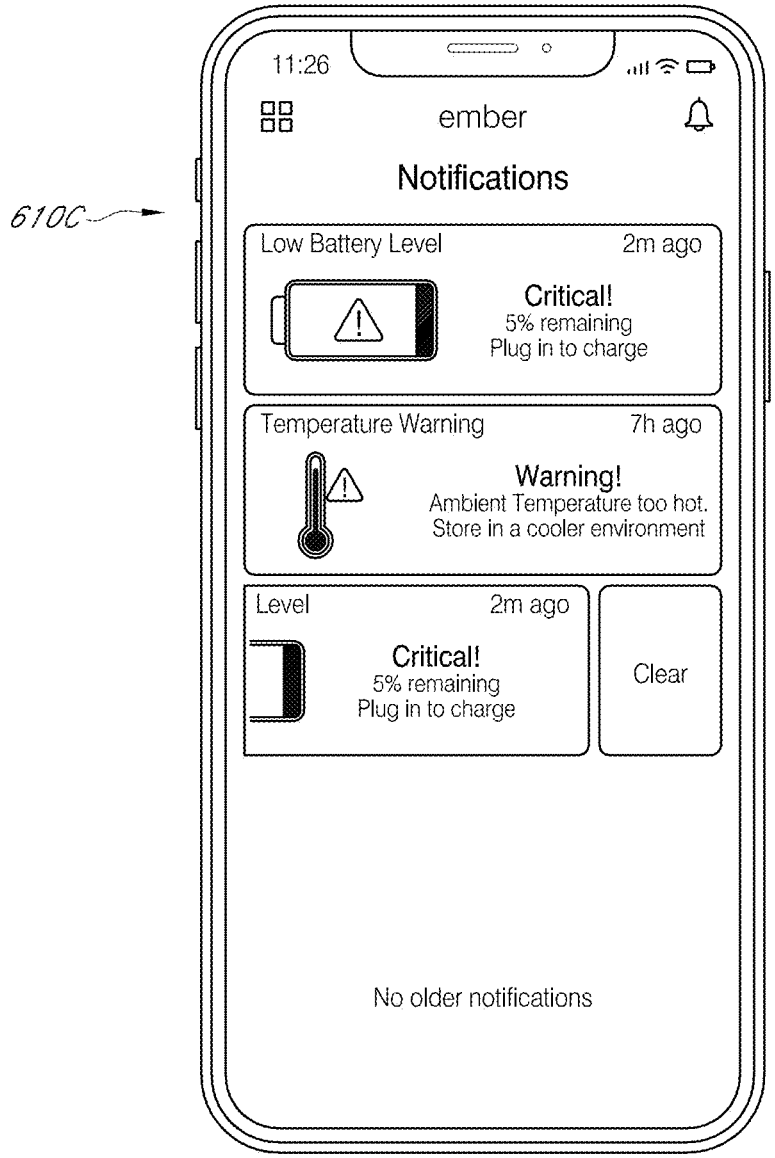

With reference to FIGS. 29A-29C, the container 100' can optionally communicate (e.g., one-way communication, two-way communication) with one or more remote electronic device (e.g., mobile phone, tablet computer, desktop computer, remote server) 600, via one or both of a wired or wireless connection (e.g., 802.11b, 802.11a, 802.11g, 802.11n standards, etc.). Optionally, the container 100' can communicate with the remote electronic device 600 via an app (mobile application software) that is optionally downloaded (e.g., from the cloud) onto the remote electronic device 600. The app can provide one or more graphical user interface screens 610A, 610B, 610C via which the remote electronic device 600 can display one or more data received from the container 100'. Optionally, a user can provide instructions to the container 100' via one or more of the graphical user interface screens 610A, 610B, 610C on the remote electronic device 600.

In one implementation, the graphical user interface (GUI) screen 610A can provide one or more temperature presets corresponding to one or more particular medications (e.g., epinephrine/adrenaline for allergic reactions, insulin, vaccines, etc.). The GUI screen 610A can optionally allow the turning on and off of the cooling system 200'. The GUI screen 610A can optionally allow the setting of the control temperature to which the chamber 126' in the container 100' is cooled by the cooling system 200'.

In another implementation, the graphical user interface (GUI) screen 610B can provide a dashboard display of one or more parameters of the container 100' (e.g., ambient temperature, internal temperature in the chamber 126', temperature of the heat sink 230', temperature of the battery 277, etc.). The GUI screen 610B can optionally provide an indication (e.g., display) of power supply left in the one or more batteries 277 (e.g., % of life left, time remaining before battery power drains completely). Optionally, the GUI screen 610B can also include information (e.g., a display) of how many of the receptacles 510 in the tray 500 are occupied (e.g., by containers 520). Optionally, the GUI screen 610B can also include information on the contents of the container 100' (e.g., medication type or disease medication is meant to treat), information on the destination for the container 100' and/or information (e.g., name, identification no.) for the individual assigned to the container 100'.

In another implementation, the GUI screen 610C can include a list of notifications provided to the user of the container 100', including alerts on battery power available, alerts on ambient temperature effect on operation of container 100', alerts on a temperature of a heat sink of the container 100', alert on temperature of the chamber 126, 126', 126V, alert on low air flow through the intake vent 203', 203", 203V and/or exhaust vent 205', 205", 205V indicating they may be blocked/clogged, etc. One of skill in the art will recognize that the app can provide the plurality of GUI screens 610A, 610B, 610C to the user, allowing the user to swipe between the different screens.

Optionally, as discussed further below, the container 100' can communicate information, such as temperature history of the chamber 126' and/or first heat sink 210 that generally corresponds to a temperature of the containers 520, 520V (e.g., medicine containers, vials, cartridges, injectors), power level history of the batteries 277, ambient temperature history, etc. to the cloud (e.g., on a periodic basis, such as every hour; on a continuous basis in real time, etc.) to one or more of a) an RFID tag on the container system 100, 100', 100", 100B-100V that can later be read (e.g., at the delivery location), b) to a remote electronic device (e.g., a mobile electronic device such as a smartphone or tablet computer or laptop computer or desktop computer), including wirelessly (e.g., via WiFi 802.11, BLUETOOTH®, or other RF communication), and c) to the cloud (e.g., to a cloud-based data storage system or server) including wirelessly (e.g., via WiFi 802.11, BLUETOOTH®, or other RF communication). Such communication can occur on a periodic basis (e.g., every hour; on a continuous basis in real time, etc.). Once stored on the RFID tag or remote electronic device or cloud, such information can be accessed via one or more remote electronic devices (e.g., via a dashboard on a smart phone, tablet computer, laptop computer, desktop computer, etc.). Additionally, or alternatively, the container system 100, 100', 100", 100B-100V can store in a memory (e.g., part of the electronics in the container system 100, 100', 100", 100B-100V) information, such as temperature history of the chamber 126, 126', 126V, temperature history of the first heat sink 210, 210B-210V, power level history of the batteries 277, ambient temperature history, etc., which can be accessed from the container system 100, 100', 100", 100B-100V by the user via a wired or wireless connection (e.g., via the remote electronic device 600).

Figure 30:
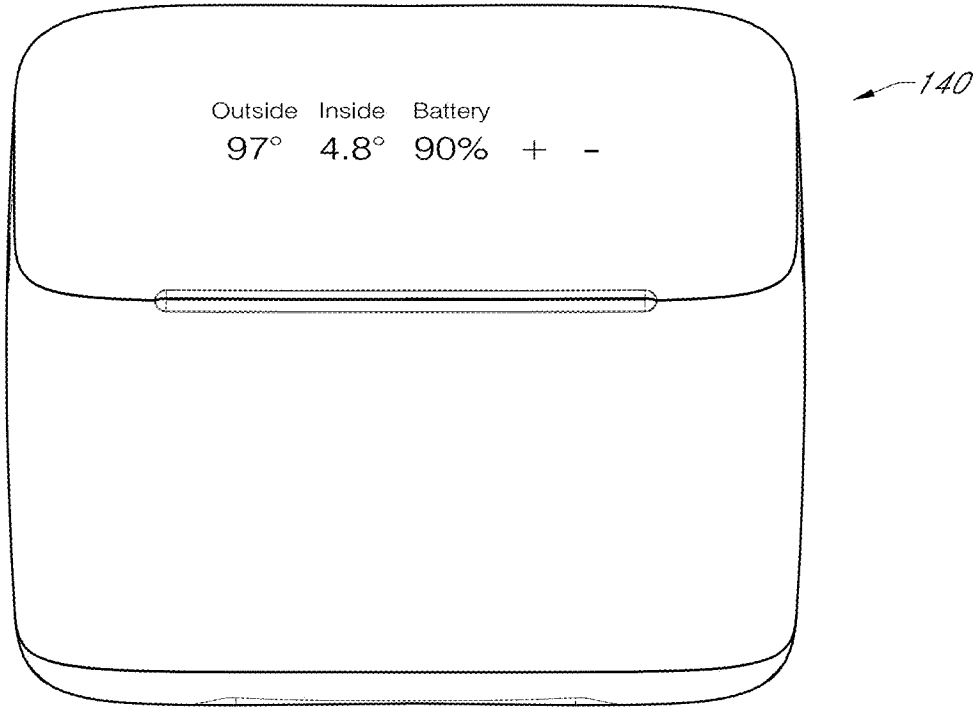
FIG. 30 is a schematic view of a visual display of the container.

With reference to FIG. 30, the body 120' of the container 100' can have a visual display 140 on an outer surface 121' of the body 120'. The visual display 140' can optionally display one or more of the temperature in the chamber 126', the ambient temperature, a charge level or percentage for the one or more batteries 277, and amount of time left before recharging of the batteries 277 is needed. The visual display 140' can include a user interface (e.g., pressure sensitive buttons, capacitance touch buttons, etc.) to adjust (up or down) the temperature preset at which the cooling system 200' is to cool the chamber 126' to. Accordingly, the operation of the container 100' (e.g., of the cooling system 200') can be selected via the visual display and user interface 140' on a surface of the container 100'. Optionally, the visual display 140' can include one or more hidden-til-lit LEDs. Optionally, the visual display 140' can include an electronic ink (e-ink) display. In one implementation, the container 100' can optionally include a hidden-til-lit LED 142' (see FIG. 34) that can selectively illuminate (e.g., to indicate one or more operating functions of the container 100', such as to indicate that the cooling system 200' is in operation). The LED 142' can optionally be a multi-color LED selectively operable to indicate one or more operating conditions of the container 100' (e.g., green if normal operation, red if abnormal operation, such as low battery charge or inadequate cooling for sensed ambient temperature, etc.).

Figure 31:
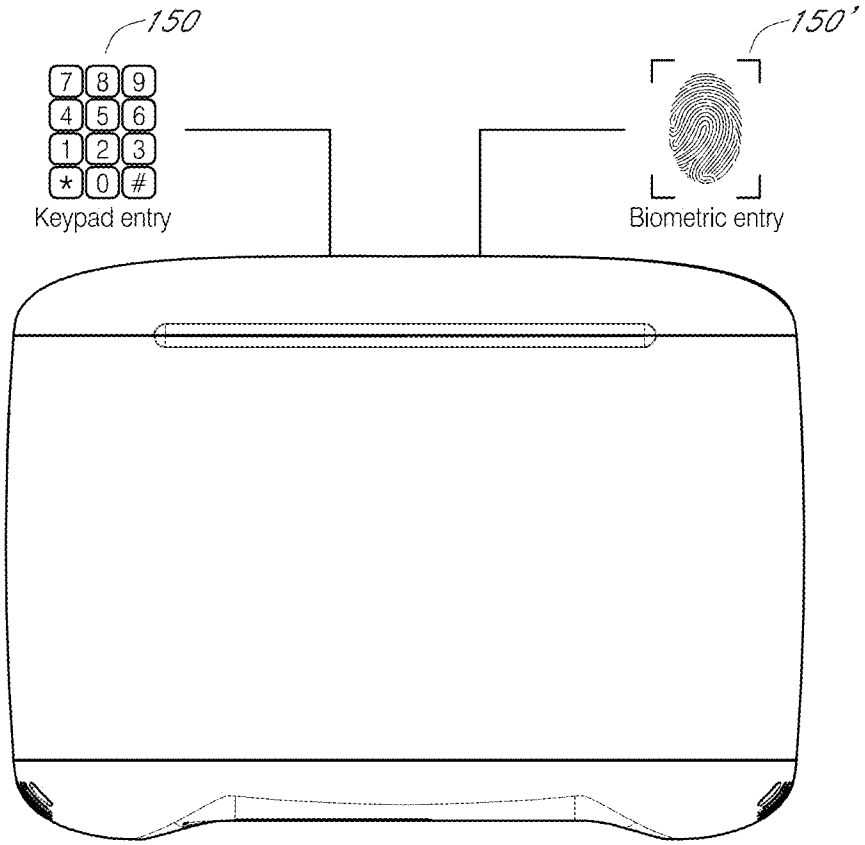
FIG. 31 is a schematic view of security features of the container.

With reference to FIG. 31, the container 100' can include one or more security features that allow opening of the container 100' only when the security feature(s) are met. In one implementation, the container 100' can include a keypad 150 via which an access code can be entered to unlock the lid L" to allow access to the chamber 126' when it matches the access code key programmed to the container 100'. In another implementation, the container 100' can additionally or alternatively have a biometric sensor 150', via which the user can provide a biometric identification (e.g., fingerprint) that will unlock the lid L" and allow access to the chamber 126' when it matches the biometric key programmed to the container 100'. Optionally, the container 100' remains locked until it reaches its destination, at which point the access code and/or biometric identification can be utilized to unlock the container 100' to access the contents (e.g., medication) in the chamber 126'.

The container 100' can optionally be powered in a variety of ways. In one implementation, the container system 100' is powered using 12 VDC power (e.g., from one or more batteries 277'). In another implementation, the container system 100' is powered using 120 VAC or 240 VAC power. In another implementation, the cooling system 200' can be powered via solar power. For example, the container 100' can be removably connected to one or more solar panels so that electricity generated by the solar panels is transferred to the container 100', where circuitry of the container 100' optionally charges the one or more batteries 277 with the solar power. In another implementation, the solar power from said one or more solar panels directly operates the cooling system 200' (e.g., where batteries 277 are excluded from the container 100'). The circuitry in the container 100' can include a surge protector to inhibit damage to the electronics in the container 100' from a power surge.

In operation, the cooling system 200' can optionally be actuated by pressing the power button 290. Optionally, the cooling system 200' can additionally (or alternatively) be actuated remotely (e.g., wirelessly) via a remote electronic device, such as a mobile phone, tablet computer, laptop computer, etc. that wirelessly communicates with the cooling system 200' (e.g., with a receiver or transceiver of the circuitry). The chamber 126' can be cooled to a predetermined and/or a user selected temperature or temperature range. The user selected temperature or temperature range can be selected via a user interface on the container 100' and/or via the remote electronic device.

The circuitry optionally operates the one or more TECs 220' so that the side of the one or more TECs 220' adjacent the inner wall 126A' is cooled and so that the side of the one or more TECs 220' adjacent the one or more heat sinks 230' is heated. The TECs 220' thereby cool the inner wall 126A' and thereby cools the chamber 126' and the contents (e.g., tray 500 with containers (e.g., vials) 520 therein). Though not shown in the drawings, one or more sensors (e.g., temperature sensors) are in thermal communication with the inner wall 126A' and/or the chamber 126' and communicate information to the circuitry indicative of the sensed temperature. The circuitry operates one or more of the TECs 220' and one or more fans 280' based at least in part on the sensed temperature information to cool the chamber 126' to the predetermined temperature and/or user selected temperature. The circuitry operates the one or more fans 280' to flow air (e.g., received via the intake vents 203') over the one or more heat sinks 230' to dissipate heat therefrom, thereby allowing the one or more heat sinks 230' to draw more heat from the one or more TECs 220', which in turn allows the one or more TECs 220' to draw more heat from (i.e., cool) the inner wall 126A' to thereby further cool the chamber 126'. Said air flow, once it passes over the one or more heat sinks 230', is exhausted from the body 120' via the exhaust vents 205'.

Figure 32:
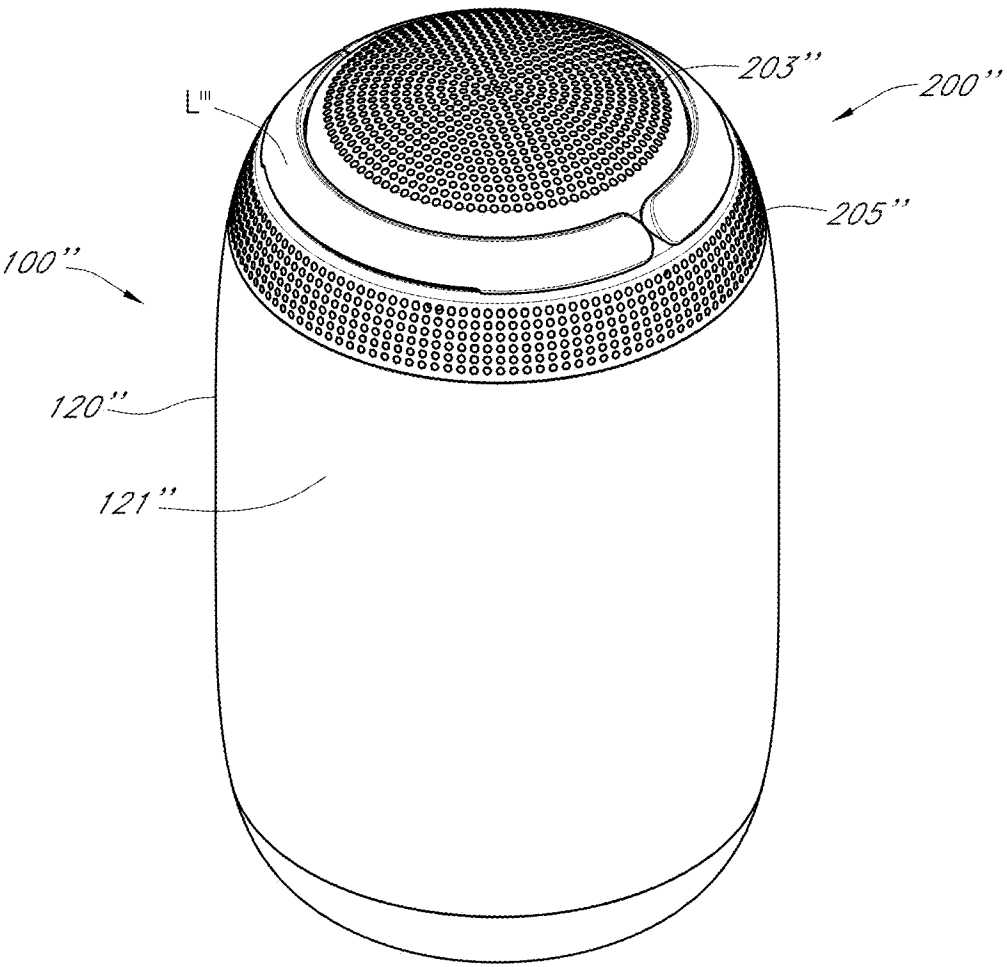
FIG. 32 is a schematic perspective view of another embodiment of a cooler container.
Figure 33B:
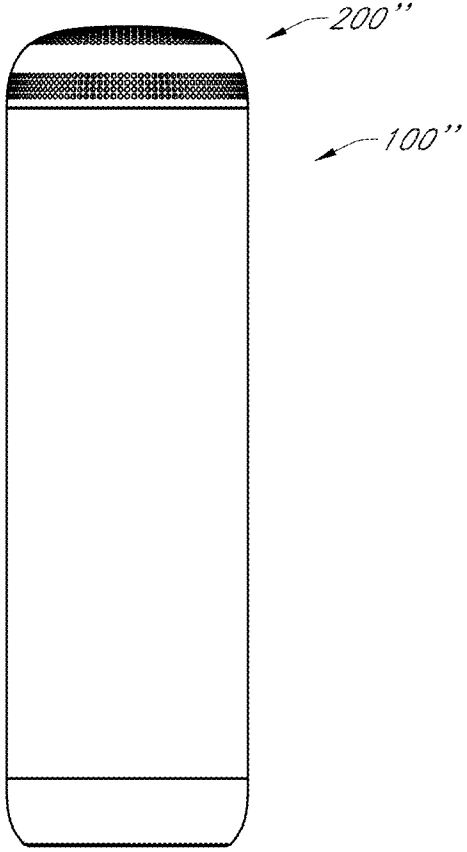
FIGS. 33A-33B are schematic side views of various containers of different sizes.
Figure 33A:
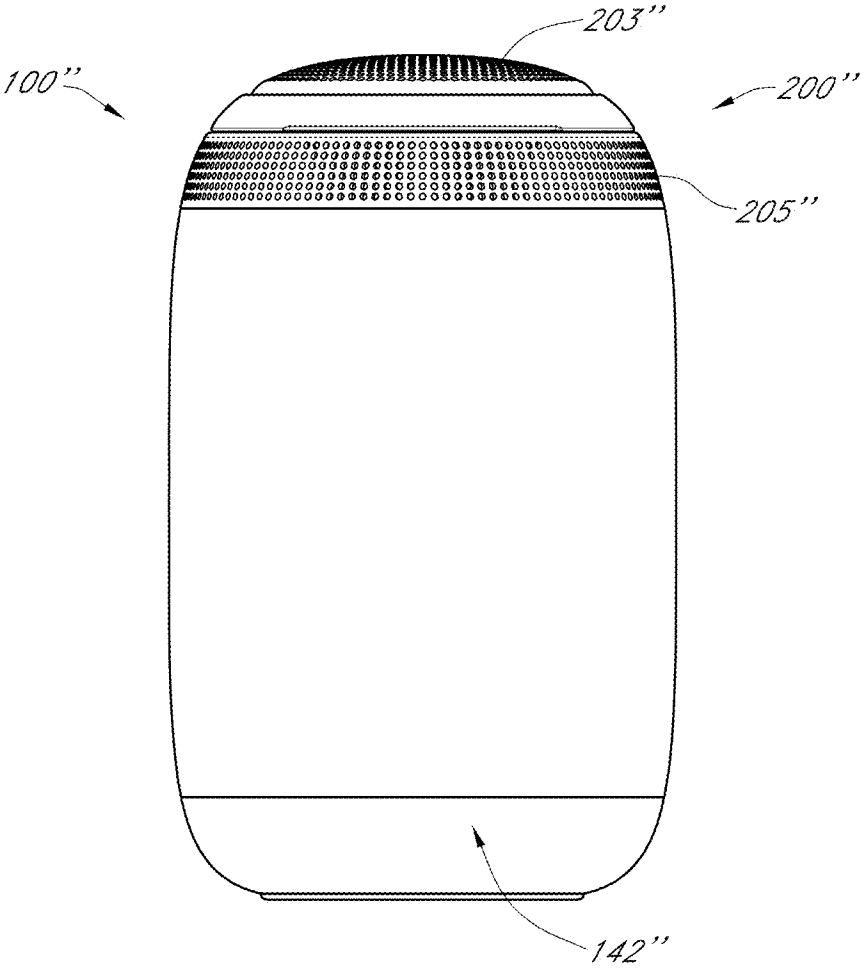
Figure 34:
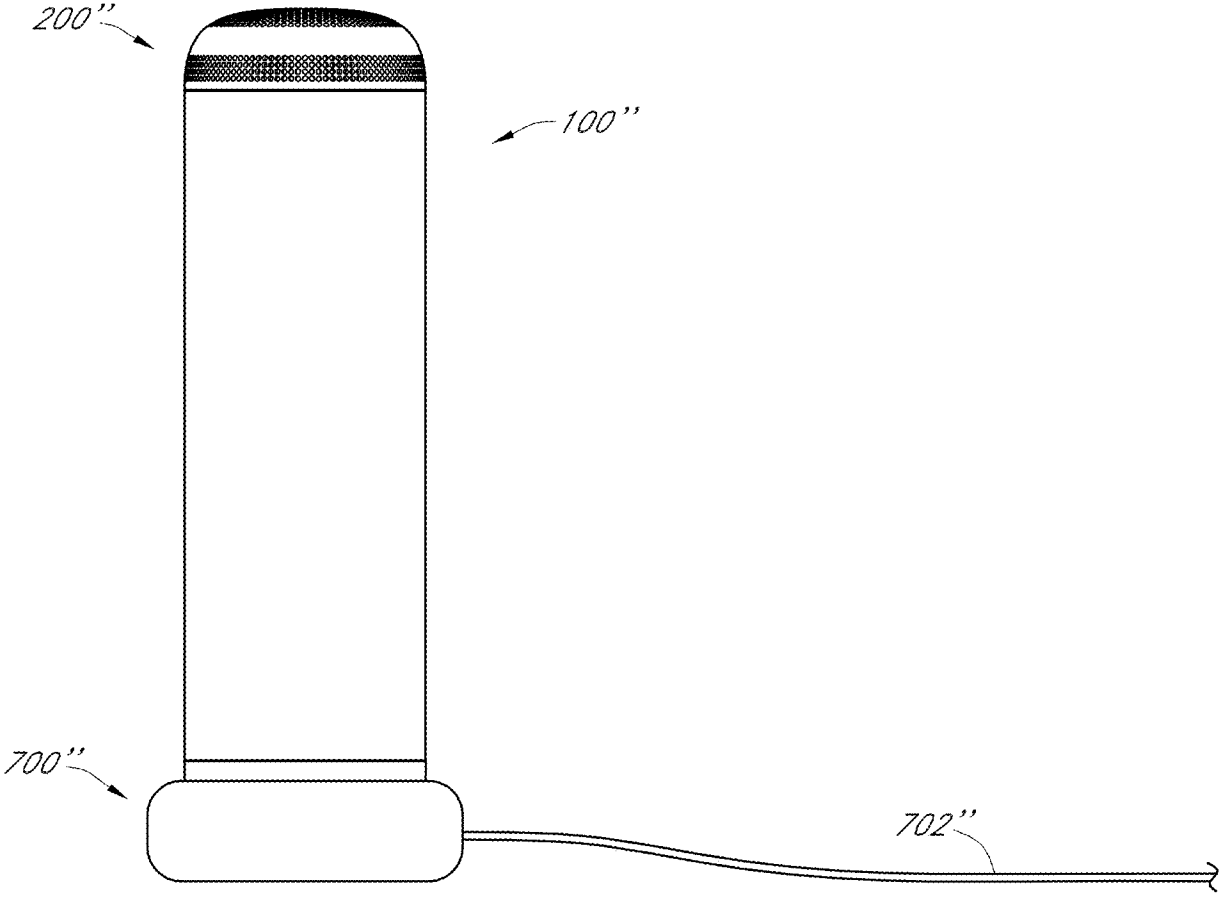
FIG. 34 is a schematic view a container disposed on a power base.
Figure 37:
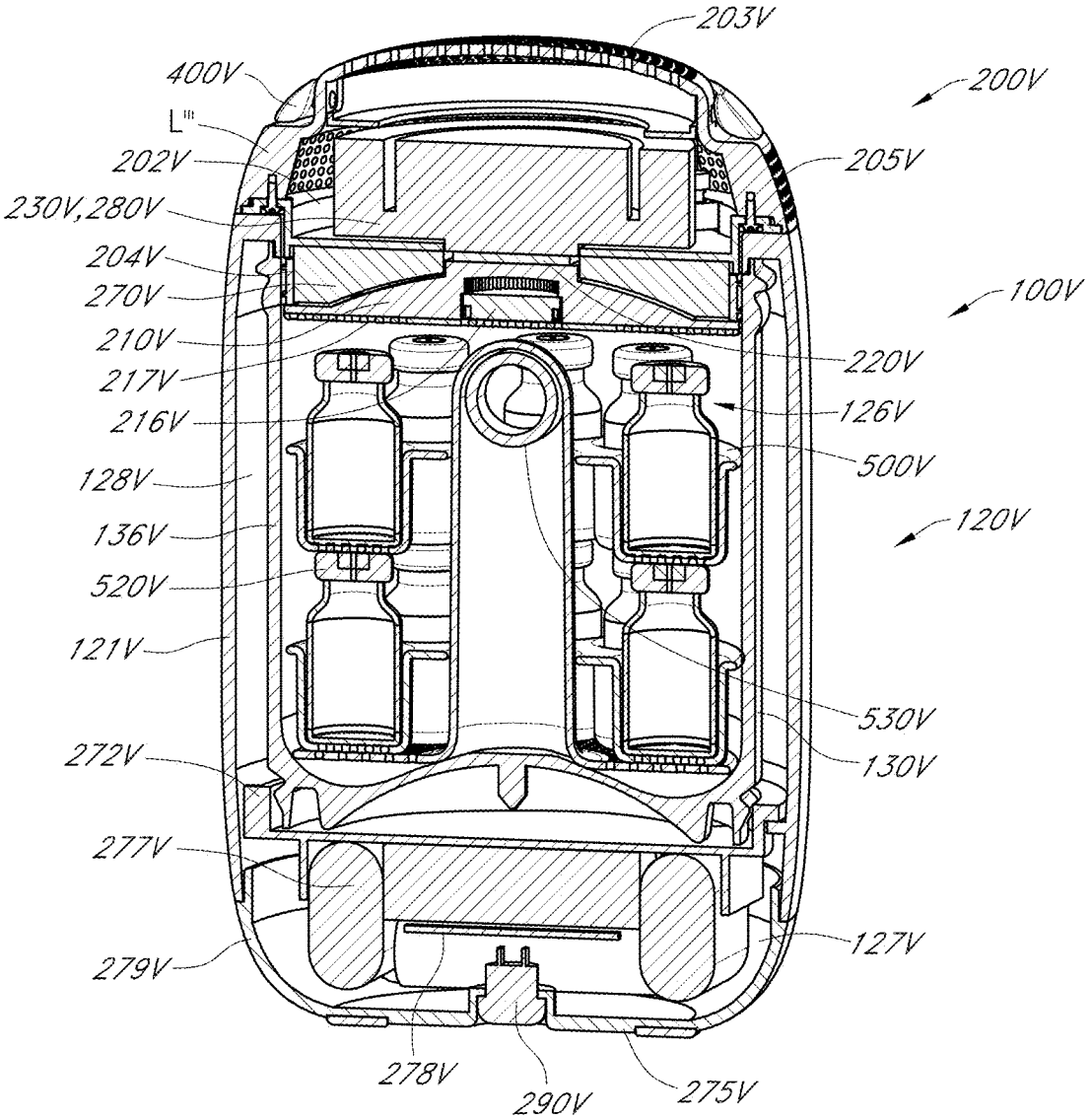
FIG. 37 is a schematic cross-sectional view of the cooler container of FIG. 32.
Figure 38:
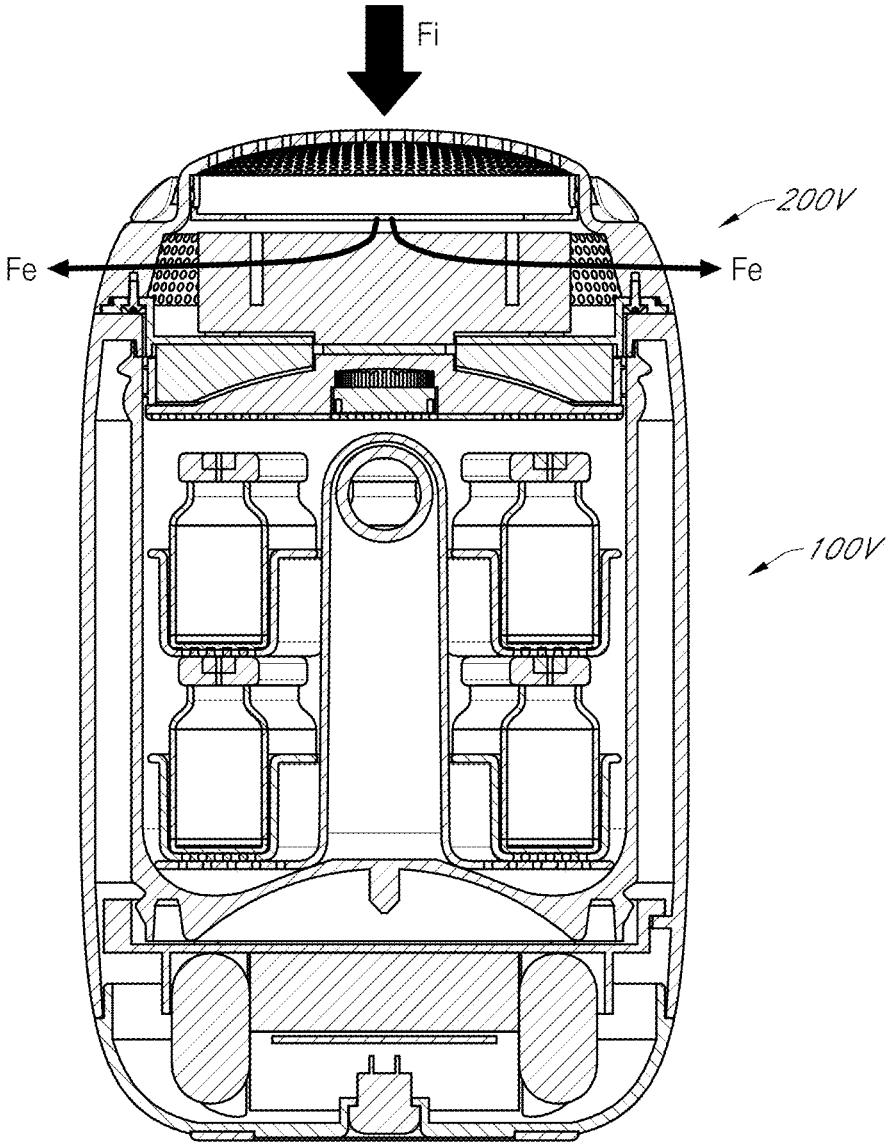
FIG. 38 is a schematic cross-sectional view of the cooler container of FIG. 37 with one fan in operation.
Figure 39:
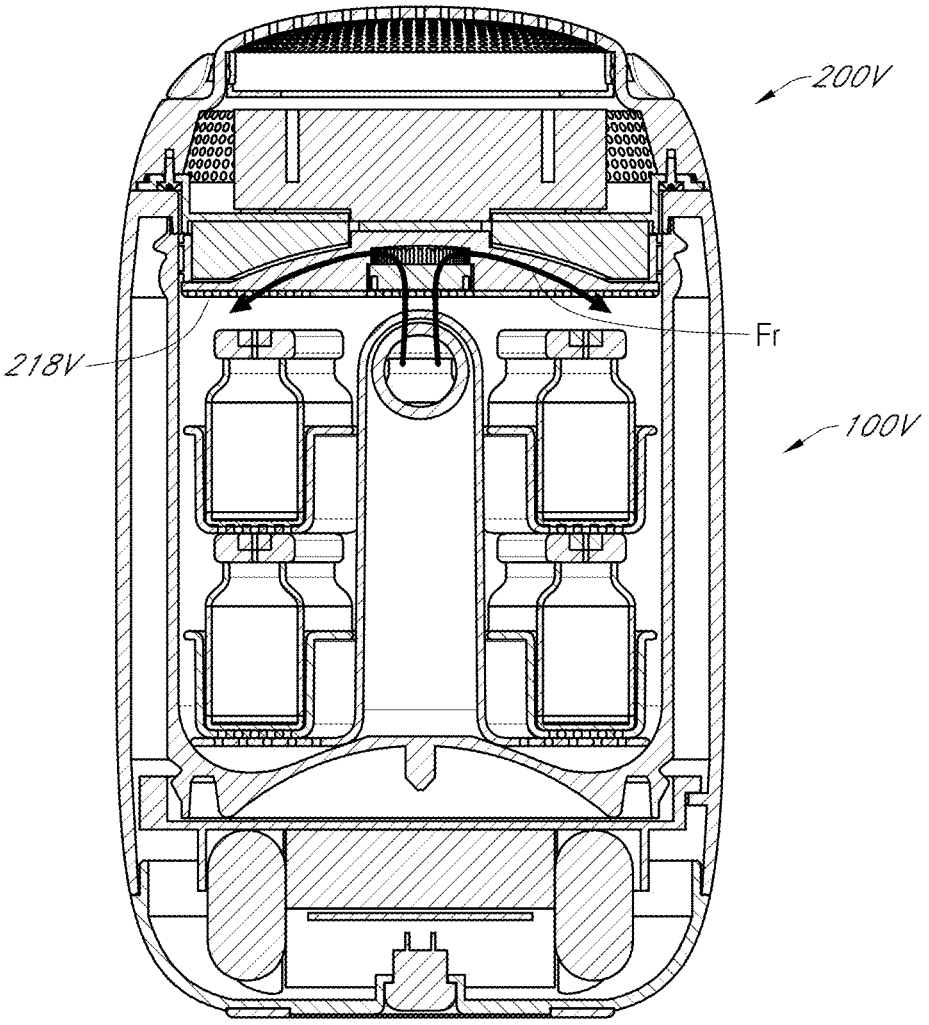
FIG. 39 is a schematic cross-sectional view of the cooler container of FIG. 37 with another fan in operation.

FIGS. 32-34 schematically illustrate a container 100" that includes a cooling system 200". The container system 100"

can include a vessel body 120 removably sealed by a lid L'". Some of the features of the container 100" and cooling system 200" are similar to the features of the container 100' and cooling system 200' in FIGS. 20-31. Thus, reference numerals used to designate the various components of the container 100" and cooling system 200" are similar to those used for identifying the corresponding components of the cooling system 200' in FIGS. 20-31, except that an "" "is used. Therefore, the structure and description for said components of the cooling system 200' of FIGS. 20-31 are understood to also apply to the corresponding components of the container 100" and cooling system 200" in FIGS. 32-34, except as described below. FIG. 33A is a front view of the container 100" in FIG. 32. FIG. 33B is a smaller version of the container 100" and optionally has the same internal components as shown for the container in FIG. 33A (e.g., as shown in FIGS. 37-39).

With reference to FIGS. 32-34, the container 100" differs from the container 100' in that the container 100" has a generally cylindrical or tube-like body 120" with a generally cylindrical outer surface 121". The container 100" can have similar internal components as the container 100', such as a chamber 126" defined by an inner wall 126A", TEC 220", heat sink 230", one or more fans 280", one or more optional batteries 277', converter 279" and power button 290". The lid L'" can have one or more vents 203", 205" defined therein, and operate in a similar manner as the vents 203', 205' described above. The container 100" can have a variety of sizes (see FIG. 35) that can accommodate a different number and/or size of containers 520". The container 100" and cooling system 200" operate in a similar manner described above for the container 100' and cooling system 200'.

The container 100" can optionally include a display similar to the display 140' described above for the container 100' (e.g., that displays one or more of the temperature in the chamber 126", the ambient temperature, a charge level or percentage for the one or more batteries 277", and amount of time left before recharging of the batteries 277" is needed). The container 100" can optionally include a hidden-til-lit LED 142" (see FIG. 36) that can selectively illuminate (e.g., to indicate one or more operating functions of the container 100", such as to indicate that the cooling system 200' is in operation). The LED 142" can optionally be a multi-color LED selectively operable to indicate one or more operating conditions of the container 100" (e.g., green if normal operation, red if abnormal operation, such as low battery charge or inadequate cooling for sensed ambient temperature, etc.).

With reference to FIG. 34, the container 100" can be removably placed on a base 700", which can connect to a power source (e.g., wall outlet) via a cable 702". In one implementation, the base 700" directly powers the cooling system 200" of the container 100" (e.g., to cool the contents in the container 100") to the desired temperature (e.g., the temperature required by the medication, such as insulin, in the chamber 126" of the container 100"). In another implementation, the base 700" can additionally or alternatively charge the one or more optional batteries 277", so that the batteries 277" take over powering of the cooling system 200" when the container 100" is removed from the base 700". Optionally, the vessel 120" of the container system 100" can have one or more electrical contacts EC1 (e.g., contact rings) that communicate with one or more electrical contacts EC2 (e.g., pogo pins) of the base 700" when the vessel 120" is placed on the base 700". In another implementation, the base 700" can transfer power to the vessel 120" of the container system 100" via inductive coupling (e.g., electromagnetic induction).

Figure 35A:
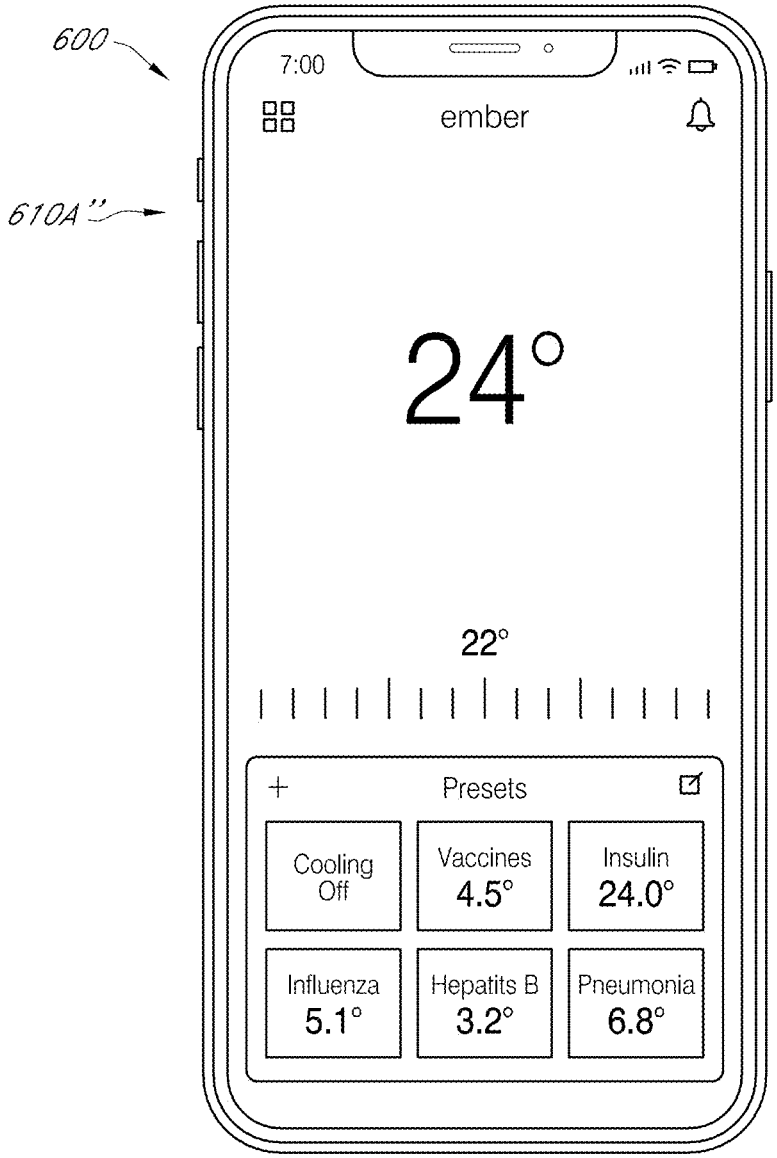
FIGS. 35A-35C are schematic views of a graphical user interface for use with the container.
Figure 35B:
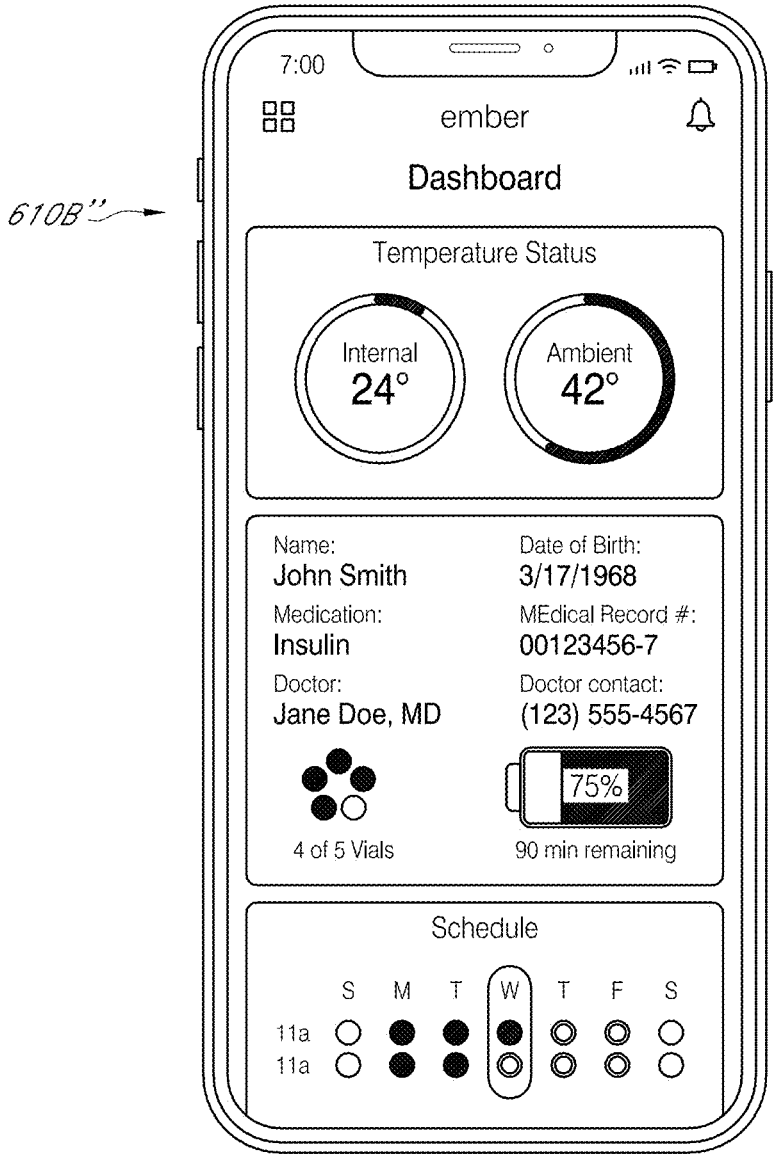
Figure 35C:
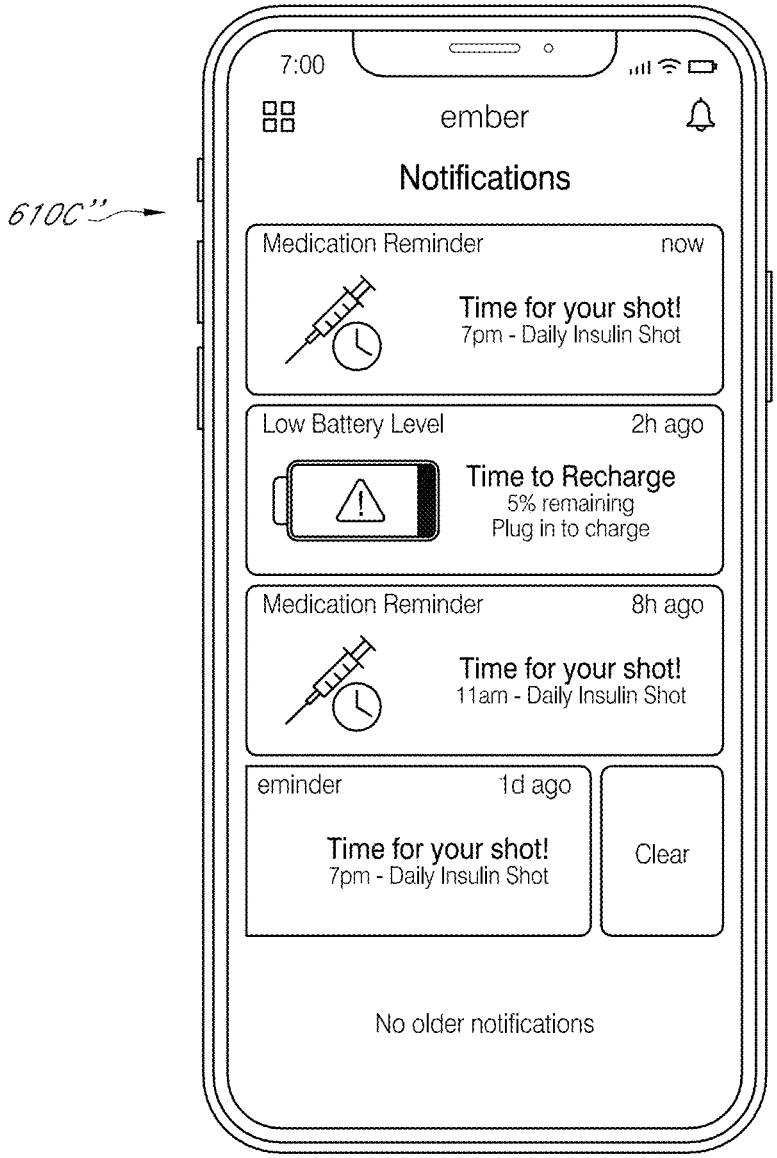

With reference to FIGS. 35A-35C, the container 100" can optionally communicate (e.g., one-way communication, two-way communication) with one or more remote electronic device (e.g., mobile phone, tablet computer, desktop computer) 600, via one or both of a wired or wireless connection. Optionally, the container 100" can communicate with the remote electronic device 600 via an app (mobile application software) that is optionally downloaded (e.g., from the cloud) onto the remote electronic device 600. The app can provide one or more graphical user interface screens 610A", 610B", 610C" via which the remote electronic device 600 can display one or more data received from the container 100". Optionally, a user can provide instructions to the container 100" via one or more of the graphical user interface screens 610A", 610B", 610C" on the remote electronic device 600.

In one implementation, the graphical user interface (GUI) screen 610A" can provide one or more temperature presets corresponding to one or more particular medications (e.g., insulin). The GUI 610A" can optionally allow the turning on and off of the cooling system 200". The GUI 610A" can optionally allow the setting of the control temperature to which the chamber 126" in the container 100" is cooled by the cooling system 200".

In another implementation, the graphical user interface (GUI) screen 610B" can provide a dashboard display of one or more parameters of the container 100" (e.g., ambient temperature, internal temperature in the chamber 126", etc.). The GUI screen 610B" can optionally provide an indication (e.g., display) of power supply left in the one or more batteries 277" (e.g., % of life left, time remaining before battery power drains completely). Optionally, the GUI screen 610B" can also include information (e.g., a display) of how many of the receptacles 510" in the tray 500" are occupied (e.g., by containers 520"). Optionally, the GUI screen 610B" can also include information on the contents of the container 100' (e.g., medication type or disease medication is meant to treat), information on the physician (e.g., name of doctor and contact phone no) and/or information (e.g., name, date of birth, medical record no.) for the individual assigned to the container 100".

In another implementation, the GUI screen 610C" can include a list of notifications provided to the user of the container 100", including alerts on battery power available, alerts on ambient temperature effect on operation of container 100", etc. One of skill in the art will recognize that the app can provide the plurality of GUI screens 610A", 610B", 610C" to the user, allowing the user to swipe between the different screens. Optionally, as discussed further below, the container 100" can communicate information, such as temperature history of the chamber 126", power level history of the batteries 277", ambient temperature history, etc. to the cloud (e.g., on a periodic basis, such as every hour; on a continuous basis in real time, etc.).

In some implementations, the container system 100, 100', 100", 100B-100X can include one or both of a radiofrequency identification (RFID) reader and a barcode reader. For example, the RFID reader and/or barcode reader can be disposed proximate (e.g., around) a rim of the chamber 126, 126', 126" to that it can read content units (e.g., vials, containers) placed into or removed from the chamber 126, 126', 126". The RFID reader or barcode reader can communicate data to the circuitry in the container system, which as discussed above, can optionally store such data in a memory or the container system and/or communicate such data to a separate or remote computing system, such as a remote computer server (e.g., accessible by a doctor treating the patient with the medication in the container), a mobile electronic device, such as a mobile phone or tablet computer. Such communication can optionally be in one or both of a wired manner (via a connector on the container body) or wireless manner (via a transmitter or transceiver of the container in communication with the circuitry of the container). Each of the contents placed in the chamber of the container (e.g., each medicine unit, such as each vial or container) optionally has an RFID tag or barcode that is read by the RFID reader or barcode reader as it is placed in and/or removed from the chamber of the container, thereby allowing the tracking of the contents of the container system 100, 100', 100", 100B-100X. Optionally, the container system (e.g., the RFID reader, barcode reader and/or circuitry) of the container system, send a notification (e.g., to a remote computer server, to one or more computing systems, to a mobile electronic device such as a smartphone or tablet computer or laptop computer or desktop computer) every time a medicine unit (e.g., vial, container) is placed into and/or removed from the chamber of the container system 100, 100', 100", 100B-100X.

In some implementations, the container system 100, 100', 100", 100B-100X can additionally or alternatively (to the RFID reader and/or barcode reader) include a proximity sensor, for example in the chamber 126, 126', 126" to advantageously track one or both of the insertion of and removal of content units (e.g., medicine units such as vials, containers, pills, etc.) from the container system. Such a proximity sensor can communication with the circuitry of the container and advantageously facilitate tracking, for example, of the user taking medication in the container, or the frequency with which the user takes the medication. Optionally, operation of the proximity sensor can be triggered by a signal indicating the lid L, L', L" has been opened. The proximity sensor can communicate data to the circuitry in the container system, which as discussed above, can optionally store such data in a memory or the container system and/or communicate such data to a separate or remote computing system, such as a remote computer server (e.g., accessible by a doctor treating the patient with the medication in the container), a mobile electronic device, such as a mobile phone or tablet computer. Such communication can optionally be in one or both of a wired manner (via a connector on the container body) or wireless manner (via a transmitter or transceiver of the container in communication with the circuitry of the container).

In some implementations, the container system 100, 100', 100", 100B-100X can additionally or alternatively (to the RFID reader and/or barcode reader) include a weight sensor, for example in the chamber 126, 126', 126" to advantageously track the removal of content units (e.g. medicine units such as vials, containers, pills, etc.) from the container system. Such a weight sensor can communicate with the circuitry of the container and advantageously facilitate tracking, for example, of the user taking medication in the container, or the frequency with which the user takes the medication. Optionally, operation of the weight sensor can be triggered by a signal indicating the lid L, L', L" has been opened. The weight sensor can communicate data to the circuitry in the container system, which as discussed above, can optionally store such data in a memory or the container system and/or communicate such data to a separate or remote computing system, such as a remote computer server (e.g., accessible by a doctor treating the patient with the medication in the container), a mobile electronic device, such as a mobile phone or tablet computer. Such communication can optionally be in one or both of a wired manner (via a connector on the container body) or wireless manner (via a transmitter or transceiver of the container in communication with the circuitry of the container).

Figure 36:
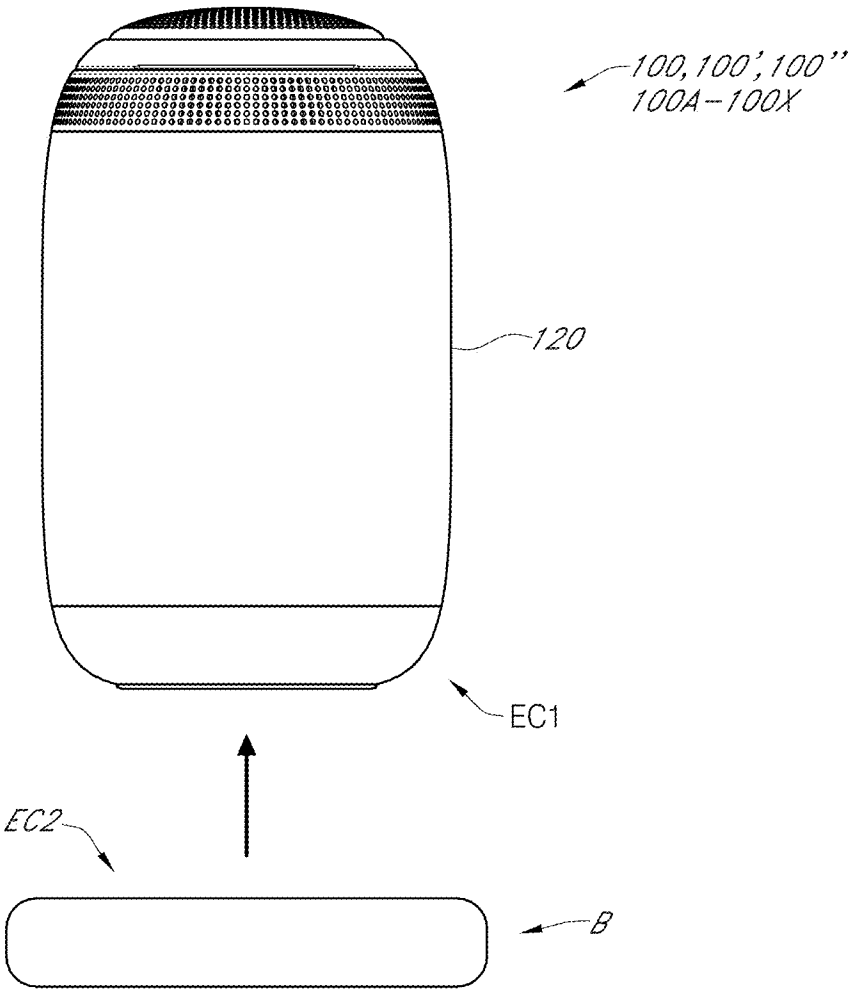
FIG. 36 is a schematic view of another embodiment of a cooler container.

FIG. 36 shows a container system, such as the container systems 100, 100', 100", 100A-100X described herein, removably connectable to a battery pack B (e.g., a Dewalt battery pack), which can provide power to one or more electrical components (e.g., TEC, fan, circuitry, etc.) of the container systems or the cooling systems 200, 200', 200", 200A-200T. Optionally, the vessel 120 of the container system can have one or more electrical contacts EC1 (e.g., contact rings) that communicate with one or more electrical contacts EC2 (e.g., pogo pins) when the vessel 120 is placed on the battery pack B. In another implementation, the battery pack B can transfer power to the vessel 120 of the container system via inductive coupling (e.g., electromagnetic induction).

FIGS. 37-39 show a schematic cross-sectional view of a container system 100V that includes a cooling system 200V. Optionally, the container system 100V has a container vessel 120V that is optionally cylindrical and symmetrical about a longitudinal axis, and one of ordinary skill in the art will recognize that at least some of the features shown in cross-section in FIGS. 37-39 are defined by rotating them about the axis to define the features of the container 100V and cooling system 200V. Some of the features of the cooling system 200V, which optionally serves as part of the lid L"' that selectively seals the vessel 120V, are similar to features in the cooling system 200M in FIGS. 13A-13B. Thus, references numerals used to designate the various components of the cooling system 200V are similar to those used for identifying the corresponding components of the cooling system 200M in FIGS. 13A-13B, except that an "V" is used. Therefore, the structure and description for said similar components of the cooling system 200M in FIGS. 13A-13B are understood to also apply to the corresponding components of the cooling system 200V in FIGS. 37-39, except as described below.

With reference to FIGS. 37-39, the cooling system 200V can include a heat sink (cold side heat sink) 210V in thermal communication with a thermoelectric element (TEC) 220V and can be in thermal communication with the chamber 126V of the vessel 120V. Optionally, the cooling system 200V can include a fan 216V selectively operable to draw air from the chamber 126V into contact with the cold side heat sink 210V. Optionally, cooling system 200V can include an insulator member 270V disposed between the heat sink 210V and an optional lid top plate 202V, where the lid top plate 202V is disposed between the heat sink (hot side heat sink) 230V and the insulator 270V, the insulator 270V disposed about the TEC 220V. As shown in FIG. 42, air flow Fr is drawn by the fan 216V from the chamber 126V and into contact with the heat sink (cold side heat sink) 210V (e.g., to cool the air flow Fr), and then returned to the chamber 126V. Optionally, the air flow Fr is returned via one or more openings 218V in a cover plate 217V located distally of the heat sink 210V and fan 216V.

With continued reference to FIGS. 37-39, the TEC 220V is selectively operated to draw heat from the heat sink (e.g., cold-side heat sink) 210V and transfer it to the heat sink (hot-side heat sink) 230V. A fan 280V is selectively operable to dissipate heat from the heat sink 230V, thereby allowing the TEC 220V to draw further heat from the chamber 126V via the heat sink 210V. As show in FIG. 40, during operation of the fan 280V, intake air flow Fi is drawn through one or more openings 203V in the lid cover L''' and over the heat sink 230V (where the air flow removes heat from the heat sink 230V), after which the exhaust air flow Fe flows out of one or more openings 205V in the lid cover L'''. Optionally, both the fan 280V and the fan 216V are operated simultaneously. In another implementation, the fan 280V and the fan 216V are operated at different times (e.g., so that operation of the fan 216V does not overlap with operation of the fan 280V).

As shown in FIGS. 37-39, the chamber 126V optionally receives and holds one or more (e.g., a plurality of) trays 500V, each tray 500V supporting one or more (e.g., a plurality of) liquid containers 520V (e.g., vials, such as vaccines, medications, etc.). The lid L''' can have a handle 400V used to remove the lid L''' from the vessel 120V to remove contents from the chamber 126V or place contents in the chamber 126V (e.g., remove the trays 500 via handle 530V). The lid L''' can have a sealing gasket G, such as disposed circumferentially about the insulator 270V to seal the lid L''' against the chamber 126V. The inner wall 136V of the vessel 120V is spaced from the outer wall 121V to define a gap (e.g., an annular gap) 128V therebetween. Optionally, the gap 128V can be under vacuum. Optionally, the inner wall 136V defines at least a portion of an inner vessel 130V. Optionally, the inner vessel 130V is disposed on a bottom plate 272V.

The bottom plate 272V can be spaced from a bottom 275V of the vessel 120V to define a cavity 127V therebetween. The cavity 127V can optionally house one or more batteries 277V, a printed circuit board (PCBA) 278V and at least partially house a power button or switch 290V. Optionally, the bottom 275V defines at least a portion of an end cap 279V attached to the outer wall 121V. Optionally, the end cap 279V is removable to access the electronics in the cavity 127V (e.g., to replace the one or more batteries 277V, perform maintenance on the electronics, such as the PCBA 278V, etc.). The power button or switch 290V is accessible by a user (e.g., can be pressed to turn on the cooling system 200V, pressed to turn off the cooling system 200V, pressed to pair the cooling system 200V with a mobile electronic device, etc.). As shown in FIG. 37, the power switch 290V can be located generally at the center of the end cap 279V (e.g., so that it aligns/extends along the longitudinal axis of the vessel 120V).

The electronics (e.g., PCBA 278V, batteries 277V) can electrically communicate with the fans 280V, 216V and TEC 220V in the lid L''' via one or more electrical contacts (e.g., electrical contact pads, Pogo pins) in the lid L''' that contact one or more electrical contacts (e.g., Pogo pins, electrical contact pads) in the portion of the vessel 120V that engages the lid L''', such as in a similar manner to that described above for FIG. 18D.

Figure 40:
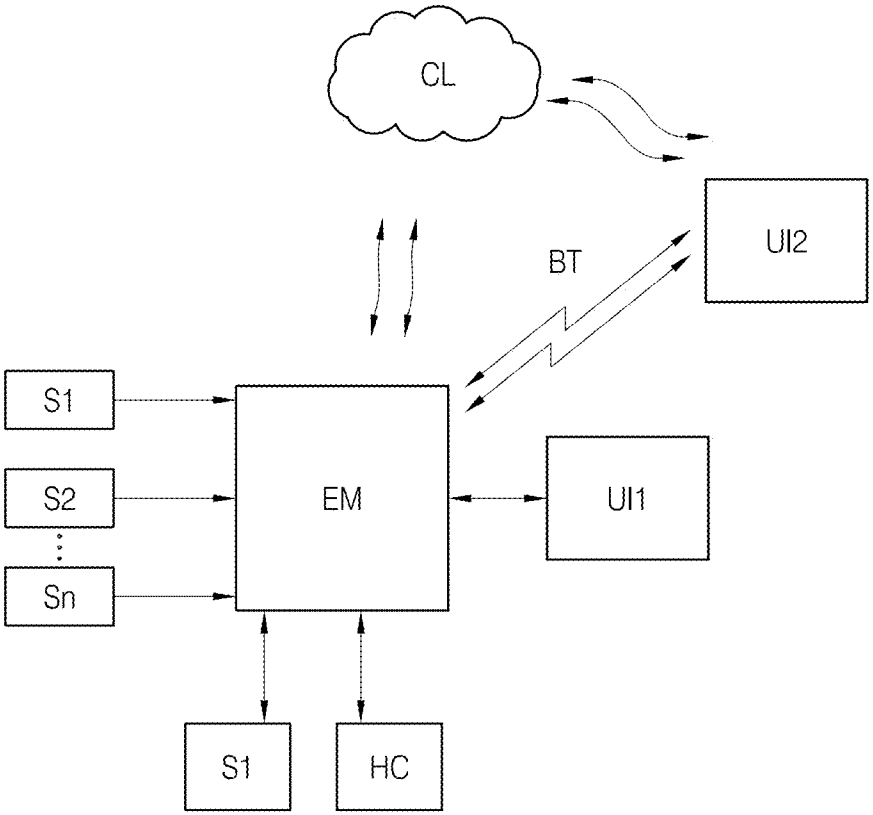
FIG. 40 is a schematic block diagram showing communication between the cooler container and a remote electronic device.

FIG. 40 shows a block diagram of a communication system for (e.g., incorporated into) the devices described herein (e.g., the one or more container systems 100, 100', 100'', 100A-100X). In the illustrated embodiment, circuitry EM can receive sensed information from one or more sensors S1-Sn (e.g., level sensors, volume sensors, temperature sensors, battery charge sensors, biometric sensors, load sensors, Global Positioning System or GPS sensors, radiofrequency identification or RFID reader, etc.). The circuitry EM can be housed in the container, such as in the vessel 120 (e.g., bottom of vessel 120, side of vessel 120, as discussed above) or in a lid L of the container. The circuitry 120 can receive information from and/or transmit information (e.g., instructions) to one or more heating or cooling elements HC, such as the TEC 220, 220', 220A-220X (e.g., to operate each of the heating or cooling elements in a heating mode and/or in a cooling mode, turn off, turn on, vary power output of, etc.) and optionally to one or more power storage devices PS (e.g., batteries, such as to charge the batteries or manage the power provided by the batteries to the one or more heating or cooling elements).

Optionally, the circuitry EM can include a wireless transmitter, receiver and/or transceiver to communicate with (e.g., transmit information, such as sensed temperature and/or position data, to and receive information, such as user instructions, from one or more of: a) a user interface UI1 on the unit (e.g., on the body of the vessel 120), b) an electronic device ED (e.g., a mobile electronic device such as a mobile phone, PDA, tablet computer, laptop computer, electronic watch, a desktop computer, remote server), c) via the cloud CL, or d) via a wireless communication system such as WiFi and/or Bluetooth BT. The electronic device ED can have a user interface UI2, that can display information associated with the operation of the container system (such as the interfaces disclosed above, see FIGS. 31A-31C, 38A-38C), and that can receive information (e.g., instructions) from a user and communicate said information to the container system 100, 100', 100'', 100A-100X (e.g., to adjust an operation of the cooling system 200, 200', 200'', 200A-200X).

In operation, the container system can operate to maintain the chamber 126 of the vessel 120 at a preselected temperature or a user selected temperature. The cooling system can operate the one or more TECs to cool the chamber 126 (e.g., if the temperature of the chamber is above the preselected temperature, such as when the ambient temperature is above the preselected temperature) or to heat the chamber 126 (e.g., if the temperature of the chamber 126 is below the preselected temperature, such as when the ambient temperature is below the preselected temperature). The preselected temperature may be tailored to the contents of the container (e.g., a specific medication, a specific vaccine), and can be stored in a memory of the container, and the cooling system or heating system, depending on how the temperature control system is operated, can operate the TEC to approach the preselected or set point temperature.

Optionally, the circuitry EM can communicate (e.g., wirelessly) information to a remote location (e.g., cloud-based data storage system, remote computer, remote server, mobile electronic device such as a smartphone or tablet computer or laptop or desktop computer) and/or to the individual carrying the container (e.g., via their mobile phone, via a visual interface on the container, etc.), such as a temperature history of the chamber 126 to provide a record that can be used to evaluate the efficacy of the medication in the container and/or alerts on the status of the medication in the container. Optionally, the temperature control system (e.g., cooling system, heating system) automatically operates the TEC to heat or cool the chamber 126 of the vessel 120 to approach the preselected temperature. In one implementation, the cooling system 200, 200', 200'', 200B-200X can cool and maintain one or both of the chamber 126, 126', 126V and the containers 520, 520V at or below 15 degrees Celsius, such as at or below 10 degrees Celsius, in some examples at approximately 5 degrees Celsius.

In one implementation, the one or more sensors S1-Sn can include one more air flow sensors in the lid L that can monitor airflow through one or both of the intake vent 203', 203'', 203V and exhaust vent 205', 205'', 205V. If said one or more flow sensors senses that the intake vent 203', 203'', 203V is becoming clogged (e.g., with dust) due to a decrease in air flow, the circuitry EM (e.g., on the PCBA 278V) can optionally reverse the operation of the fan 280, 280', 280B-280P, 280V for one or more predetermined periods of time to draw air through the exhaust vent 205', 205", 205V and exhaust air through the intake vent 203', 203", 203V to clear (e.g., unclog, remove the dust from) the intake vent 203', 203", 203V. In another implementation, the circuitry EM can additionally or alternatively send an alert to the user (e.g., via a user interface on the container 100, 100', 100", 100B-100X, wirelessly to a remote electronic device such as the user's mobile phone via GUI 610A-610C, 610A'-610C') to inform the user of the potential clogging of the intake vent 203', 203", 203V, so that the user can inspect the container 100, 100', 100", 100B-100X and can instruct the circuitry EM (e.g., via an app on the user's mobile phone) to run an "cleaning" operation, for example, by running the fan 280, 280', 280B-280P, 280V in reverse to exhaust air through the intake vent 203', 203", 203V.

In one implementation, the one or more sensors S1-Sn can include one more Global Positioning System (GPS) sensors for tracking the location of the container system 100, 100', 100", 100B-100X. The location information can be communicated, as discussed above, by a transmitter and/or transceiver associated with the circuitry EM to a remote location (e.g., a mobile electronic device, a cloud-based data storage system, etc.).

Figure 41A:
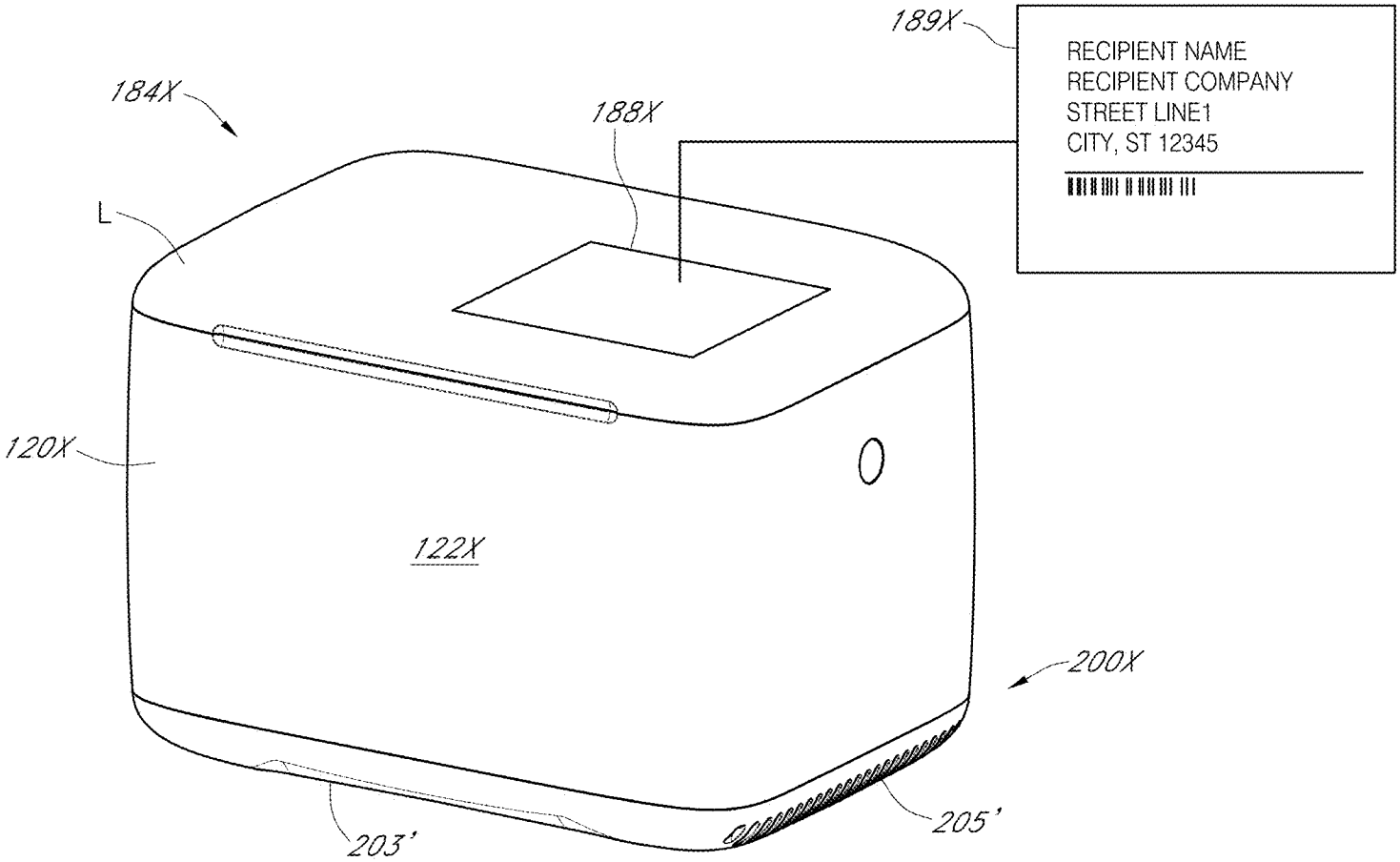
FIG. 41A shows a schematic perspective view of a cooler container.

FIG. 41A shows a container system 100X (e.g., a medicine cooler container) that includes a cooling system 200X. Though the container system 100X has a generally box shape, in other implementations it can have a generally cylindrical or tube shape, similar to the container system 100, 100", 100B, 100C, 100D, 100E, 100F, 100G, 100H, 100I, 100J, 100K, 100K', 100L, 100L', 100M, 100N, 100P, 100Q, 100R, 100T, 100U, 100V, or the features disclosed below for container system 100X can be incorporated into the generally cylindrical or tube shaped containers noted above. In other implementations, the features disclosed below for container system 100X can be incorporated into containers 100' disclosed above. In one implementation, the cooling system 200X can be in the lid L of the container system 100X and can be similar to (e.g., have the same or similar components as) the cooling system 200, 200", 200B, 200B', 200C, 200D, 200E, 200F, 200G, 200H, 200I, 200J, 200K, 200K', 200L, 200L', 200M, 200N, 200P, 200Q, 200R, 200S, 200T, 200V described above. In another implementation, the cooling system can be disposed in a portion of the container vessel 120X (e.g. a bottom portion of the container vessel 120X, similar to cooling system 200' in vessel 120' described above).

As shown in FIG. 41A, the container system 100X can include a display screen 188X. Though FIG. 41A shows the display screen 188X on the lid L, it can alternatively (or additionally) be incorporated into a side surface 122X of the container vessel 120X. The display screen 188X can optionally be an electronic ink or E-ink display (e.g., electrophoretic ink display). In another implementation, the display screen 188X can be a digital display (e.g., liquid crystal display or LCD, light emitting diode or LED, etc.). Optionally, the display screen 188X can display a label 189X (e.g., a shipping label with one or more of an address of sender, an address of recipient, a Maxi Code machine readable symbol, a QR code, a routing code, a barcode, and a tracking number), but can optionally additionally or alternatively display other information (e.g., temperature history information, information on the contents of the container system 100X). The container system 100X can optionally also include a user interface 184X. In FIG. 43A, the user interface 184X is a button on the lid L. In another implementation, the user interface 184X is disposed on the side surface 122X of the container vessel 120X. In one implementation, the user interface 184X is a depressible button. In another implementation, the user interface 184X is a capacitive sensor (e.g., touch sensitive sensor). In another implementation, the user interface 184X is a sliding switch (e.g., sliding lever). In another implementation, the user interface 184X is a rotatable dial. In still another implementation, the user interface 184X can be a touch screen portion (e.g., separate from or incorporated as part of the display screen 188X). Advantageously, actuation of the user interface 184X can alter the information shown on the display 188X, such as the form of a shipping label shown on an E-ink display 188X. For example, actuation of the user interface 184X, can switch the text associated with the sender and receiver, allowing the container system 100X to be shipped back to the sender once the receiving party is done with it.

Figure 41B:
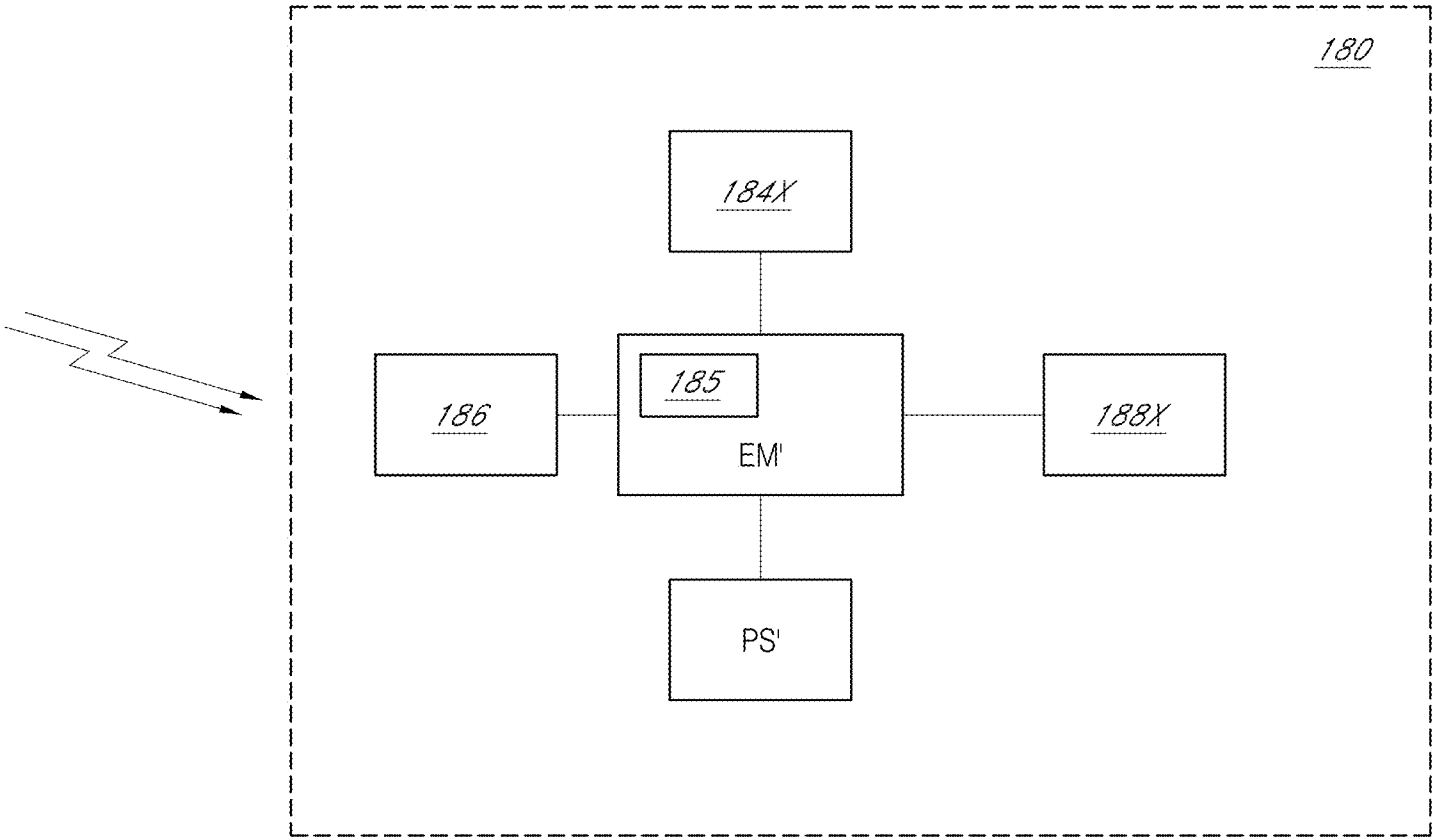
FIG. 41B is a is a schematic block diagram showing electronics in the cooler container associated with operation of the display screen of the cooler container.

FIG. 41B shows a block diagram of electronics 180 of the container system 100X. The electronics 180 can include circuitry EM' (e.g., including one or more processors on a printed circuit board). The circuitry EM' communicate with one or more batteries PS', with the display screen 188X, and with the user interface 184X. Optionally, a memory module 185X is in communication with the circuitry EM'. In one implementation, the memory module 185X can optionally be disposed on the same printed circuit board as other components of the circuitry EM'. The circuitry EM' optionally controls the information displayed on the display screen 188X. Information (e.g., sender address, recipient address, etc.) can be communicated to the circuitry EM' via an input module 186X. The input module 186X can receive such information wirelessly (e.g., via radiofrequency or RF communication, via infrared or IR communication, via WiFi 802.11, via BLUETOOTH®, etc.), such as using a wand (e.g., a radiofrequency or RF wand that is waved over the container system 100X, such as over the display screen 188X, where the wand is connected to a computer system where the shipping information is contained). Once received by the input module 186X, the information (e.g., shipping information for a shipping label to be displayed on the display screen 188X can be electronically saved in the memory module 185X). Advantageously, the one or more batteries PS' can power the electronics 180, and therefore the display screen 188X for a plurality of uses of the container 100X (e.g., during shipping of the container system 100X up to one-thousand times).

Figure 42A:
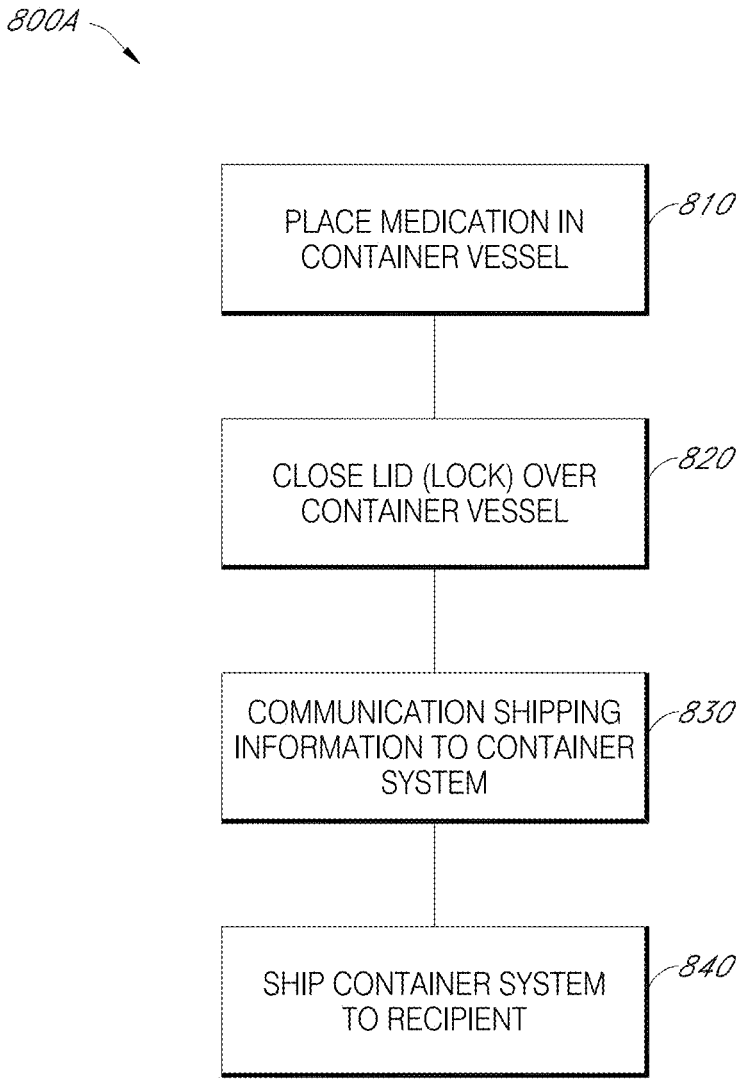
FIGS. 42A-42B show block diagrams of a method for operating the cooler container of FIG. 41A.

FIG. 42A shows a block diagram of one method 800A for shipping the container system 100X. At step 810, one or more containers, such as containers 520 (e.g., medicine containers, such as vials, cartridges (such as for injector pens), injector pens, vaccines, medicine such as insulin, epinephrine, etc.) are placed in the container vessel 120X of the container system 100X, such as at a distribution facility for the containers 520. At step 820, the lid L is closed over the container vessel 120X once finished loading all containers 520 into the container vessel 120X. Optionally, the lid L is locked to the container vessel 120X (e.g., via a magnetically actuated lock, including an electromagnet actuated when the lid is closed that can be turned off with a code, such as a digital code). At step 830, information (e.g., shipping label information) is communicated to the container system 100X. For example, as discussed above, a radiofrequency (RF) wand can be waved over the container system 100X (e.g., over the lid L) to transfer the shipping information to the input module 186X of the electronics 80 of the container system 100X. At step 840, the container system 100X is shipped to the recipient (e.g., displayed on the shipping label 189X on the display screen 188X).

Figure 42B:
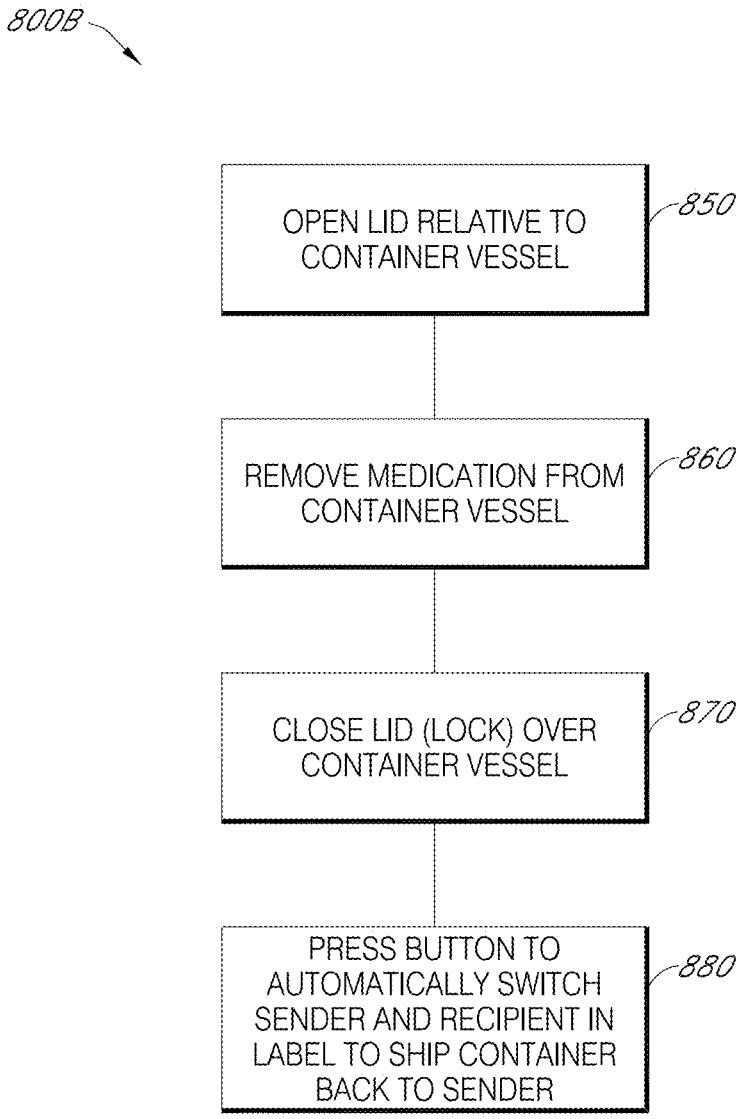

FIG. 42B shows a block diagram of a method 800B for returning the container 100X. At step 850, after receiving the container system 100X, the lid L can be opened relative to the container vessel 120X. Optionally, prior to opening the lid L, the lid L is unlocked relative to the container vessel 100X (e.g., using a code, such as a digital code, provided to the recipient from the shipper) via keypad and/or biometric identification (e.g., fingerprint on the container vessel, as discussed above with respect to FIG. 31). At step 860, the one or more containers 520 are removed from the container vessel 120X. At step 870, the lid L is closed over the container vessel 120X. At step 880, the user interface 184X (e.g., button) is actuated to switch the information of the sender and recipient in the display screen 188X with each other, advantageously allowing the return of the container system 100X to the original sender to be used again without having to reenter shipping information on the display screen 188X. The display screen 188X and label 189X advantageously facilitate the shipping of the container system 100X without having to print any separate labels for the container system 100X. Further, the display screen 188X and user interface 184X advantageously facilitate return of the container system 100X to the sender (e.g. without having to reenter shipping information, without having to print any labels), where the container system 100X can be reused to ship containers 520 (e.g., medicine containers, such as vials, cartridges (such as for injector pens), injector pens, vaccines, medicine such as insulin, epinephrine, etc.) again, such as to the same or a different recipient. The reuse of the container system 100K for delivery of perishable material (e.g., medicine) advantageously reduces the cost of shipping by allowing the reuse of the container vessel 120X (e.g., as compared to commonly used cardboard containers, which are disposed of after one use).

Additional Embodiments

In embodiments of the present invention, a portable cooler container with active temperature control, may be in accordance with any of the following clauses:

Clause 1. A portable cooler container with active temperature control, comprising:

- a container body having a chamber configured to receive and hold one or more containers of medicine;
- a lid removably coupleable to the container body to access the chamber; and
- a temperature control system comprising
  - one or more thermoelectric elements configured to actively heat or cool at least a portion of the chamber,
  - one or more batteries,
  - circuitry configured to control an operation of the one or more thermoelectric elements to heat or cool at least a portion of the chamber to a predetermined temperature or temperature range; and
  - a display screen disposed on one or both of the container body and the lid, the display screen configured to selectively display shipping information for the portable cooler container using electronic ink.

Clause 2. The portable cooler container any preceding clause, further comprising a button or touch screen actuatable by a user to automatically switch sender and recipient information on the display screen to facilitate return of the portable cooler container to a sender.

Clause 3. The portable cooler container of any preceding clause, wherein the body comprises an outer peripheral wall and a bottom portion attached to the outer peripheral wall, the inner peripheral wall being spaced relative to the outer peripheral wall to define a gap between the inner peripheral wall and the outer peripheral wall, the base spaced apart from the bottom portion to define a cavity between the base and the bottom portion, the one or more batteries and circuitry at least partially disposed in the cavity.

Clause 4. The portable cooler container of any preceding clause, wherein the one or more thermoelectric elements are housed in the lid, the temperature control system further comprising a first heat sink unit in thermal communication with one side of the one or more thermoelectric elements, a second heat sink unit in thermal communication with an opposite side of the one or more thermoelectric elements, and one or more fans, wherein the one or more fans, first heat sink unit and second heat sink unit are at least partially housed in the lid, the first heat sink configured to heat or cool at least a portion of the chamber.

Clause 5. The portable cooler container of any preceding clause, further comprising one or more sensors configured to sense the one or more parameters of the chamber or temperature control system and to communicate the sensed information to the circuitry.

Clause 6. The portable cooler container of any preceding clause, wherein at least one of the one or more sensors is a temperature sensor configured to sense a temperature in the chamber and to communicate the sensed temperature to the circuitry, the circuitry configured to communicate the sensed temperature data to the cloud-based data storage system or remote electronic device.

Clause 7. The portable cooler container of any preceding clause, further comprising one or more electrical contacts on a rim of the container body configured to contact one or more electrical contacts on the lid when the lid is coupled to the container body so that the circuitry controls the operation of the one or more thermoelectric elements and one or more fans when the lid is coupled to the container body.

Clause 8. The portable cooler container of any preceding clause, wherein the gap is under vacuum.

Clause 9. The portable cooler container of any preceding clause, further comprising a removable tray configured to removably receive the containers of medicine therein and to releasably lock the containers in the tray to inhibit dislodgement of the medicine containers from the tray during shipping of the portable cooler container.

Clause 10. The portable cooler container of any preceding clause, further comprising means for thermally disconnecting the one or more thermoelectric elements from the chamber to inhibit heat transfer between the one or more thermoelectric elements and the chamber.

Clause 11. A portable cooler container with active temperature control, comprising:

- a container body having a chamber configured to receive and hold one or more medicine containers, the chamber defined by a base and an inner peripheral wall of the container body;
- a lid removably coupleable to the container body to access the chamber; and
- a temperature control system comprising
  - one or more thermoelectric elements and one or more fans, one or both of the thermoelectric elements and fans configured to actively heat or cool at least a portion of the chamber,
  - one or more batteries, and
  - circuitry configured to control an operation of the one or more thermoelectric elements to heat or cool at least a portion of the chamber to a predetermined temperature or temperature range.

Clause 12. The portable container of clause 11, wherein the body comprises an outer peripheral wall and a bottom portion attached to the outer peripheral wall, the inner peripheral wall being spaced relative to the outer peripheral wall to define a gap between the inner peripheral wall and the outer peripheral wall, the base spaced apart from the bottom portion to define a cavity between the base and the bottom portion, the one or more batteries and circuitry at least partially disposed in the cavity.

Clause 13. The portable cooler container of any of clauses 11-12, wherein the one or more thermoelectric elements are housed in the lid, the temperature control system further comprising a first heat sink unit in thermal communication with one side of the one or more thermoelectric elements, a second heat sink unit in thermal communication with an opposite side of the one or more thermoelectric elements, wherein the one or more fans, first heat sink unit and second heat sink unit are at least partially housed in the lid, the first heat sink configured to heat or cool at least a portion of the chamber.

Clause 14. The portable cooler container of any of clauses 11-13, further comprising one or more sensors, at least one of the one or more sensors is a temperature sensor configured to sense a temperature in the chamber and to communicate the sensed temperature to the circuitry.

Clause 15. The portable cooler container of any of clauses 11-14, wherein the circuitry further comprises a transmitter configured to transmit one or both of temperature and position information for the portable cooler container to one or more of a memory of the portable cooler container, a radiofrequency identification tag of the portable cooler containers, a cloud-based data storage system, and a remote electronic device.

Clause 16. The portable cooler container of any of clauses 11-15, further comprising a display on one or both of the container body and the lid, the display configured to display information indicative of a temperature of the chamber.

Clause 17. The container of any of clauses 11-16, further comprising one or more electrical contacts on a rim of the container body configured to contact one or more electrical contacts on the lid when the lid is coupled to the container body, the circuitry being housed in the container body and the one or more thermoelectric elements being housed in the lid, the electrical contacts facilitating control of the operation of the one or more thermoelectric elements and one or more fans by the circuitry when the lid is coupled to the container body.

Clause 18. The portable cooler container of any of clauses 11-17, wherein the gap is under vacuum.

Clause 19. The portable cooler container of any of clauses 11-18, further comprising means for thermally disconnecting the one or more thermoelectric elements from the chamber to inhibit heat transfer between the one or more thermoelectric elements and the chamber.

Clause 20. A portable cooler container with active temperature control, comprising:

a container body having a chamber configured to receive and hold one or more volumes of perishable liquid, the chamber defined by a base and an inner peripheral wall of the container body;

a lid movably coupled to the container body by one or more hinges; and a temperature control system, comprising one or more thermoelectric elements configured to actively heat or cool at least a portion of the chamber, one or more power storage elements, circuitry configured to control an operation of the one or more thermoelectric elements to heat or cool at least a portion of the chamber to a predetermined temperature or temperature range, the circuitry further configured to wirelessly communicate with a cloud-based data storage system or a remote electronic device; and an electronic display screen disposed on one or both of the container body and the lid, the display screen configured to selectively display shipping information for the portable cooler container.

Clause 21. The portable cooler container of clause 20, wherein the electronic display screen is an electrophoretic display screen.

Clause 22. The portable cooler container of any of clauses 20-21, further comprising a button or touch screen actuatable by a user to automatically switch sender and recipient information on the display screen to facilitate return of the portable cooler container to a sender.

Clause 23. The portable cooler container of any of clauses 20-22, further comprising means for thermally disconnecting the one or more thermoelectric elements from the chamber to inhibit heat transfer between the one or more thermoelectric elements and the chamber.

While certain embodiments of the inventions have been described, these embodiments have been presented by way of example only, and are not intended to limit the scope of the disclosure. Indeed, the novel methods and systems described herein may be embodied in a variety of other forms. For example, though the features disclosed herein are in described for medicine containers, the features are applicable to containers that are not medicine containers (e.g., portable coolers for food, etc.) and the invention is understood to extend to such other containers. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A portable cooler container with active temperature control, comprising:

a double-walled vacuum insulated container body having a chamber configured to receive and hold one or more temperature sensitive products;

a lid hingedly coupleable or removably coupleable to the container body; and a temperature control system of the container body at least partially disposed between an outer wall of the container body below the lid and an inner wall of the container body that defines at least a portion of the chamber, comprising one or more thermoelectric elements in thermal communication with the chamber and configured to actively heat or cool said at least a portion of the chamber, one or more batteries, and circuitry configured to control an operation of the one or more thermoelectric elements to heat or cool at least a portion of the chamber to a predetermined temperature or temperature range, the circuitry further configured to wirelessly communicate with a cloud-based data storage system or a remote electronic device; and an electronic display screen that displays shipping address information for the portable cooler container.

2. The portable cooler container of claim 1, wherein the electronic display screen is an electrophoretic display screen.

3. The portable cooler container of claim 1, further comprising a button or touch screen manually actuatable by a user to automatically switch sender and recipient information on the electronic display screen to facilitate return of the portable cooler container to a sender.

4. The portable cooler container of claim 1, further comprising means for thermally disconnecting the one or more thermoelectric elements from the chamber to inhibit heat transfer between the one or more thermoelectric elements and the chamber.

5. The portable cooler container of claim 1, wherein the temperature control system further comprises a first heat sink unit in thermal communication with one side of the one or more thermoelectric elements, a second heat sink unit in thermal communication with an opposite side of the one or more thermoelectric elements, one or more fans, and one or more air intake openings and air exhaust openings defined in a surface of the container body, the first heat sink unit configured to heat or cool at least a portion of the chamber.

6. The portable cooler container of claim 1, further comprising one or more sensors configured to sense one or more parameters of the chamber or temperature control system and to communicate the sensed information to the circuitry.

7. The portable cooler container of claim 6, wherein at least one of the one or more sensors is a temperature sensor configured to sense a temperature in the chamber and to communicate the sensed temperature to the circuitry, the circuitry configured to communicate the sensed temperature data to the cloud-based data storage system or remote electronic device.

8. The portable cooler container of claim 1, further comprising one or more electrical contacts on a rim of the container body configured to contact one or more electrical contacts on the lid when the lid is coupled to the container body so that the circuitry controls the operation of one or more electronic components in the lid when the lid is coupled to the container body and power is transmitted from the one or more batteries to the one or more electronic components in the lid via the electrical contacts.

9. The portable cooler container of claim 1, further comprising a removable tray removably insertable in the chamber, the one or more temperature sensitive products comprising one or more containers of medicine removably received in one or more compartments of the tray to releasably lock the containers of medicine in the tray to inhibit dislodgement of the containers of medicine from the tray during shipping of the portable cooler container.

10. The portable cooler container of claim 1, wherein the circuitry further comprises a transmitter configured to transmit one or both of temperature and position information for the portable cooler container to one or more of a memory of the portable cooler container, a radiofrequency identification tag of the portable cooler container, the cloud-based data storage system, and the remote electronic device.

11. The portable cooler container of claim 1, wherein the lid is configured to be locked to the container body, and further comprising a keypad configured to receive an access code from a user to unlock the lid from the container body.

12. The portable cooler container of claim 1, wherein the circuitry is configured to control the operation of the one or more thermoelectric elements to heat or cool at least a portion of the chamber to a predetermined temperature or temperature range when the portable cooler is disposed on a power base.

13. A portable cooler container with active temperature control, comprising:

a double-walled vacuum insulated container body having a chamber configured to receive and hold one or more perishable products;

a lid hingedly coupleable or removably coupleable to the container body; and a temperature control system of the container body at least partially disposed between an outer wall of the container body below the lid and an inner wall of the container body that defines at least a portion of the chamber, comprising one or more thermoelectric elements in thermal communication with the chamber and configured to actively heat or cool at least a portion of the chamber, one or more batteries, and circuitry configured to control an operation of the one or more thermoelectric elements to heat or cool at least a portion of the chamber to a predetermined temperature or temperature range, the circuitry further configured to wirelessly communicate with a cloud-based data storage system or a remote electronic device.

14. The portable cooler container of claim 13, further comprising an electronic display screen on one of the container body and the lid.

15. The portable cooler container of claim 14, further comprising a button or touch screen manually actuatable by a user to automatically switch sender and recipient information on the electronic display screen to facilitate return of the portable cooler container to a sender.

16. The portable cooler container of claim 13, wherein the lid is configured to be locked to the container body, and further comprising a keypad configured to receive an access code from a user to unlock the lid from the container body.

17. The portable cooler container of claim 13, wherein the temperature control system further comprises a first heat sink unit in thermal communication with one side of the one or more thermoelectric elements, a second heat sink unit in thermal communication with an opposite side of the one or more thermoelectric elements, one or more fans, and one or more air intake openings and air exhaust openings defined in a surface of the container body, the first heat sink unit configured to heat or cool at least a portion of the chamber.

18. The portable cooler container of claim 13, further comprising one or more sensors configured to sense one or more parameters of the chamber or temperature control system and to communicate the sensed information to the circuitry, wherein at least one of the one or more sensors is a temperature sensor configured to sense a temperature in the chamber and to communicate the sensed temperature to the circuitry, the circuitry configured to communicate the sensed temperature data to the cloud-based data storage system or remote electronic device.

19. The portable cooler container of claim 13, wherein the circuitry further comprises a transmitter configured to transmit one or both of temperature and position information for the portable cooler container to one or more of a memory of the portable cooler container, a radiofrequency identification tag of the portable cooler containers, the cloud-based data storage system, and the remote electronic device.

20. The portable cooler container of claim 13, wherein the circuitry is configured to control the operation of the one or more thermoelectric elements to heat or cool at least a portion of the chamber to a predetermined temperature or temperature range when the portable cooler is disposed on a power base.

21. A portable cooler container, comprising:

a double-walled vacuum insulated container body having a chamber configured to receive and hold one or more volumes of perishable goods;

a lid hingedly coupleable or removably coupleable to the container body, the lid configured to be selectively locked to the container body, a keypad configured to selectively unlock the lid from the container body upon receipt of an access code from a user; and a control system of the container body at least partially disposed between an outer wall of the container body below the lid and an inner wall of the container body that defines at least a portion of the chamber, comprising one or more batteries, and circuitry configured to wirelessly communicate via one of a radiofrequency communication transmitter or transceiver with a cloud-based data storage system or a remote electronic device; and an electronic display screen on one of the lid and the container body that displays shipping address information for the portable cooler container.

22. The portable cooler container of claim 21, further comprising one or more sensors configured to sense one or more parameters of the chamber and to communicate the sensed information to the circuitry, wherein at least one of the one or more sensors is a temperature sensor configured to sense a temperature in the chamber and to communicate the sensed temperature to the circuitry, the circuitry configured to communicate the sensed temperature data to the cloud-based data storage system or remote electronic device.

23. The portable cooler container of claim 21, wherein the electronic display screen is configured to selectively display shipping information for the portable cooler container, a button or touch screen manually actuatable by a user to automatically switch sender and recipient information on the electronic display screen to facilitate return of the portable cooler container to a sender.

* * * * *